US009247774B2

(12) United States Patent
Davis

(10) Patent No.: US 9,247,774 B2
(45) Date of Patent: Feb. 2, 2016

(54) EASY ACCESS INDIVIDUAL NEEDS ONE PIECE GARMENT

(71) Applicant: Carol Ann Davis, Nederland, TX (US)

(72) Inventor: Carol Ann Davis, Nederland, TX (US)

( * ) Notice: Subject to any disclaimer, the term of this patent is extended or adjusted under 35 U.S.C. 154(b) by 0 days.

(21) Appl. No.: 14/557,426

(22) Filed: Dec. 1, 2014

(65) Prior Publication Data

US 2015/0082509 A1 Mar. 26, 2015

Related U.S. Application Data

(63) Continuation-in-part of application No. 12/881,047, filed on Sep. 13, 2010, now Pat. No. 8,898,813.

(60) Provisional application No. 61/276,420, filed on Sep. 12, 2009.

(51) Int. Cl.
*A41D 13/02* (2006.01)

(52) U.S. Cl.
CPC ..... *A41D 13/02* (2013.01); *A41D 2400/44* (2013.01)

(58) Field of Classification Search
CPC ..... A41D 13/02; A41D 13/0537; A41D 2400/44; A41D 2300/322
See application file for complete search history.

(56) References Cited

U.S. PATENT DOCUMENTS

| | | | |
|---|---|---|---|
| 34,635 | A | 3/1862 | Herron |
| 498,951 | A | 6/1893 | Birnbaum |
| 1,110,052 | A | 9/1914 | Hatch |
| 1,110,054 | A | 9/1914 | Hatch |
| 1,112,720 | A | 10/1914 | Powell |
| 1,326,536 | A | 12/1919 | Slattery |
| 1,537,230 | A | 5/1925 | Godbehere |
| 1,783,538 | A | 6/1929 | Herskowitz |
| 1,902,843 | A | 3/1933 | Ferrari et al. |
| 2,064,266 | A | 12/1936 | Murphey |
| 2,228,624 | A | 1/1941 | Frank |
| 2,263,146 | A | 11/1941 | Smith |
| 2,333,240 | A | 11/1943 | Florian |

(Continued)

FOREIGN PATENT DOCUMENTS

| | | |
|---|---|---|
| CN | 102612325 | 2/2015 |
| GB | 2487159 | 4/2014 |
| WO | WO2009/064094 | 5/2009 |

OTHER PUBLICATIONS

First Nonfinal office action mailed Sep. 19, 2012 in parent U.S. Appl. No. 12/881,047 (19 pages).

(Continued)

*Primary Examiner* — Richale Quinn
(74) *Attorney, Agent, or Firm* — Gordon G. Waggett, P.C.

(57) ABSTRACT

A one-piece garment employing a drop seat panel configured or modified to permit the wearer to have restroom breaks or attend to other individual needs without being required to partially or fully remove the garment is disclosed. The garment creates a horizontal separation at the back waistband that goes from side seam to side seam; vertical separation of the front of the garment from the back of the garment beginning at the waistband and running down both side seams to the desired length. The garment includes a closures to close the vertical separation of the garment from the waistband down each side seam the length of the opening; and closures to attach the back bottom part of the one piece garment to the top back part of the one piece garment in the region where the separation of the garment runs horizontally between the side seams.

19 Claims, 54 Drawing Sheets

(56) References Cited

U.S. PATENT DOCUMENTS

| | | | |
|---|---|---|---|
| 2,347,354 | A | 4/1944 | Leubrie |
| 2,357,532 | A | 9/1944 | Menzin |
| 2,923,009 | A | 2/1960 | Cookman |
| 3,088,116 | A | 5/1963 | Simonoff |
| 3,246,342 | A | 4/1966 | Pagano |
| 3,711,865 | A | 1/1973 | Schifman |
| 3,852,824 | A | 12/1974 | Grey |
| 3,949,427 | A | 4/1976 | Sampey |
| 3,956,774 | A | 5/1976 | Spaulding |
| 3,994,026 | A | 11/1976 | Sampey |
| 4,457,025 | A | 7/1984 | Meryash |
| 4,535,480 | A | 8/1985 | Kunieda |
| 4,607,396 | A | 8/1986 | Craig |
| 4,941,209 | A | 7/1990 | George |
| 5,068,920 | A | 12/1991 | Bray |
| 5,163,182 | A | 11/1992 | Fiveash |
| 5,473,780 | A | 12/1995 | Zen |
| D375,824 | S | 11/1996 | Volpati |
| 5,794,267 | A | 8/1998 | Wallace |
| 5,822,802 | A | 10/1998 | Chou |
| 5,896,581 | A | 4/1999 | Wong |
| D410,689 | S | 6/1999 | Slokevage |
| 6,327,715 | B1 | 12/2001 | Castiglione |
| 6,477,711 | B1 | 11/2002 | Freeman et al. |
| 6,789,269 | B1 | 9/2004 | Scovin |
| D505,535 | S | 5/2005 | Kern |
| 6,941,584 | B1 | 9/2005 | Matthews |
| D550,428 | S | 9/2007 | Kern |
| 8,256,023 | B2 | 9/2012 | Park et al. |

OTHER PUBLICATIONS

Response filed Mar. 19, 2013 to First Nonfinal office action mailed Sep. 19, 2012 in parent U.S. Appl. No. 12/881,047 (18 pages).

Final office action mailed Sep. 19, 2012 in parent U.S. Appl. No. 12/881,047 (21 pages).

Response filed Jan. 9, 2014 to Final office action mailed Sep. 19, 2012 in parent U.S. Appl. No. 12/881,047 (20 pages).

Notice of Allowance and Fees Due, and Notice of Allowability mailed Mar. 31, 2014 in parent U.S. Appl. No. 12/881,047 (14 pages).

IPO / UK Patent Office—UK Patent Application No. GB1206450.7—GB counterpart to parent patent application, "Examination Report under section 18(3)" mailed Mar. 22, 2013. 5 pages. All of the prior art cited therein is believed to have already been provided to the Examiner in previous Information Disclosure Statements filed in this application.

IPO / UK Patent Office—UK Patent Application No. GB1206450.7—GB counterpart to parent patent application. Response dated Jul. 22, 2013 to the Mar. 22, 2013 Examination Report. (33 pages).

IPO / UK Patent Office—UK Patent Application No. GB1206450.7—GB counterpart patent application. Cover Letter and two copies of "Examination Report under Section 18(3)" mailed Sep. 26, 2013. The Examination Report encloses U.S. Pat. No. 2,064,266 issued to Murphey on Dec. 15, 1936. 7 pages.

IPO / UK Patent Office—UK Patent Application No. GB1206450.7—GB counterpart to parent patent application. Response dated Dec. 18, 2013 to the Sep. 26, 2013 Examination Report. (13 pages).

IPO / UK Patent Office—UK Patent Application No. GB1206450.7—GB counterpart to parent patent application. Examination Report dated Jan. 2, 2014 (2 pages).

IPO / UK Patent Office—UK Patent Application No. GB1206450.7—GB counterpart to parent patent application. Response dated Jan. 2, 2014 to Examination Report dated Jan. 2, 2014 (10 pages).

IPO / UK Patent Office—UK Patent Application No. GB1206450.7—GB counterpart to parent patent application. Notification of Grant dated Apr. 1, 2014 (2 pages).

IPO / People's Republic of China—China Patent Application No. 201080051215.6—China counterpart patent application. Cover Letter and "First Office Action" issued Dec. 24, 2013 (with translation). 15 pages. All of the prior art cited in the "Final Office Action" is believed to have already been provided to the Examiner in previous Information Disclosure Statements filed in this application, with the exception of WO2009/064094 which is cited above.

IPO / People's Republic of China—China Patent Application No. 201080051215.6—China counterpart patent application. Response to Office Action dated Jun. 30, 2014. (37 pages).

IPO / People's Republic of China—China Patent Application No. 201080051215.6—China counterpart patent application. Notification of Grant dated Oct. 23, 2014. (4 pages).

Excerpts from the website of Williamson-Dickie Mfg. Co. (www.dickies.com) featuring prior art coveralls and bib overalls, . Last accessed Sep. 1, 2010 (46 pages).

Excerpts from the website of Aramark Work Apparel & Uniform Services (www.aramark-uniform.com) featuring prior art coveralls and bib overalls, . Last accessed Sep. 1, 2010 (33 pages).

Excerpts from the website of Carhartt, Inc. (www.carhartt.com) featuring prior art coveralls and bib overalls, . Last accessed Sep. 1, 2010 (80 pages).

Excerpts from the website of GHC Specialty Brands, LLC. (www.gemplers.com) featuring prior art coveralls and bib overalls, . Last accessed Sep. 1, 2010 (19 pages).

Excerpts from the website of Wenaas USA (www.wenaasusa.com) featuring prior art coveralls and bib overalls, . Last accessed Sep. 1, 2010 (48 pages).

Wikipedia, The Free Encyclopedia—definition of "Drop Seat" (http://en.wikipedia.org/wiki/Drop_seat), last accessed Sep. 1, 2010. 2 pages.

Wikipedia, The Free Encyclopedia—definition of "Jumpsuit" (http://en.wikipedia.org/wiki/Jumpsuit), last accessed Sep. 1, 2010. 7 pages.

DuPont Personal Protection (USA), website excerpts (http://www2.dupont.com/Personal_l Protection/en_US/) last accessed Sep. 2, 2010, 2 pages.

Percy, C. Sewing in a Zipper, Threads #89, pp. 14 and 16 (Oct. 17, 2008) http://www.threadsmagazine.com/item/3728/sewing-in-a-zipper. 4 pages.

PCT International Search Report in counterpart PCT International Application No. PCT/US2010/048684 (May 19, 2011), 3 pages.

PCT Written Opinion in counterpart PCT International Application No. PCT/US2010/048684 (May 19, 2011), 4 pages.

PCT Notification of ISR and WO in counterpart PCT International Application No. PCT/US2010/048684 (May 19, 2011), 2 pages.

DuPont Controlled Environments Garment and Product catalog (2010), 20 pages, accessed Jun. 20, 2011, http://www.dupontcatalog.com/controlledenvironments/WebProject.asp?CodeId=7.3.5.6&BookCode=cev&from=2.

DuPont Personal Protection Controlled Environment Apparel Selection Guide, 2 pages, (2009), available online at http://www2.dupont.com/Personal_Protection/en_US/assets/downloads/cleanroom/07_09/DSP_Controlled_Environment_Guide_K17536.pdf.

DuPont Personal Protection Product catalog (2011), 59 pages, accessed Jun. 20, 2011, http://www.dupontcatalog.com/personalprotection/WebProject.asp?CodeId=7.5.1.3&BookCode=dpp11flx&from=2.

Chocko Powersports 2012 Catalog. CDI International Inc. 45-page pdf (showing catalog pp. 1-88). See p. 51 (pdf 26/45). First Accessed May 21, 2012.

Working Woman Workwear, Toronto, Ontario, Canada—complete current set of screenshots from the website http://www.working-woman-workwear.com (accessed Jul. 20, 2012). 10 pages.

Internet Archive WayBack Machine (http://web.archive.org) search results for www.workingwoman-workwear.com showing crawl dates for archive pages available in 2007, 2008 and 2011. 5 pages. (Accessed Jul. 20, 2012).

Working Woman Workwear, Toronto, Ontario, Canada—true and correct copy of complete set of screenshots from internet archive (http://web.archive.org) for the website http://www.workingwoman-workwear.com dated May 29, 2007 (see footer)(last accessed Jul. 20, 2012). 6 pages.

Working Woman Workwear, Toronto, Ontario, Canada—true and correct complete set of screenshots from internet archive (http://web.archive.org) for the website http://www.workingwoman-workwear.com dated Jun. 12, 2008 (see footer)(last accessed Jul. 20, 2012). 6 pages.

(56) References Cited

OTHER PUBLICATIONS

Working Woman Workwear, Toronto, Ontario, Canada—true and correct complete set of screenshots from internet archive (http://web.archive.org) for the website http://www.workingwoman-workwear.com dated Feb. 9, 2011 (see footer)(last accessed Jul. 20, 2012). 6 pages.

Johnson, Elizabeth, "Women in Male-Dominated Occupations, Part 1". Sep. 14, 2005. 4 pages. Published by Safety X Change, http://www.safetyxchange.org/financing-safety/women-in-male-dominated-occupations-part-1#.

Johnson, Elizabeth, "Female Workers and the PPE Challenge". Sep. 21, 2005. 3 pages. Published by Safety X Change, http://www.safetyxchange.org/financing-safety/female-workers-the-ppe-challenge#.

Johnson, Elizabeth, "The Female Worker and the PPE Challenge". Sep. 28, 2005. 4 pages. Published by Safety X Change, http://www.safetyxchange.org/financing-safety/the-female-worker-the-ppe-challenge#.

Propper™ Improved CVC Nomex Coverall from epropper.com. 2 page website screenshot. Last Accessed Jul. 20, 2012. First Accessed May 21, 2012. https://www.epropper.com/products/174/productgroup/9/PROPPER%99_Improved_CVC_Nomex_Coverall.htm. Applicant does not know date of this content.

Choko Design Ladies Tall Drop Seat Waterproof Snow Bib. 2 page website screenshot. Last Accessed Jul. 20, 2012. First Accessed May 21, 2012. http://www.overallwarehouse.com/Choko-Design-Ladies-Tall-Drop-Seat-Waterproof-Snow-Bib/10036688/Product. Applicant does not know date of this content.

eBay online product listing for Gill Women's Key West Foul Weather Drop Seat Trousers. Last Accessed Jul. 20, 2012. First Accessed May 21, 2012. 20 pages. http://www.ebay.com/itm/Gill-Womens-Key-West-Foul-Weather-Drop-Seat-Trousers-/380214154980. Applicant does not know date of this content, however, part of date appears to indicate that the content was last updated on Oct. 15, 2010.

Wikipedia, The Free Encyclopedia—definition of "Drop Seat" (http://en.wikipedia.org/wiki/Drop_seat), last accessed Sep. 1, 2010. 2 pages. This reference was noted in the IDS filed Jun. 21, 2011 but the uploaded document was corrupt (unreadable) and is being resubmitted here.

EASY ACCESS INDIVIDUAL NEEDS ONE PIECE GARMENT

CROSS-REFERENCE TO RELATED APPLICATIONS

This application is a continuation-in-part of U.S. Nonprovisional patent application Ser. No. 12/881,047 entitled "Easy access individual needs one piece garment" filed Sep. 13, 2010, Confirmation No. 1323, issuing as U.S. Pat. No. 8,898,813 which in turn claims the benefit of the filing date of and priority to U.S. Provisional Application Ser. No. 61/276,420 filed Sep. 12, 2009, Confirmation No. 4811. Said applications are incorporated herein by reference in their entireties.

COPYRIGHT AUTHORIZATION UNDER 37 CFR 1.71

A portion of the disclosure of this patent document contains material which is subject to copyright protection. The copyright owner has no objection to the facsimile reproduction by anyone of the patent document or the patent disclosure, as it appears in the Patent and Trademark Office patent file or records, but otherwise reserves all copyright rights whatsoever.

STATEMENT REGARDING FEDERALLY SPONSORED RESEARCH OR DEVELOPMENT

Not Applicable.

BACKGROUND OF THE INVENTION

1. Field of Use

One piece garments exist for men, women and children for a variety of functional and fashionable uses. For example, in present disclosure pertains generally to one-piece clothing, such as coveralls, overalls, bib overalls, biberalls, personal protective clothing bibs and overalls, athletic bibs, ski bibs, snowsuits, jumpsuits and the like, and more specifically, to this style of clothing configured or modified to permit restroom breaks or attending to other individual needs without being required to partially or fully remove the garment.

When wearing an ordinary one piece garment a person must partially or completely remove the garment to take care of individual needs. The partial or complete removal of the garment is time consuming, difficult, frustrating, embarrassing, and can be a safety and health risk.

2. Background Technology

Jumpsuits are generally regarded as a garment of convenience, as they are simpler to launder, put on and remove than an ensemble outfit. Unless the jumpsuit has a drop seat, however, it is necessary to remove it entirely for bathroom use. Numerous jumpsuit designs have appeared for work and leisure applications. Various designs of jumpsuits have been developed and patented. Several jumpsuits with drop seats have been proposed. For example U.S. Pat. No. 1,537,230 (Godbehere) discloses a jumpsuit having a drop seat secured at its upper edge by a belt.

U.S. Pat. No. 4,941,209 (George) relates to a unitary garment which includes an upper and lower portion. The upper and lower portions of the unitary garment are configured to fit the top and bottom of a human torso respectively. The lower portion further includes a detachable drop-seat panel which is fastened along its side edges toward the front of the unitary garment and in the pocket area. The unitary garment further includes two pockets associated with the lower portion such that the pockets are configured to substantially conceal the fastening means and resulting fastened side edges of the drop-seat panel.

U.S. Pat. No. 3,956,774 (Spaulding) discloses a jumpsuit having a drop seat secured at its upper edge by a belt and; a jumpsuit having a sliding fastener that extends from the inside of one ankle to the inside of the other ankle along the normal inseam of the garment; and a jumpsuit having a sliding fastener that extends along a vertical seam from the neck on front, downward through the crotch region, and then back up to the neck in back.

U.S. Pat. No. 3,994,026 (Sampey) discloses a jumpsuit garment with integral drop seat flap secured at its upper edge by a belt with additional hook and loop fastening behind the belt.

U.S. Pat. No. 4,457,025 (Meryash) discloses a jump suit with a rear drop-seat panel that opens downwardly. The suit has a flexible panel mounted across the inside front portion thereof to define pockets therewith. The panel further extends on either side of the suit to define tapered flaps which overlap around the rear portion of the suit near the waist and under the drop-seat panel when it is raised to the closed position. The overlapped flaps are joined by attaching means such as VELCRO and the drop-seat panel has attaching means thereon such as VELCRO or zippers which engage matching fasteners on proximate portions of the flaps when the panel is closed over the flaps. The overlapped flaps supplement the strength of the jump suit and enhance the fit thereof and reduce draftiness at the seams of the drop-seat panel. Meryash discloses a jumpsuit with drop seat in which underflaps overlap inside the drop seat flap to enhance the fit of the jumpsuit and to reinforce the jumpsuit in this area with the drop seat panel up or down and also prevent the suit from being "drafty" or open at the panel edges when the drop seat panel is raised in the closed position.

U.S. Pat. No. 5,896,581 (Wong) discloses a unitary garment with a modified and improved drop-seat which is not overtly detectable by the casual observer. The rear portion of the garment is constructed with two plies of fabric. The inner ply contains a teardrop-shaped aperture (Wong 12) bounded by elastic around the perimeter. The outer ply incorporates a trapezoidal-shaped lappet (Wong 20) with elasticized sides. The combination of these two innovations enables a heretofore unachievable style line which closely conforms to body contours. Due to the elastic tension around the perimeter the aperture is relatively static in relation to the buttocks and upper thigh thereby allowing the wearer freedom of movement during toilet and personal hygiene activities without fear of inadvertently wetting or soiling the garment. Multiple styling embodiments are possible (e.g., jumpsuit, culottes, shorts, formal-, casual-, sports-wear, et al).

U.S. Pat. No. 5,473,780 (Zen) discloses a one-piece body suit (cat suit or jump suit or romper) that has a rear drop-seat portion. That portion is formed with a central panel and two opposite triangular panels extending therefrom which cross each other at the front of the garment. Fastener ends at the ends of the triangular panels are removably fastened at the back of the wearer.

U.S. Pat. No. 6,941,584 (Matthews) discloses a jump suit having features effective for both male and female users that includes a central zippered opening extends downward from waistband along the crotch between left and right pants legs. A main zipper controlled by a pair of keepers and opens and closes the opening, which extends from the waistband in front to an upper end in the back located slightly above the waistband. This enables opening over the hips when a user is relieving himself. A large lapel on the front of the garment is movable by being folded from a first position where the lapel extends outward to one shoulder without crossing the center to a second position where the lapel extends toward the other shoulder and covers strip of a central vertical vent. Several vents and covering strips removably controlled by zippers are provided around the periphery of a main back panel.

U.S. Pat. No. 5,163,182 (Fiveash) discloses a jumpsuit with a dropseat panel concealed by a folded pocket panel. When the dropseat is opened, the upper free edge of the pocket has a length selected such that it controls movement of the dropseat panel and its attached waistband, maintaining the waistband in contact with the wearer's body whereby the waistband cannot fall into a toilet.

SUMMARY OF INVENTION

In one embodiment of the present invention there is disclosed and described a one piece garment having horizontal separation of the one piece garment at the back waistband that goes from side seam to side seam; vertical separation of the front of the one piece garment from the back of the one piece garment beginning at the waistband and running down both side seams to the desired length; secure way to close the vertical separation of the one piece garment from the waistband down each side seam the length of the opening; and a secure way to attach the back bottom part of the one piece garment to the top back part of the one piece garment where the separation of the garment runs horizontally from side seam to the other side seam.

In another embodiment of the present disclosure there is described and disclosed a one piece garment comprising: an upper torso section to be worn over at least a part of the upper portion of a human torso; a lower torso section to be worn over at least a part of the lower portion of a human torso and at least the upper portion of the legs; and a drop seat panel capable of being opened and closed. In this embodiment, the upper torso section comprises: an upper torso front panel, an upper torso rear panel, an upper torso right side, and an upper torso left side. The upper torso section front panel meets the upper torso rear panel section at the upper torso left side and upper torso right side. The lower torso section comprises a lower torso front panel, a lower torso rear panel, a lower torso section right side, a lower torso section left side, a left side seam located along an intersection where the lower torso rear panel section and lower torso front panel section meet at the lower torso left side, and a right side seam located along an intersection where the lower torso rear panel section and the lower torso front panel section meet at the lower torso right side. The lower torso section front panel meets the lower torso rear panel section at the lower torso section left side and the lower torso section right side. The lower torso front panel is permanently connected or integral with the upper torso section front panel between the left side seam and the right side seam. In one embodiment, the lower torso rear panel is removably attachable with the upper torso section rear panel between the left side seam and the right side seam.

In one embodiment, the drop seat panel comprises a drop seat panel top edge having left and right ends extending between the left side seam and the right side seam. The drop down seat panel also has a bottom fold line having left and right ends, opposite the drop panel top edge, permanently attached to (or otherwise integral with) the lower torso section rear panel and extending between the left side seam and the right side seam. The drop seat panel also comprises a drop seat panel left side edge, having a left side edge top extending downwardly from the drop panel top edge left side end along the left side seam to a left side edge bottom at the drop panel bottom fold line left end. At least a portion of the drop seat panel left side edge is removably attachable to the lower torso front panel left side seam. The drop seat panel also comprises a drop seat panel right side edge, having a right side edge top extending downwardly from the drop panel top edge right side end along the right side seam to the drop panel bottom fold line right end. At least a portion of the drop seat panel right side edge is removably attachable to the lower torso front panel right side seam. The drop seat panel is also provided with drop seat panel left seam and right seam fasteners for accomplishing such removable attachment or connection.

In one embodiment, the left seam fastener and right seam fastener are selected from the group consisting of zippers, snaps, hook and loop fasteners, buttons and clips, and the like. In another embodiment, the left and right seam fasteners are zippers. In one embodiment, the zippers are hidden within the respective left or right seams.

In another embodiment of the present one piece garment, the drop panel right side edge and drop panel left side edge have lengths extending from about the waist region of the human torso to the bottom of the pants leg section. In another embodiment, the drop panel right side edge and drop panel left side edge have lengths extending from about the waist region of the human torso to the ankles region of the human.

The drop panel top edge may be removably attachable to the upper torso section rear panel and the garment may further comprise a drop panel top edge fastener for removably connecting or attaching the drop panel top edge to the upper torso section rear panel. The drop panel top edge fastener may be selected from the group consisting of zippers, snaps, hook and loop fasteners, buttons and clip, and in one embodiment, the fastener is a zipper.

In yet another embodiment, the drop panel left seam, drop panel right seam, and drop panel top edge further comprise a unitary zipper enclosure to permit or otherwise provide the desired removable attachment. In one embodiment, the zipper extends between the drop panel bottom fold line left end, the left side seam, the drop panel top edge left side, the drop panel top edge and the drop panel top edge right side, the right side seam, and the drop panel bottom fold line right end.

The drop seat panel top edge left end and drop seat panel top edge right end may further comprise additional fasteners for fastening to the lower torso front panel. These fasteners can include snaps, snap tabs, buttons, clips, hooks, belts, sashes, ropes, ties, and the like.

The left side seam and right side seam may be substantially vertical in orientation, or be oriented between vertical and horizontal. In one embodiment, the left side seam and right side seam are substantially diagonal in orientation.

The upper torso rear panel may further comprise a shirttail tuck panel. The drop panel top edge can also have an elastic waist band material attached thereto or integrated therein. Storm flaps can be employed to cover the drop left side seam, right side seam and drop seat panel top edge when the drop seat panel is in its closed position.

As noted above, a portion of said drop seat panel left side edge can be attached to the seam, such as by attaching, to a point of attachment, the drop panel left side edge top. Similarly, the drop panel right side edge top can serve as a single point of attachment to the seam. In another embodiment, substantially the entire portion of drop seat panel left side edge is removably attachable to the lower torso front panel left side seam, and substantially the entire portion of the drop seat panel right side edge is removably attachable to the lower torso front panel right side seam.

The one piece garment can modify the upper torso rear panel to further comprise a shirttail tuck panel extending downwardly below a waist region of the human torso, the shirttail panel having left and right side edges defining the depth of the shirttail and a lower edge extending between the left and right side edges of the shirttail tuck panel. In one embodiment, the shirttail tuck panel left and right side edges are respectively attached to the lower torso front panel left side and right side seams. In one embodiment, the shirttail tuck panel lower edge is substantially parallel to the waist region, while in another, it may have some curvature. In one embodiment, the shirttail extends downwardly to a depth of about half way down the right and left side zipper seams.

In yet another embodiment, the drop panel top edge has elastic waist band material attached thereto or integrated therein wherein the elastic waist band material further comprises: an inside face, an elastic band having opposed ends and comprising a plurality of button holes along its length, a channel in the inside face for housing the elastic band, the channel having opposed slots, the elastic band opposed ends extending outwardly from within the channel through the respectively opposed slots, a first button attached to the inside face proximate one of the slots for securing the elastic band via one of the button holes and a second button attached to the inside face proximate the other one of the slots for securing the elastic band via another one of the button holes.

Additional embodiments employ zipper guards to provide further personal protection for the user. These zipper guards preferably comprise a flat of fabric or other material attached to the zipper seam on the main part of the garment, behind the length of zipper.

BRIEF SUMMARY OF DRAWINGS

The accompanying drawings, which are incorporated in and constitute a part of the specification, illustrate preferred embodiments of the invention. These drawings, together with the general description of the invention given above and the detailed description of the preferred embodiments given below, serve to explain the principles of the invention.

New Drawings

Figure 12A:
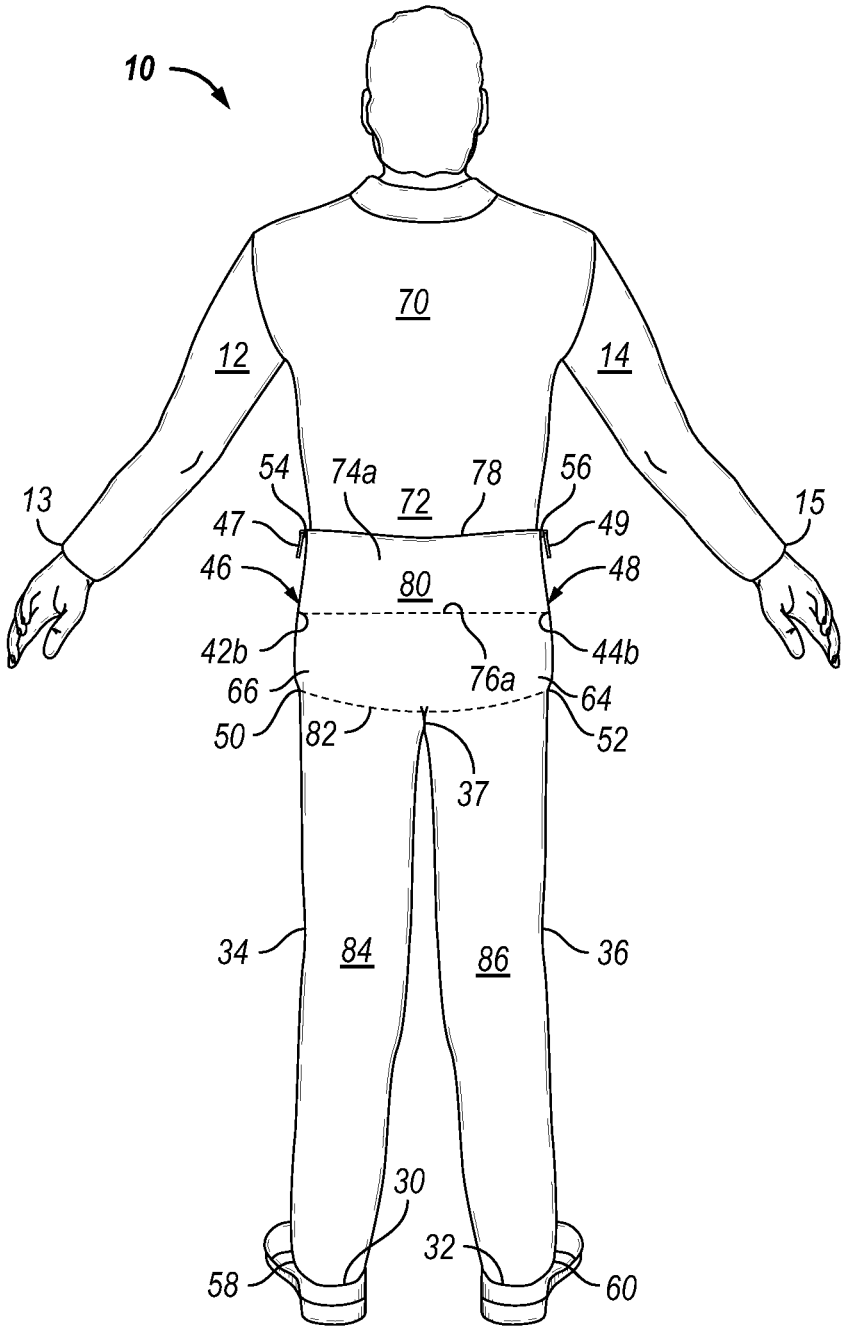

FIG. 12A illustrates a back view of a person wearing a one piece garment (e.g., coveralls, etc.) showing a drop seat panel according to one aspect of the present disclosure (similar to that shown in FIG. 1B) where the drop seat panel is shown in the closed position with the shirttail portion depicted as being squared off and attached at the side seams as a continuation of the body of the back of the garment.

Figure 12B:
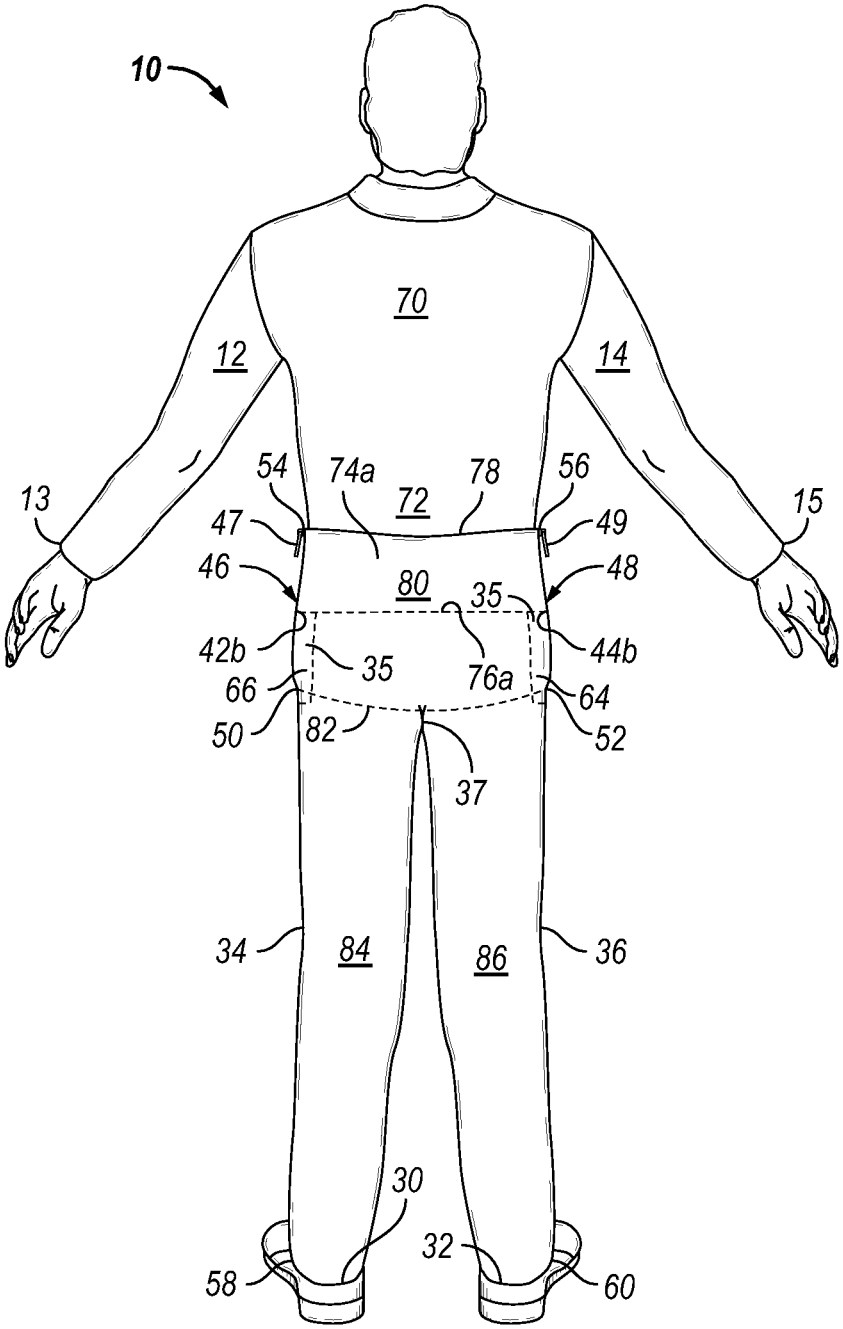

FIG. 12B illustrates a back view of a person wearing a one piece garment (e.g., coveralls, etc.) showing a drop seat panel according to one aspect of the present disclosure (similar to that shown in FIG. 12A) where the drop seat panel is shown in the closed position with the shirttail portion depicted as being squared off and attached at the side seams as a continuation of the body of the back of the garment, and where zipper guards are illustrated.

Figure 13A:
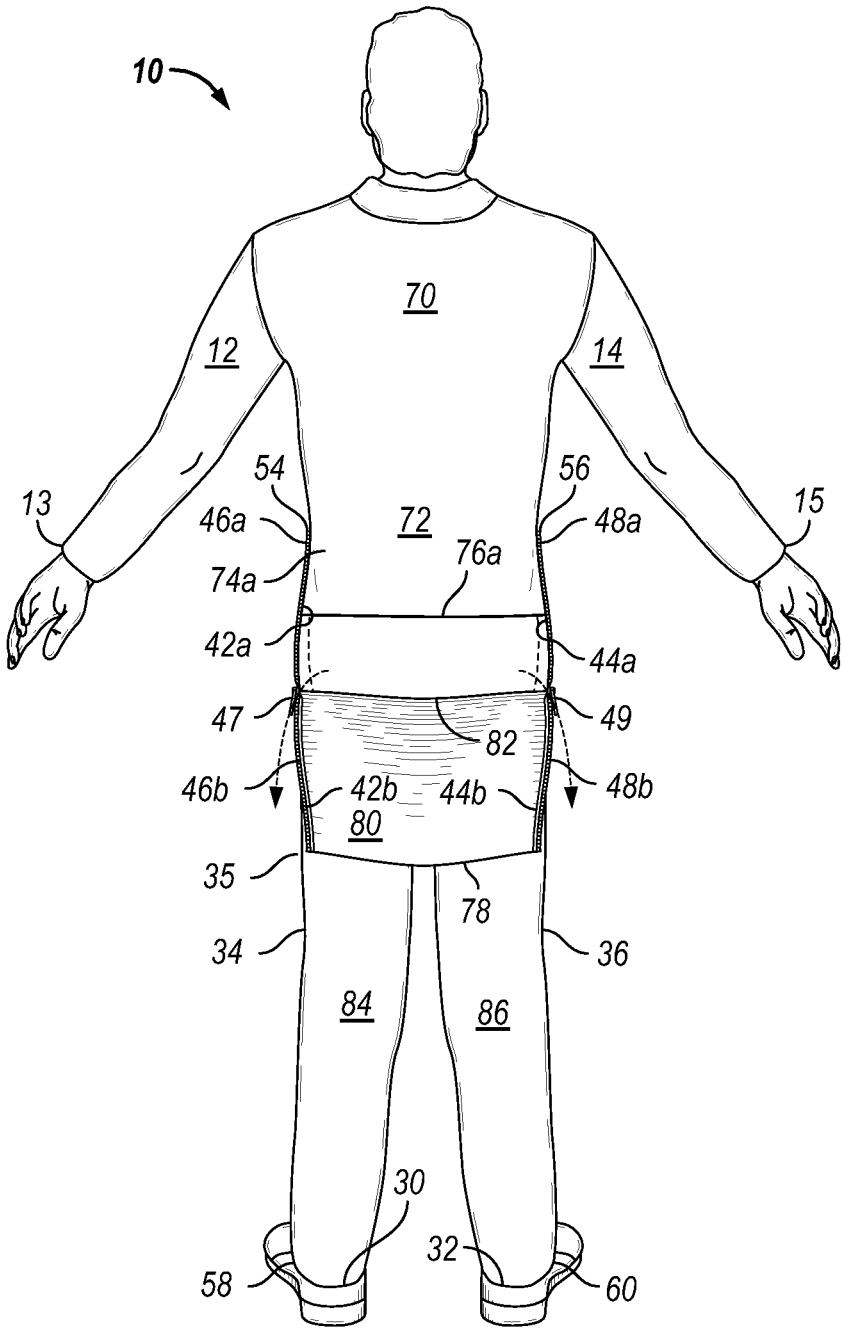

FIG. 13A illustrates a back view of a person wearing a one piece garment (e.g., coveralls, etc.) showing a drop seat panel according to one aspect of the present disclosure (similar to that shown in FIG. 12A) where the drop seat panel is shown in the opened position.

Figure 13B:
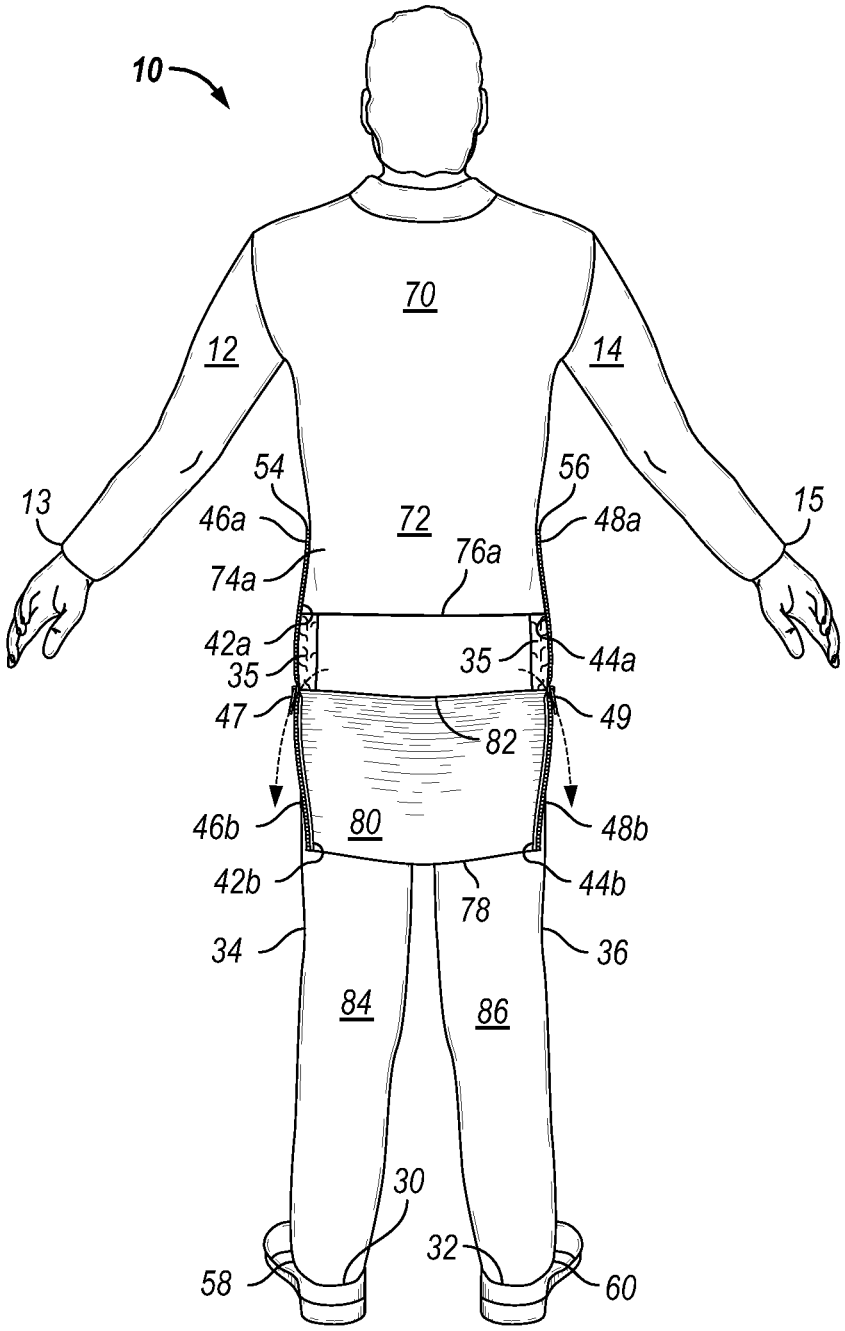

FIG. 13B illustrates a back view of a person wearing a one piece garment (e.g., coveralls, etc.) showing a drop seat panel according to one aspect of the present disclosure (similar to that shown in FIG. 12B) where the drop seat panel is shown in the opened position.

Figure 14:
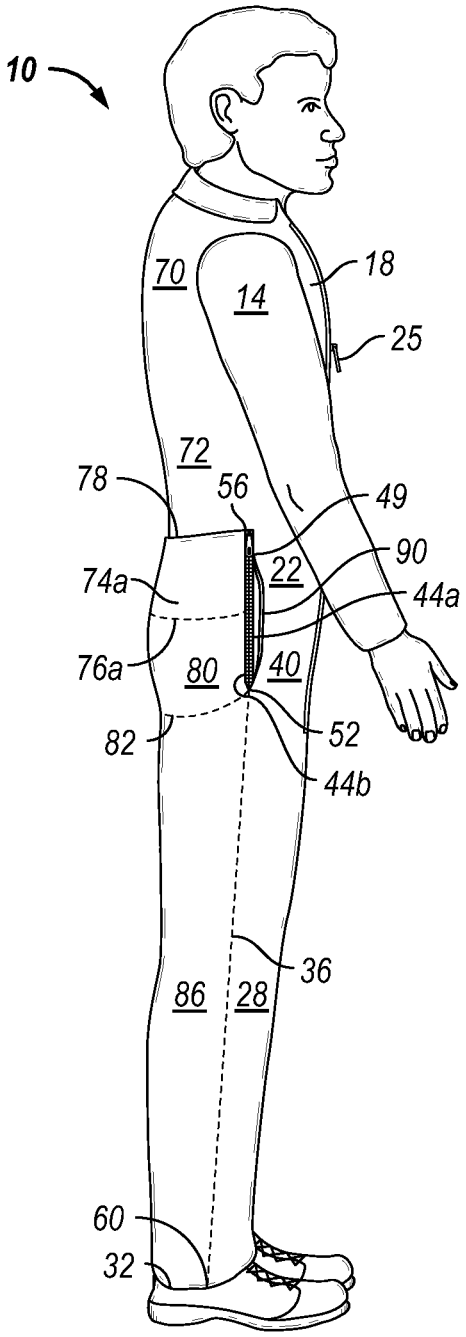

FIG. 14 illustrates a right side view of a person wearing a one piece garment (e.g., coveralls, etc.) showing a drop seat panel configured according to one aspect of the present disclosure (similar to that shown in FIG. 3 and FIG. 12A) where the drop seat panel is shown in the closed position.

Figure 15A:
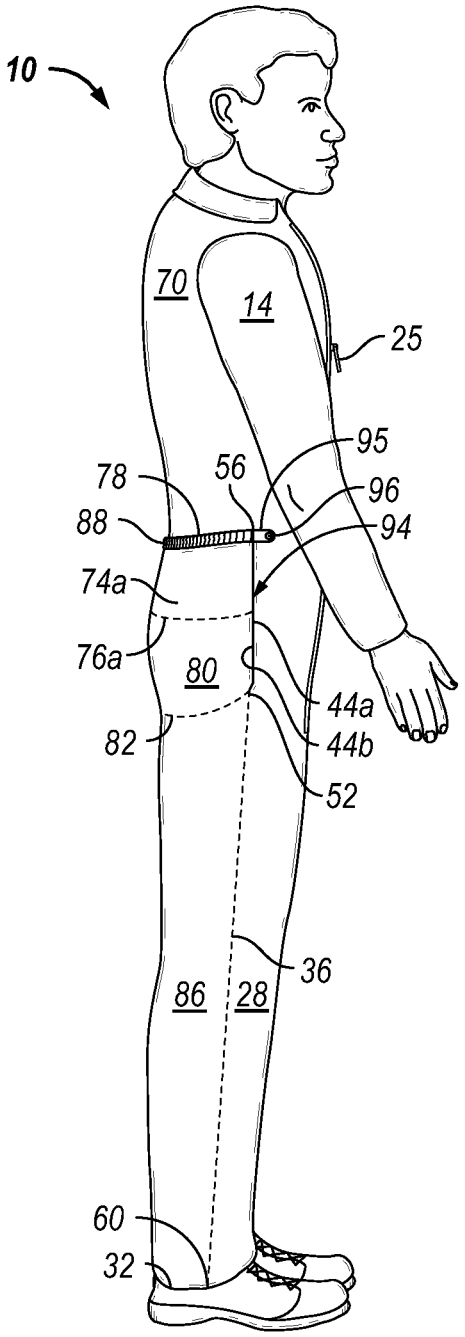

FIG. 15A illustrates a right side view of a person wearing a one piece garment (e.g., coveralls, etc.) showing a drop seat panel configured according to another aspect of the present disclosure (similar to that shown in FIGS. 4A and 12A) where the drop seat panel is shown in the closed position.

Figure 15B:
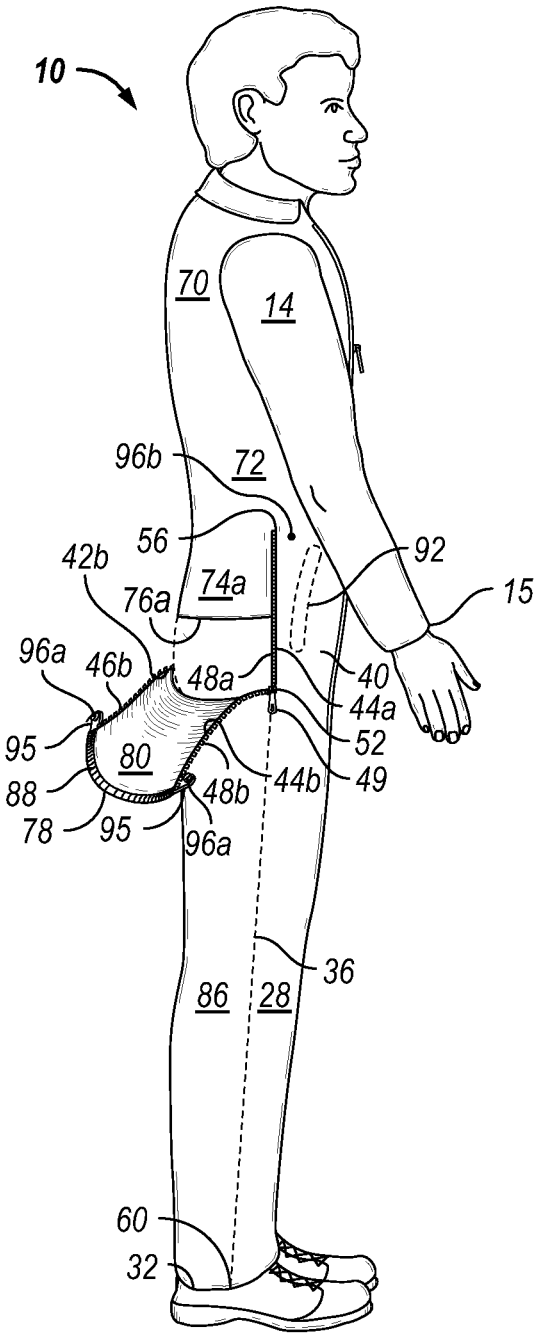

FIG. 15B illustrates a right side view of a person wearing a one piece garment (e.g., coveralls, etc.) showing a drop seat panel configured according to another aspect of the present disclosure (similar to that shown in FIGS. 4B, 12A and 15A) where the drop seat panel is shown in the opened position.

Figure 15C:
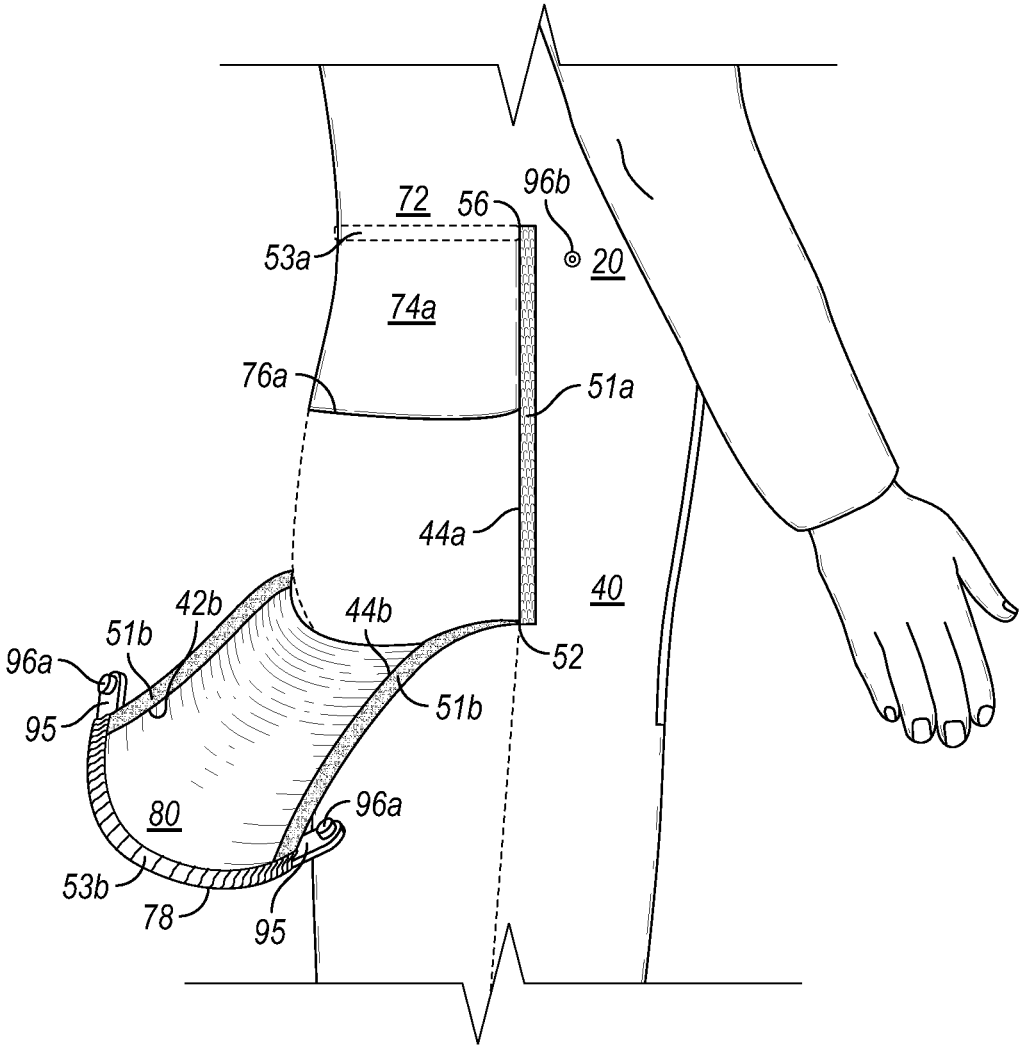

FIG. 15C illustrates a right side view of a person wearing a one piece garment (e.g., coveralls, etc.) showing a drop seat panel configured according to another aspect of the present disclosure (similar to that shown in FIGS. 4C, 12A and 15A) where the drop seat panel is shown in the opened position.

Figure 15D:
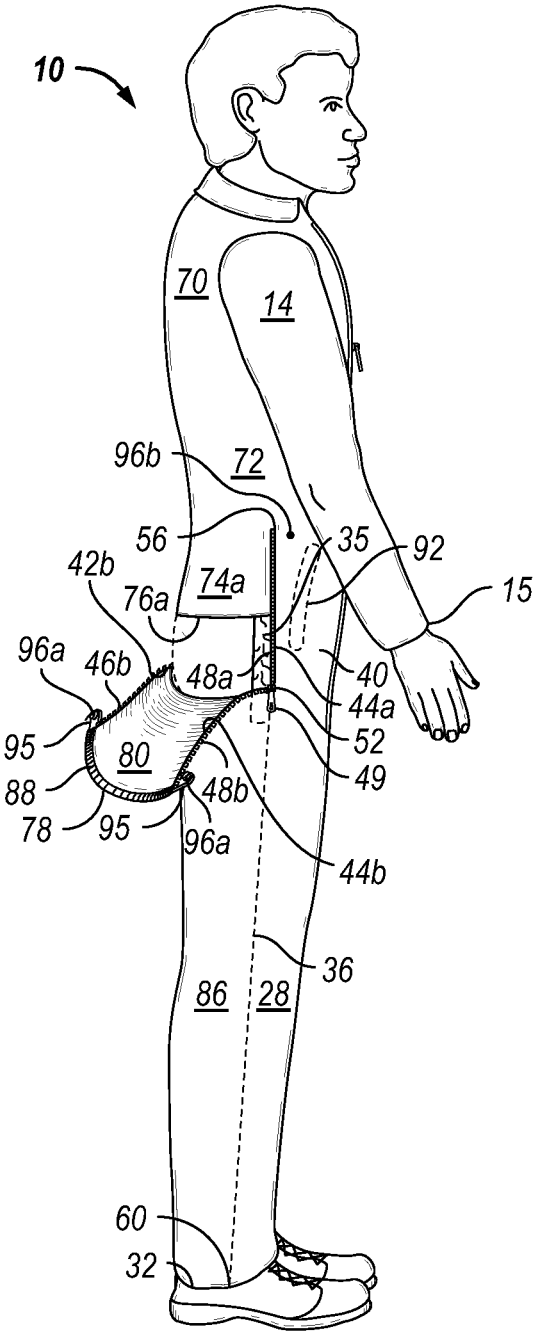

FIG. 15D illustrates a right side view of a person wearing a one piece garment (e.g., coveralls, etc.) showing a drop seat panel configured according to another aspect of the present disclosure (similar to that shown in FIGS. 4C, 12B, 13B and 15B) where the drop seat panel is shown in the opened position.

Figure 16A:
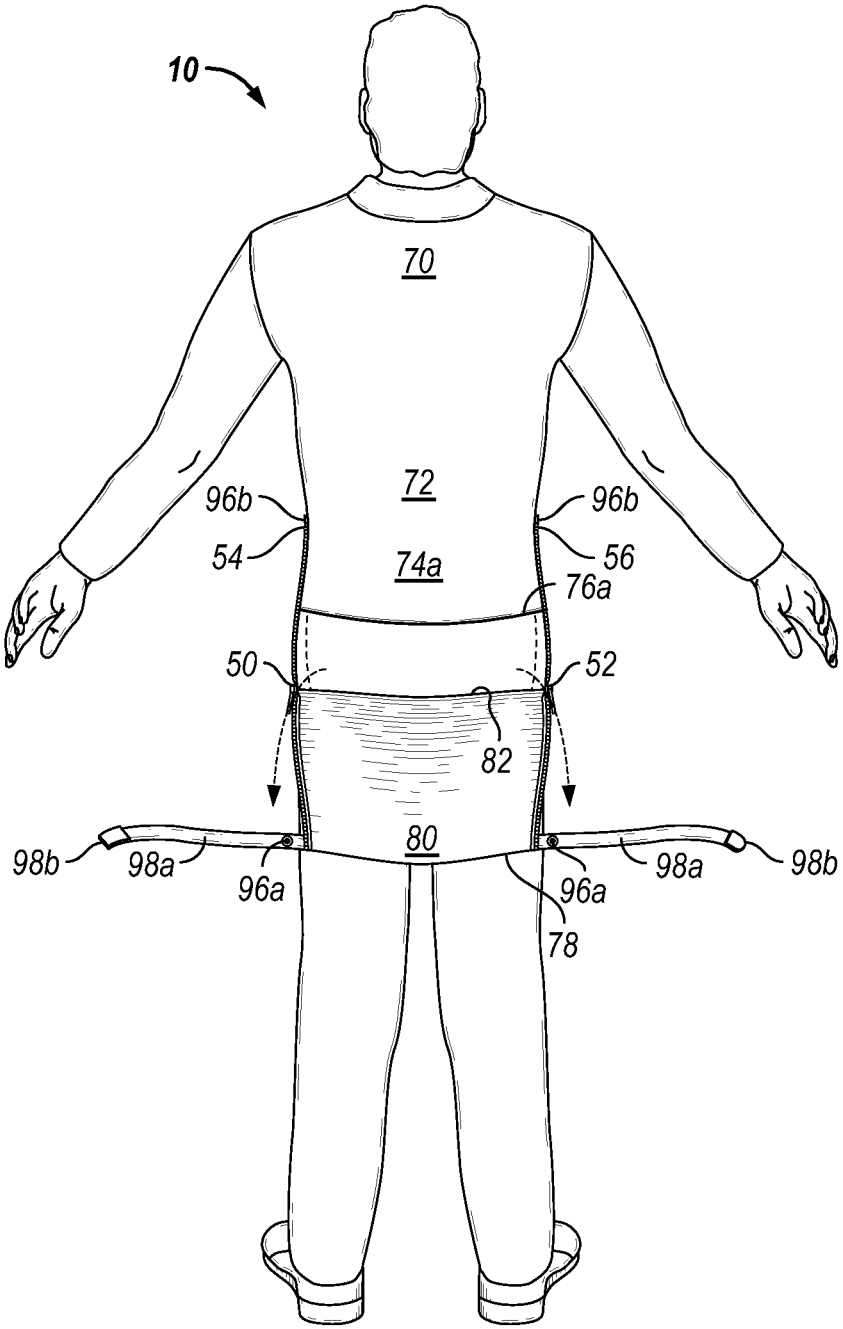

FIG. 16A illustrates a back view of a person wearing a one piece garment (e.g., coveralls, etc.) showing a drop seat panel according to another aspect of the present disclosure (similar to FIG. 5A) where the drop seat panel is shown in the opened position with the shirttail portion depicted as being squared off and attached at the side seams as a continuation of the body of the back of the garment.

Figure 16B:
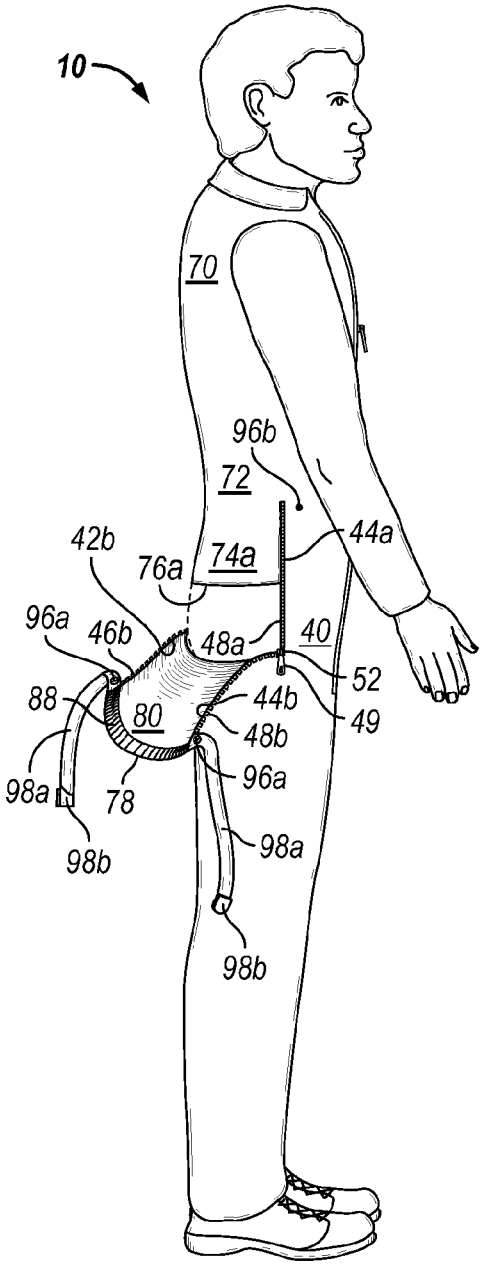

FIG. 16B illustrates a right side view of a person wearing a one piece garment (e.g., coveralls, etc.) showing a drop seat panel configured according to one aspect of the present disclosure (similar to FIGS. 5B and 16A) where the drop seat panel is shown in the opened position.

Figure 16C:
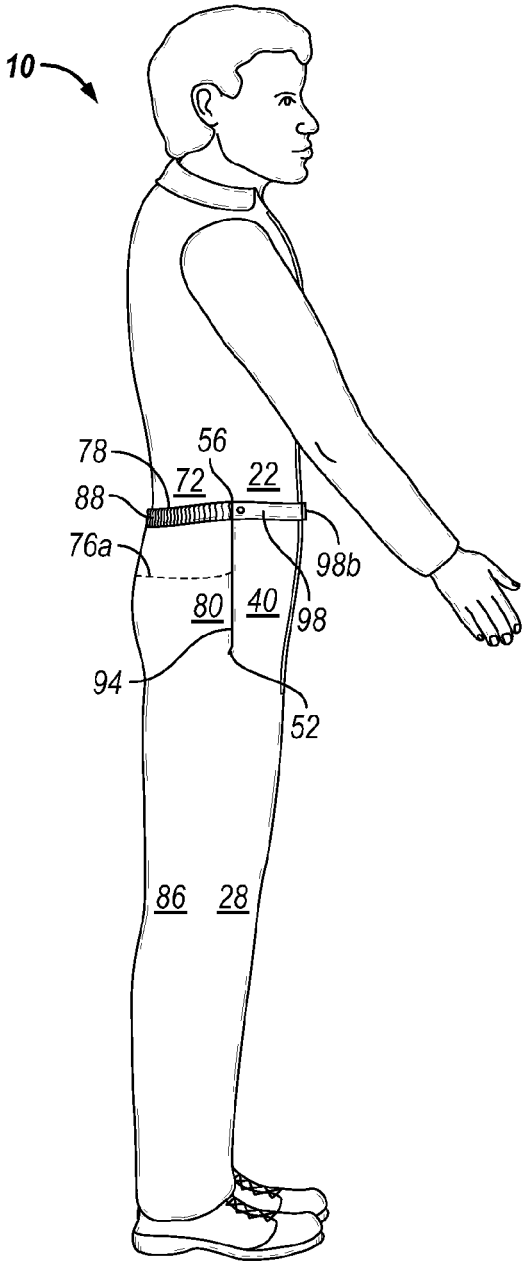

FIG. 16C illustrates a right side view of a person wearing a one piece garment (e.g., coveralls, etc.) showing a drop seat panel configured according to another aspect of the present disclosure (similar to FIGS. 5C and 16A) where the drop seat panel is shown in the closed position.

Figure 16D:
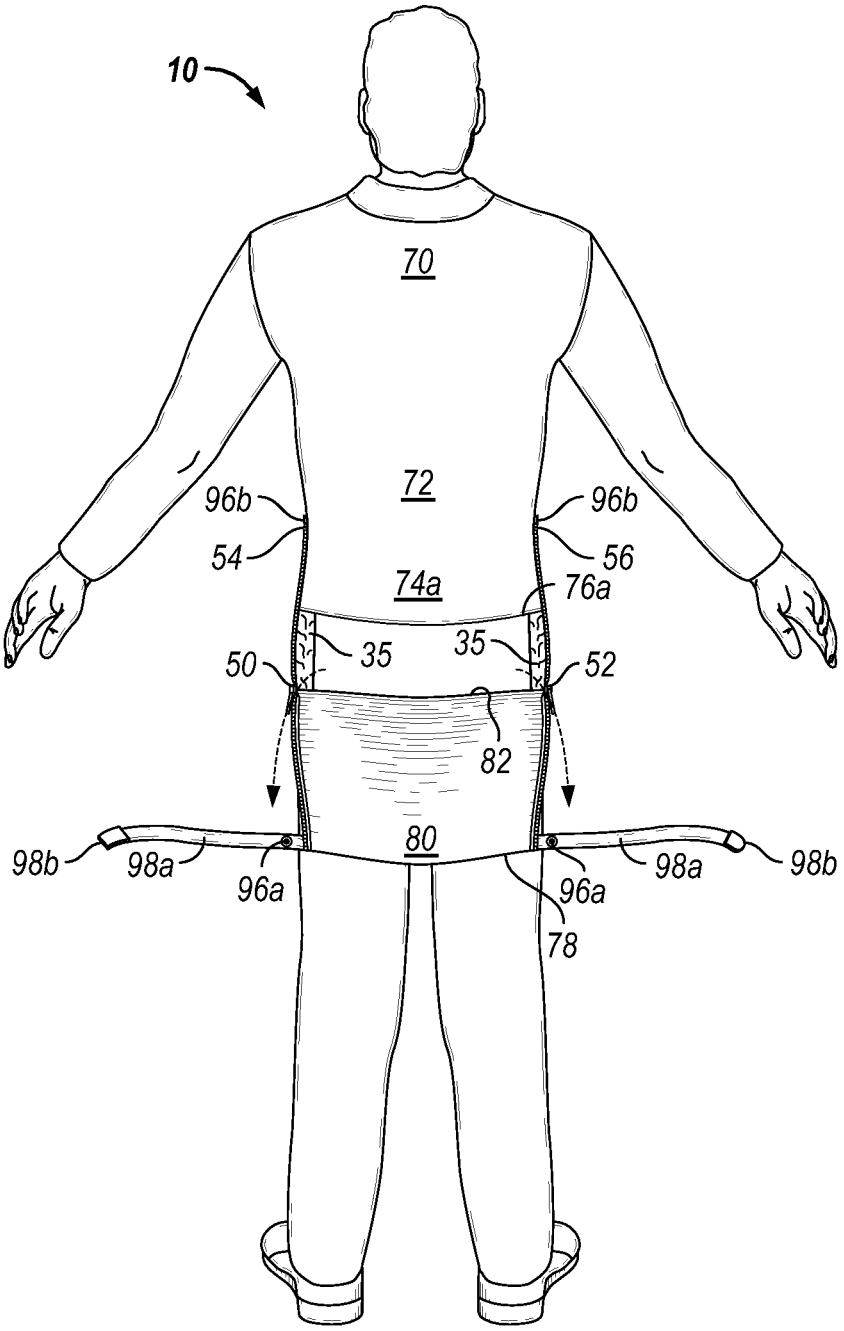

FIG. 16D illustrates a back view of a person wearing a one piece garment (e.g., coveralls, etc.) showing a drop seat panel according to another aspect of the present disclosure (similar to FIGS. 5A, 12B, 13B and 16A) where the drop seat panel is shown in the opened position with the shirttail portion depicted as being squared off and attached at the side seams as a continuation of the body of the back of the garment, and where zipper guards are illustrated.

Figure 16E:
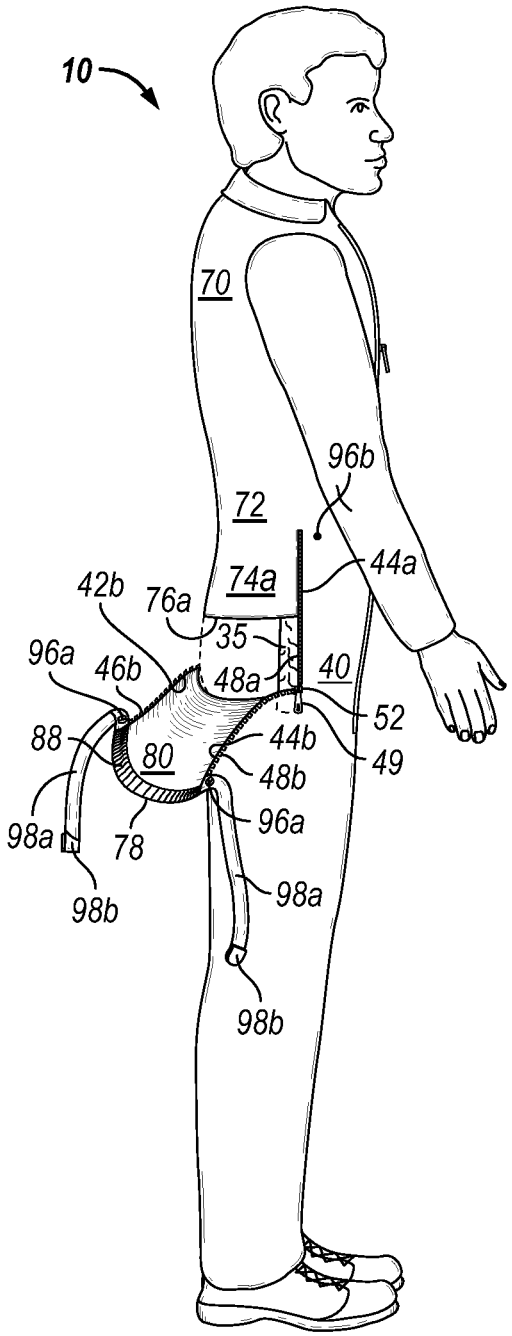

FIG. 16E illustrates a right side view of a person wearing a one piece garment (e.g., coveralls, etc.) showing a drop seat panel configured according to one aspect of the present disclosure (similar to FIGS. 16B and 16D) where the drop seat panel is shown in the opened position.

Figure 16F:
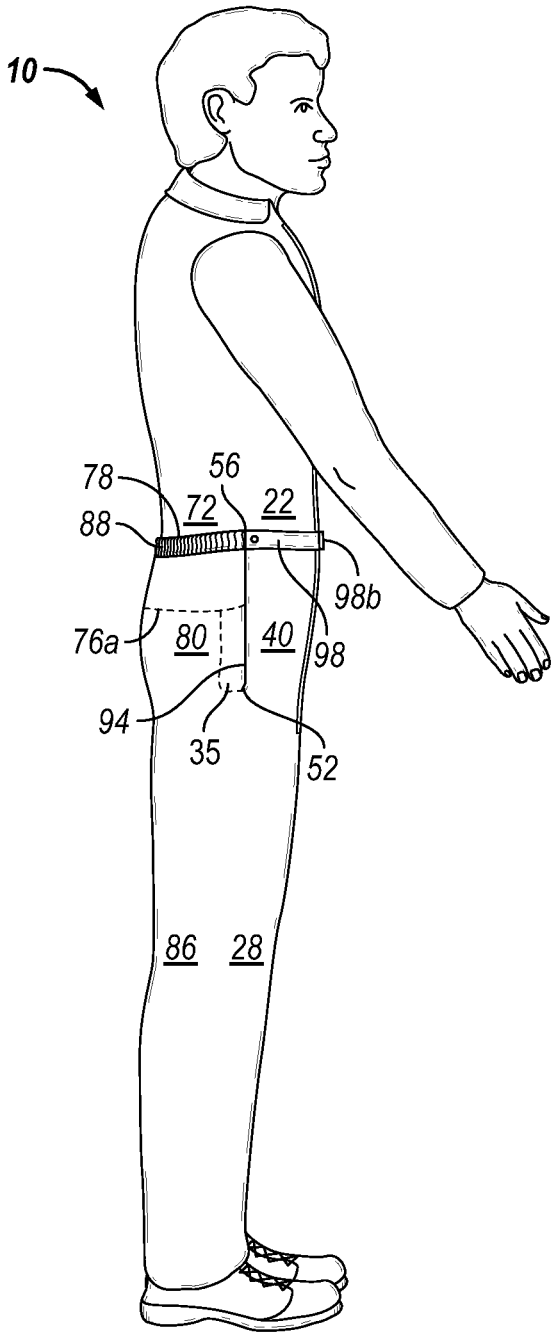

FIG. 16F illustrates a right side view of a person wearing a one piece garment (e.g., coveralls, etc.) showing a drop seat panel configured according to another aspect of the present disclosure (similar to FIGS. 16C and 16D) where the drop seat panel is shown in the closed position.

Figure 17A:
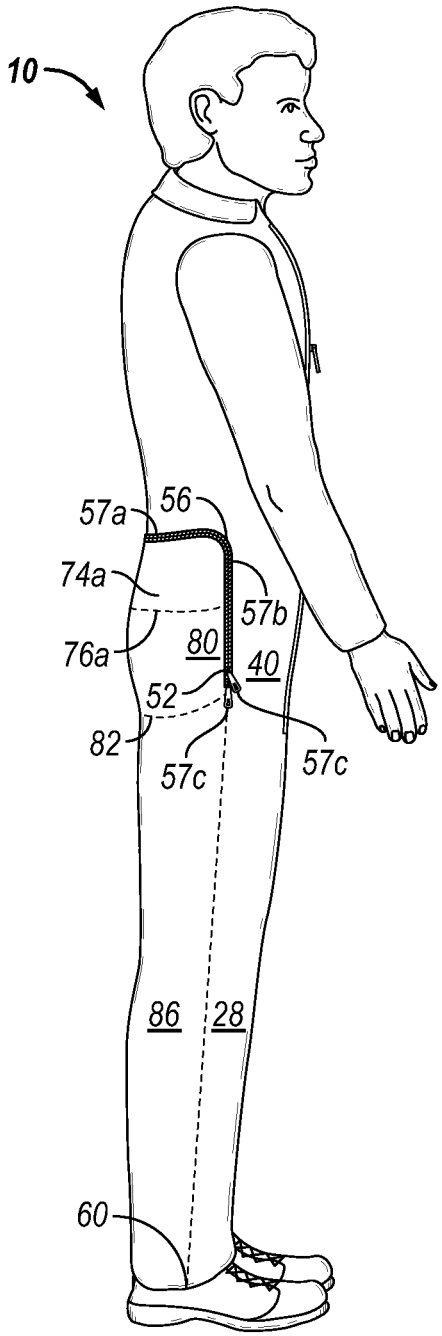

FIG. 17A illustrates a right side view of a person wearing a one piece garment (e.g., coveralls, etc.) showing a drop seat panel configured according to one aspect of the present disclosure (similar to that shown in FIGS. 6A and 14) where the drop seat panel is shown in the closed position.

Figure 17B:
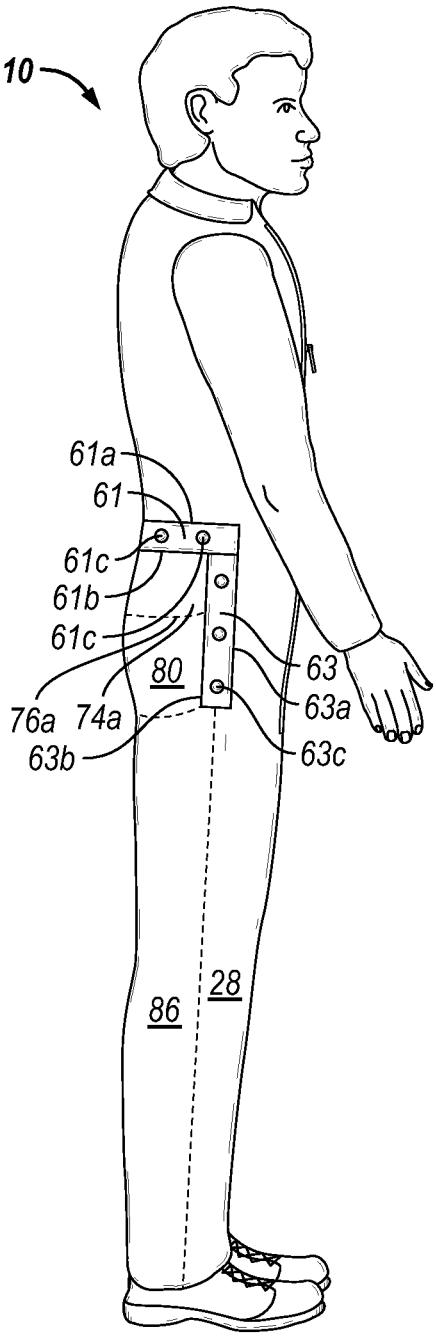

FIG. 17B illustrates a right side view of a person wearing a one piece garment (e.g., coveralls, etc.) showing a drop seat panel configured according to one aspect of the present disclosure (similar to that shown in FIGS. 6B and 14) where the drop seat panel is shown in the closed position.

Figure 17C:
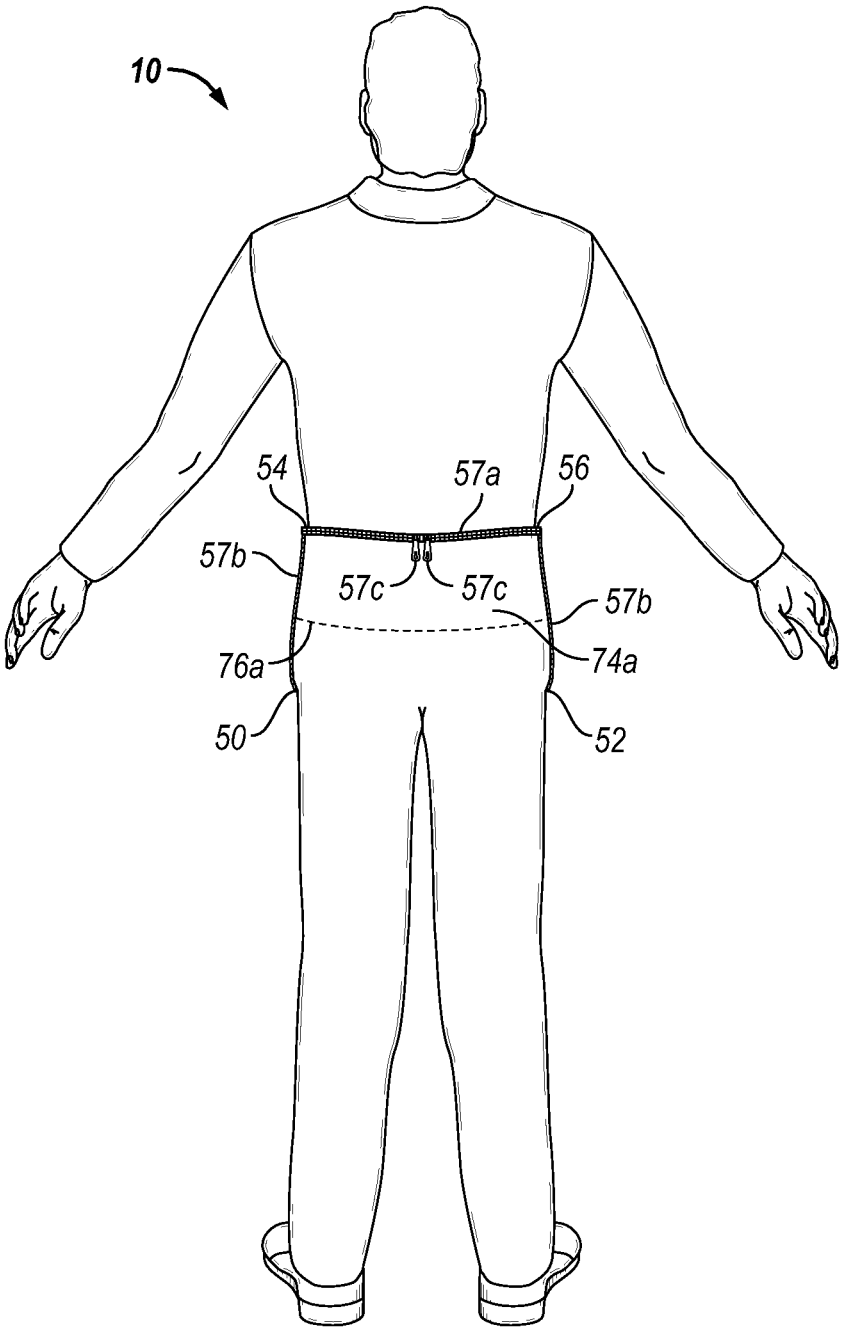

FIG. 17C illustrates a back side view of a person wearing a one piece garment (e.g., coveralls, etc.) showing a drop seat panel configured according to another aspect of the present disclosure (similar to that shown in FIGS. 6C, 14 and 17A) where the drop seat panel is shown in the closed position.

Figure 17D:
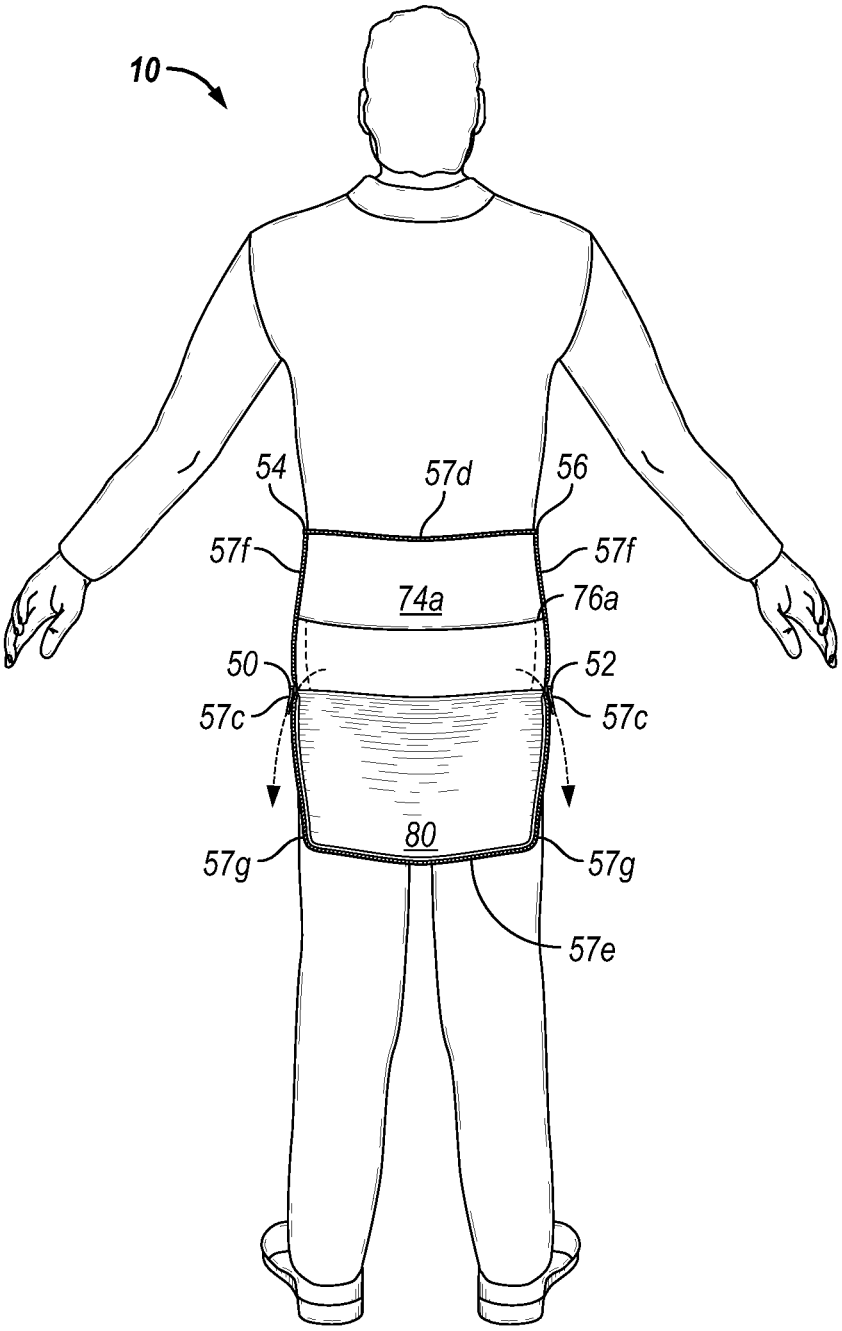

FIG. 17D illustrates a back side view of a person wearing a one piece garment (e.g., coveralls, etc.) showing a drop seat panel configured according to another aspect of the present disclosure (similar to that shown in FIGS. 6D, 14, 17A and 17C) where the drop seat panel is shown in the opened position.

Figure 17E:
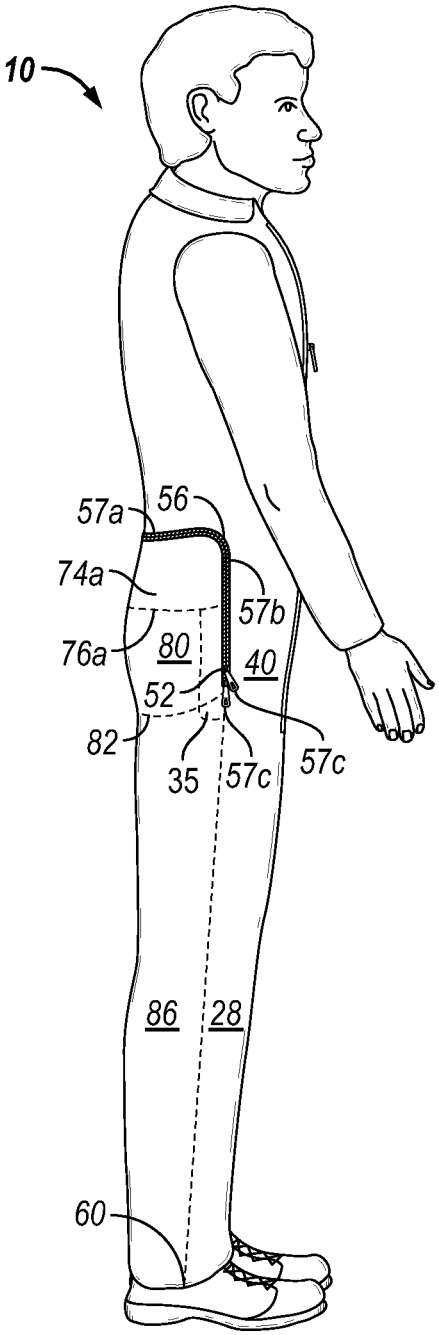

FIG. 17E illustrates a right side view of a person wearing a one piece garment (e.g., coveralls, etc.) showing a drop seat panel configured according to one aspect of the present disclosure (similar to that shown in FIGS. 6A, 12B and 17B) where the drop seat panel is shown in the closed position, and where zipper guards are illustrated.

Figure 17F:
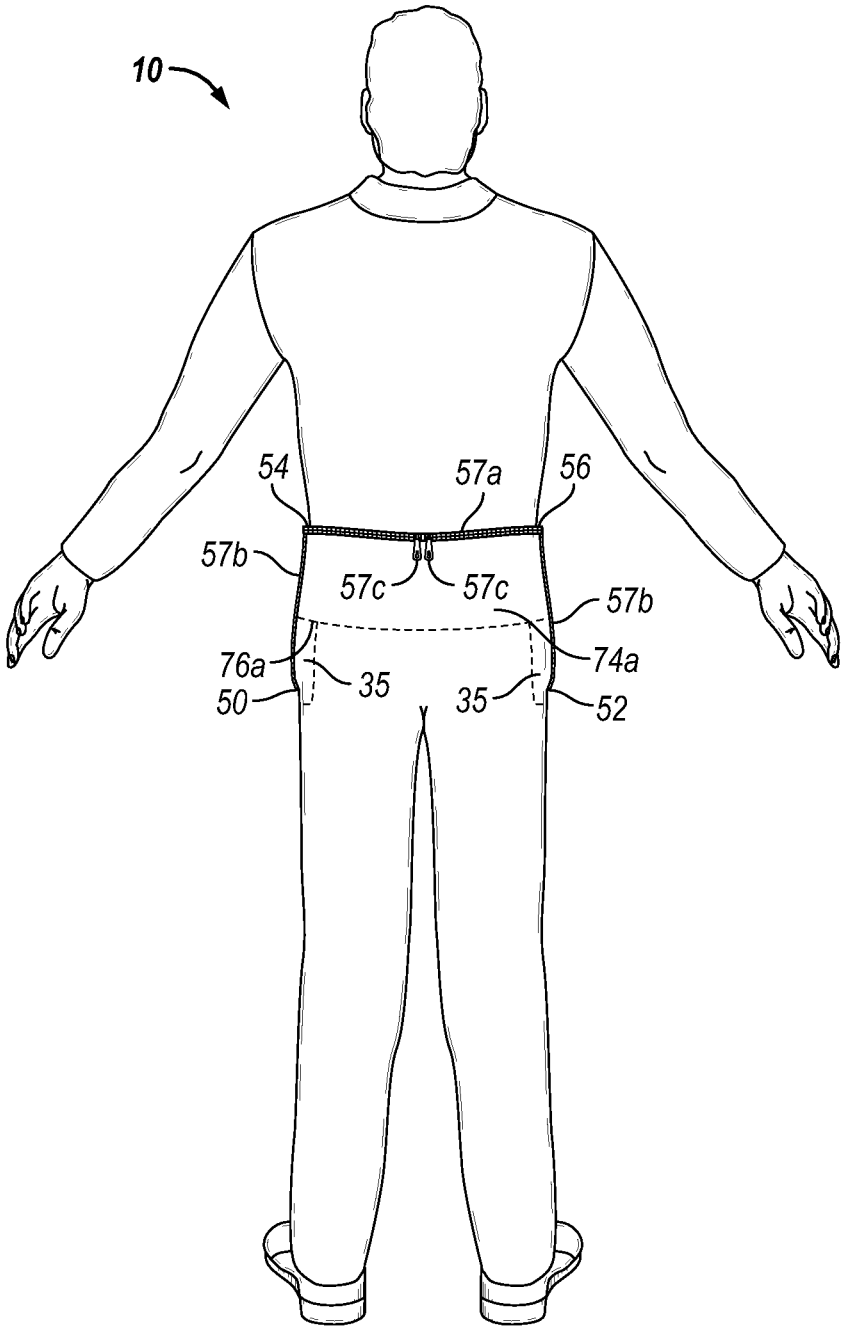

FIG. 17F illustrates a back side view of a person wearing a one piece garment (e.g., coveralls, etc.) showing a drop seat panel configured according to another aspect of the present disclosure (similar to that shown in FIGS. 6C, 14, 17A and 17C) where the drop seat panel is shown in the closed position, and where zipper guards are illustrated.

Figure 17G:
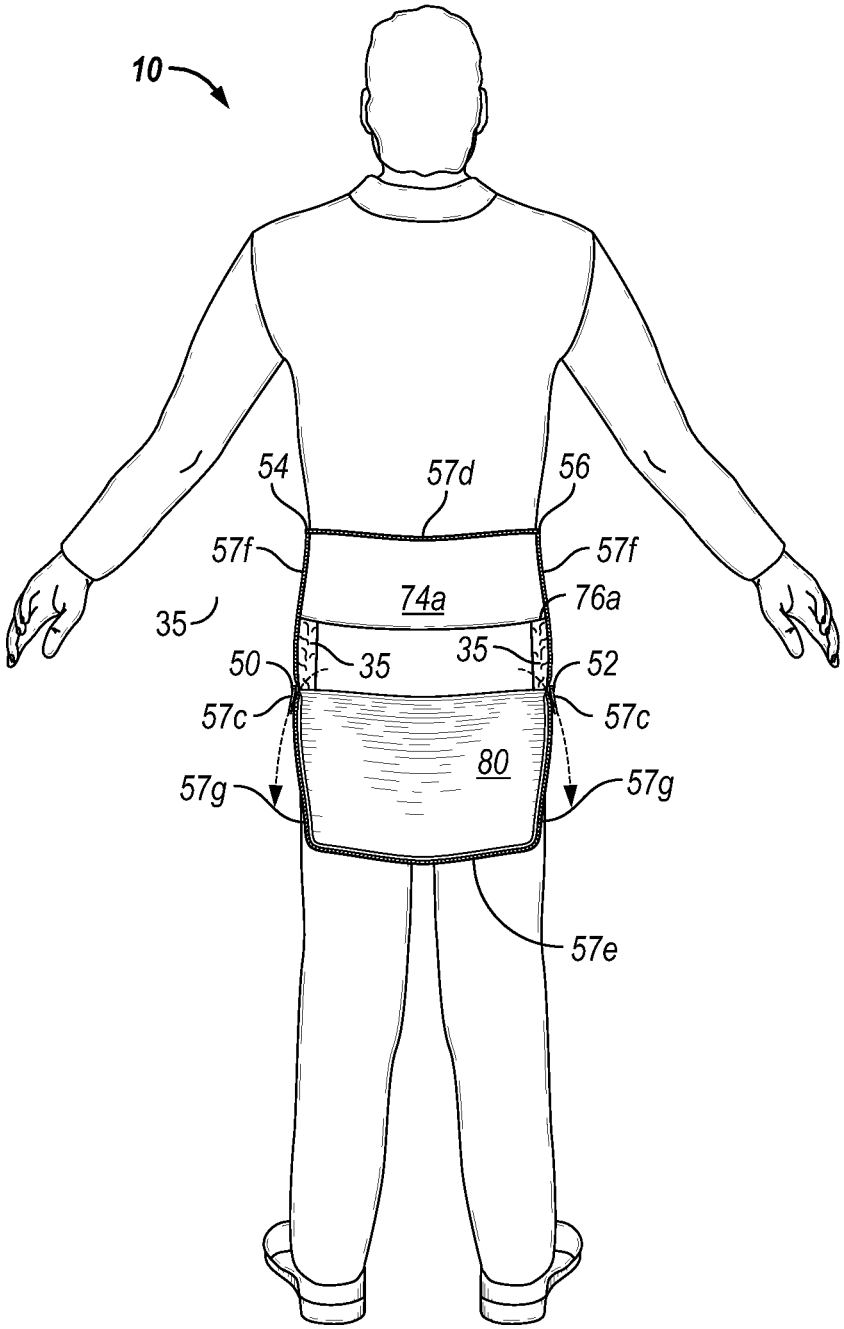

FIG. 17G illustrates a back side view of a person wearing a one piece garment (e.g., coveralls, etc.) showing a drop seat panel configured according to another aspect of the present disclosure (similar to that shown in FIGS. 6D, 14, 17E and 17F) where the drop seat panel is shown in the opened position, and where zipper guards are illustrated.

Figure 8A:
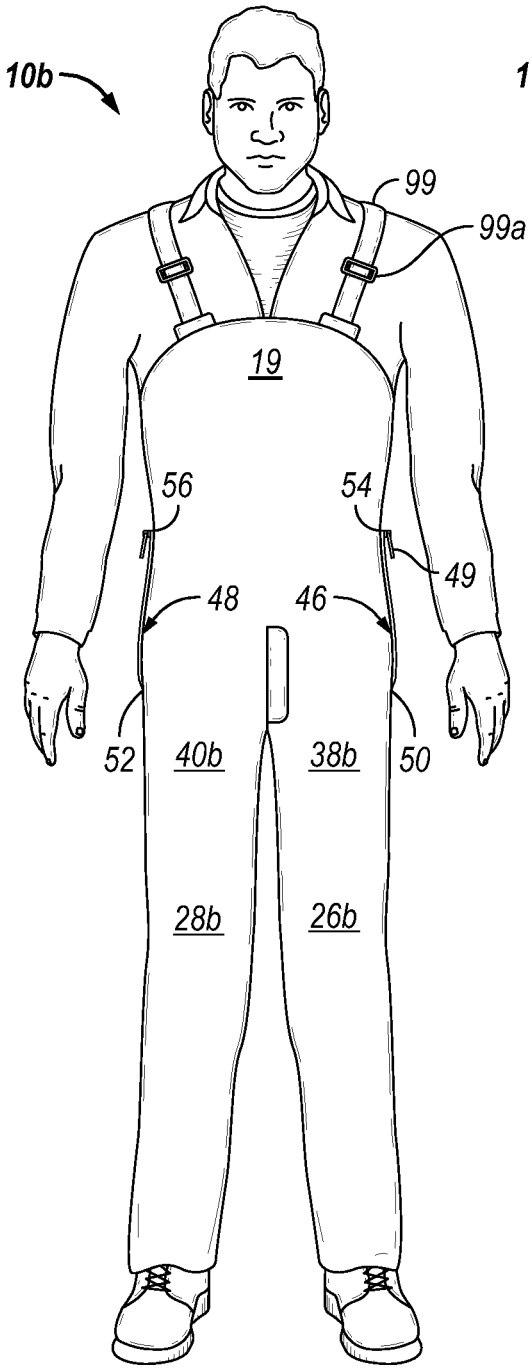
FIG. 8A illustrates a front view of a person wearing a one piece garment (e.g., bib coveralls, ski bib, overalls, etc.) according to one aspect of the present disclosure.
Figure 8B:
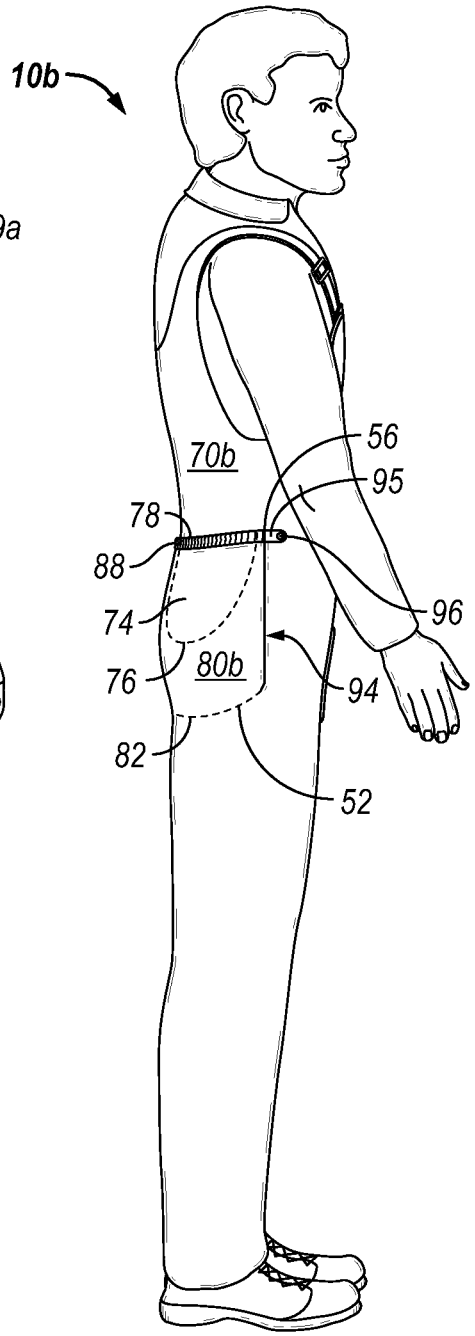
FIG. 8B illustrates a right side view of a person wearing a one piece garment (e.g., bib, etc.) showing a drop seat panel according to one aspect of the present disclosure where the drop seat panel is shown in the closed position.
Figure 18A:
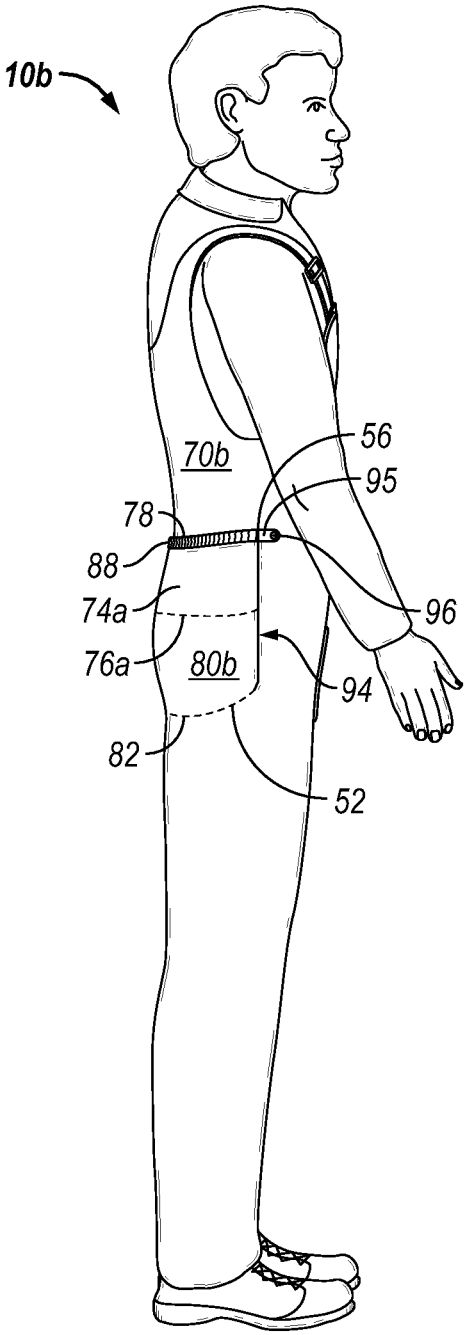

FIG. 18A illustrates a right side view of a person wearing a one piece garment (e.g., bib, etc.) showing a drop seat panel according to one aspect of the present disclosure (similar to FIGS. 8B and 15A) where the drop seat panel is shown in the closed position.

Figure 8C:
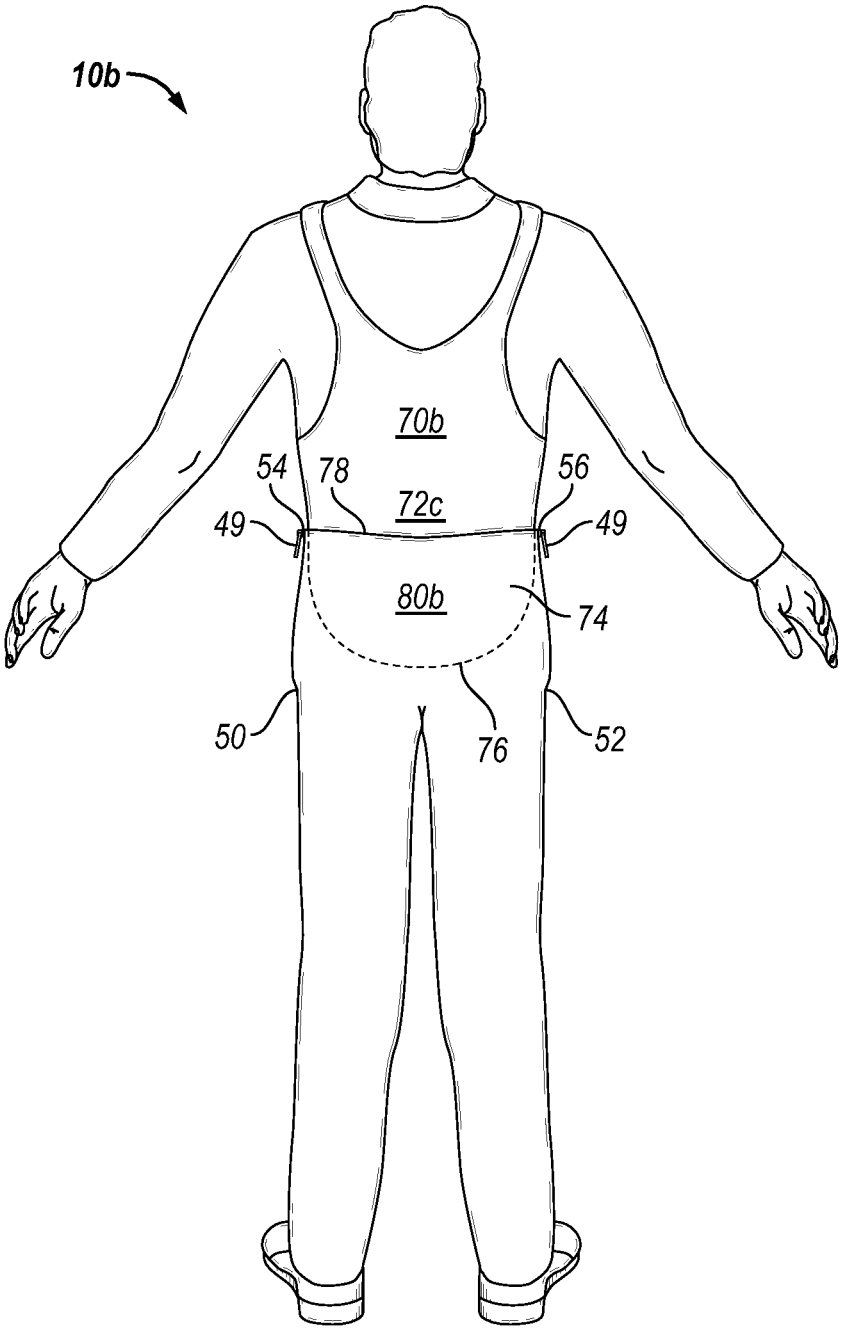
FIG. 8C illustrates a back view of a person wearing a one piece garment (e.g., bib, etc.) showing a drop seat panel according to one aspect of the present disclosure where the drop seat panel is shown in the closed position.
Figure 18B:
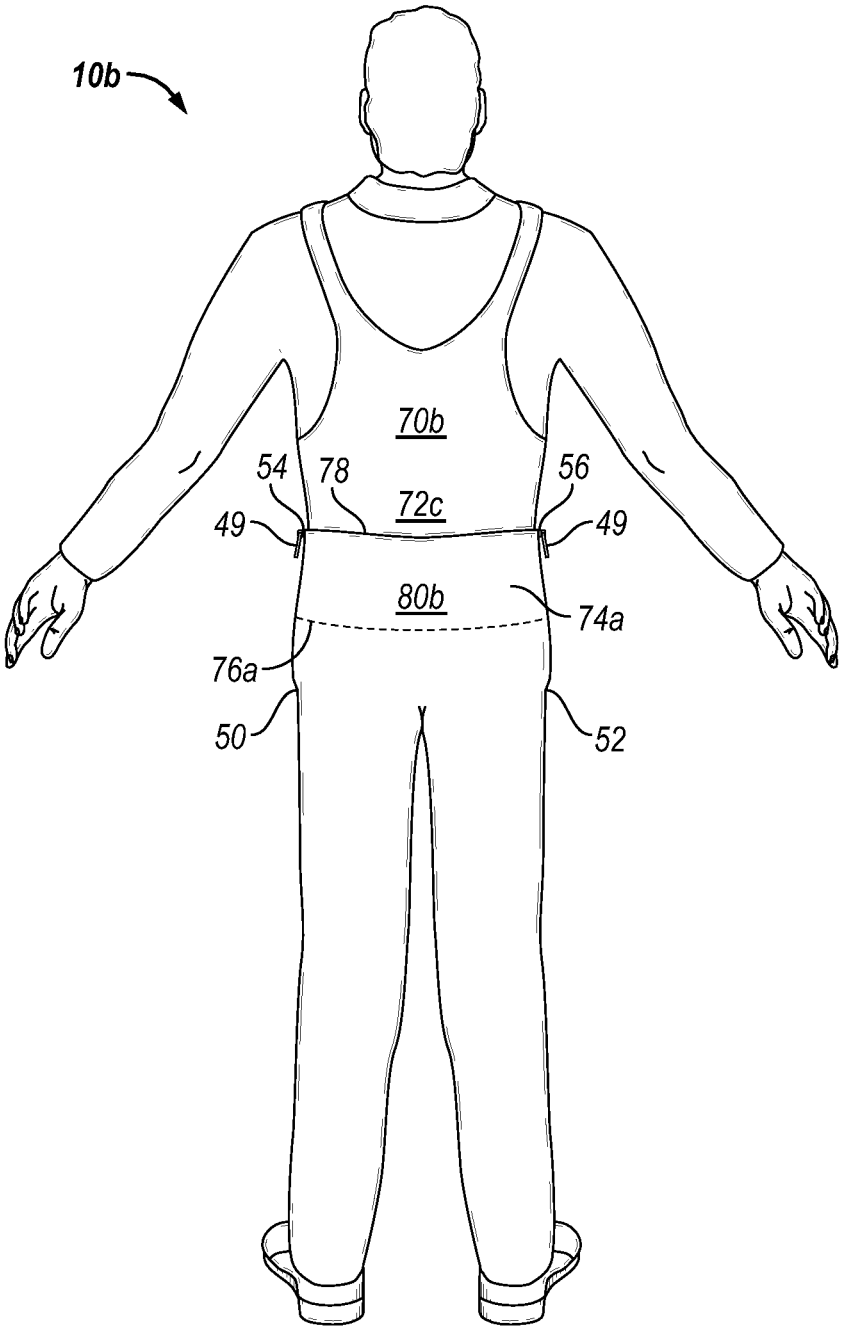

FIG. 18B illustrates a back view of a person wearing a one piece garment (e.g., bib, etc.) showing a drop seat panel according to one aspect of the present disclosure (similar to FIGS. 8C, 12C and 15A) where the drop seat panel is shown in the closed position.

Figure 19A:
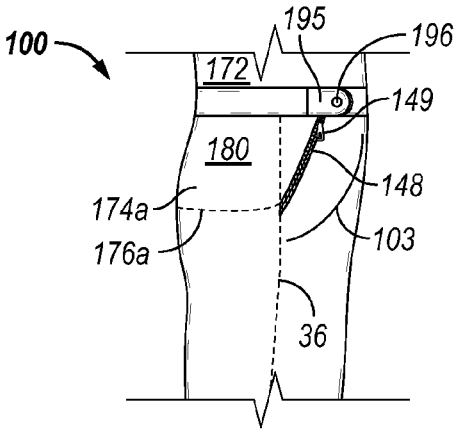

FIG. 19A illustrates a right side view of the waist section of an embodiment of the present disclosure (similar to that in FIG. 10A) that modifies an existing set of prior art coveralls (bibs, etc.) to outfit the coveralls with a drop seat panel according to one aspect of the present disclosure where the drop seat panel is shown in the closed position with the shirttail portion depicted as being squared off and attached at the side seams as a continuation of the body of the back of the garment.

Figure 19B:
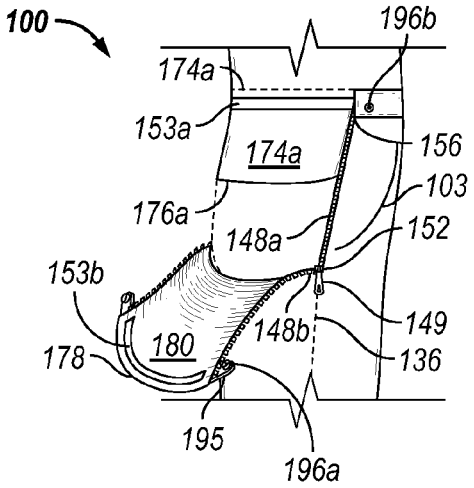

FIG. 19B illustrates a right side view of the waist section of an embodiment of the present disclosure (similar to that in FIG. 10B) that modifies an existing set of prior art coveralls (bibs, etc.) to outfit the coveralls with a drop seat panel according to one aspect of the present disclosure where the drop seat panel is shown in the opened position with the shirttail portion depicted as being squared off and attached at the side seams as a continuation of the body of the back of the garment.

Figure 19C:
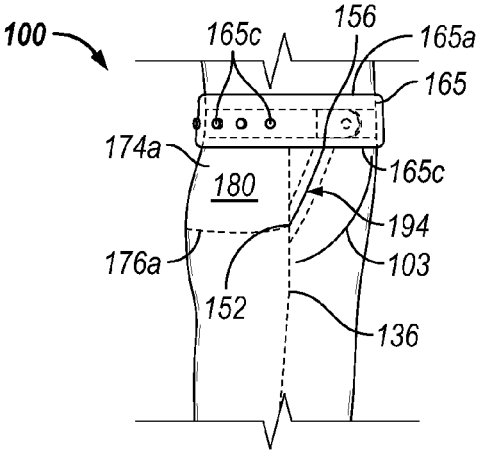

FIG. 19C illustrates a right side view of the waist section of an embodiment of the present disclosure (similar to that in FIG. 10C) that modifies an existing set of prior art coveralls (bibs, etc.) to outfit the coveralls with a drop seat panel according to one aspect of the present disclosure where the drop seat panel is shown in the closed position with a storm/wind flap covering the drop seat seams and with the shirttail portion depicted as being squared off and attached at the side seams as a continuation of the body of the back of the garment.

Figure 19D:
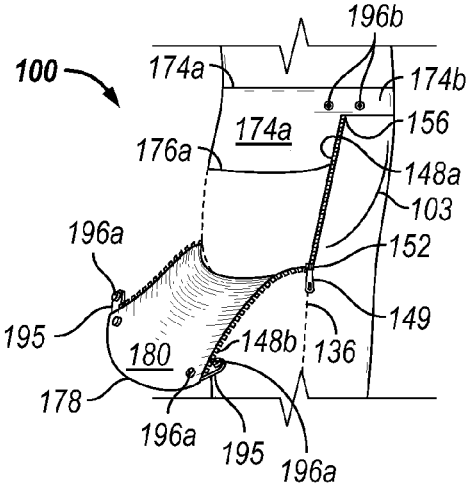

FIG. 19D illustrates a right side view of the waist section of an embodiment of the present disclosure (similar to that in FIG. 19D) that modifies an existing set of prior art coveralls (bibs, etc.) to outfit the coveralls with a drop seat panel according to one aspect of the present disclosure where the drop seat panel is shown in the opened position and with the shirttail portion depicted as being squared off and attached at the side seams as a continuation of the body of the back of the garment.

Figure 19E:
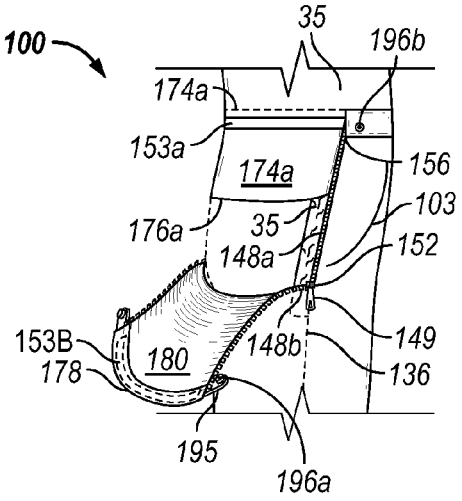

FIG. 19E illustrates a right side view of the waist section of an embodiment of the present disclosure (similar to that in FIG. 19B) that modifies an existing set of prior art coveralls (bibs, etc.) to outfit the coveralls with a drop seat panel according to one aspect of the present disclosure where the drop seat panel is shown in the opened position with the shirttail portion depicted as being squared off and attached at the side seams as a continuation of the body of the back of the garment, and where zipper guards are illustrated.

Figure 19F:
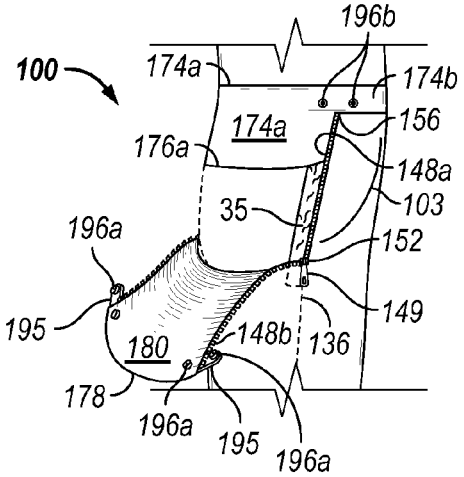

FIG. 19F illustrates a right side view of the waist section of an embodiment of the present disclosure (similar to that in FIG. 19D) that modifies an existing set of prior art coveralls (bibs, etc.) to outfit the coveralls with a drop seat panel according to one aspect of the present disclosure where the drop seat panel is shown in the opened position and with the shirttail portion depicted as being squared off and attached at the side seams as a continuation of the body of the back of the garment, and where zipper guards are illustrated.

Figure 11A:
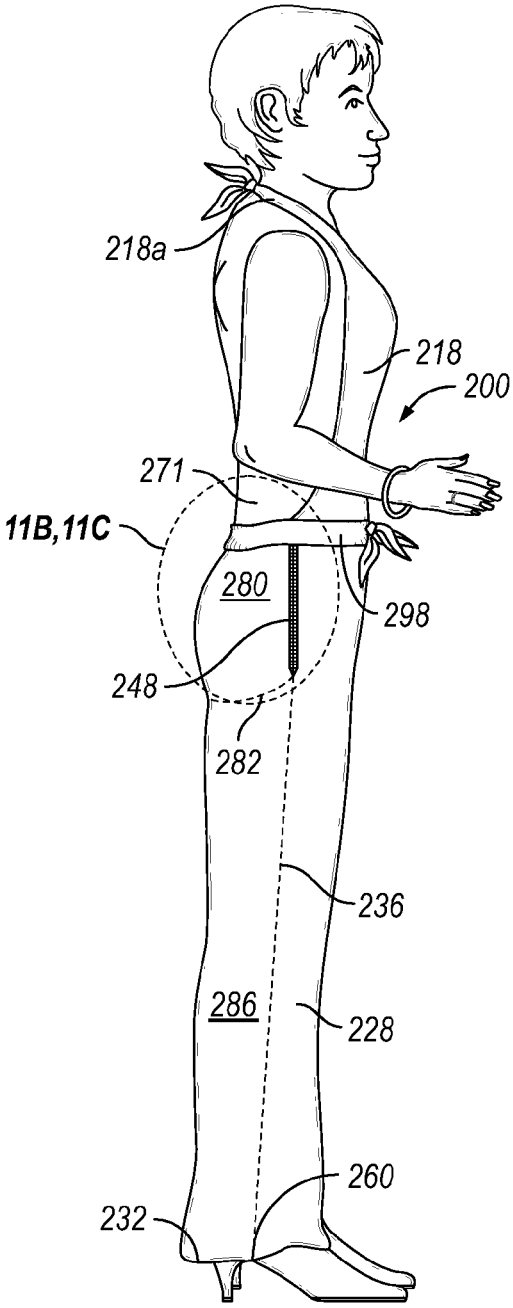
FIG. 11A illustrates a right side view of a person wearing a one piece garment (e.g., jumpsuit, halter jumpsuit, etc.) showing a drop seat panel configured according to another aspect of the present disclosure where the drop seat panel is shown in the closed position.
Figure 20A:
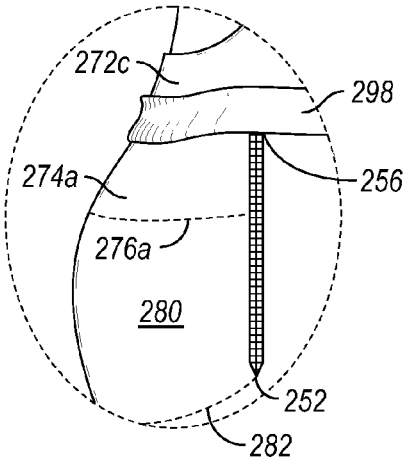

FIG. 20A illustrates another embodiment of the section labeled 11C in FIG. 11A showing an embodiment (similar to that in FIG. 11C) where a shirttails section is used with the shirttail portion depicted as being squared off and attached at the side seams as a continuation of the body of the back of the garment.

Figure 20B:
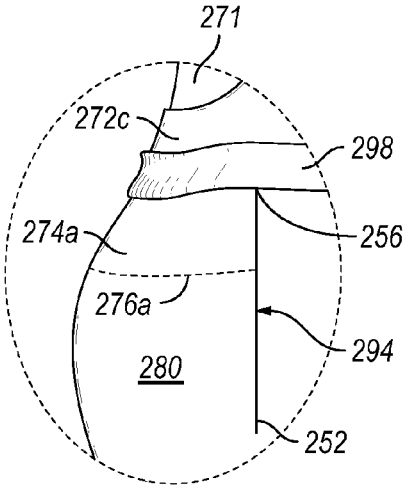

FIG. 20B illustrates another embodiment of the section labeled 11C in FIG. 11A showing an embodiment (similar to that in FIG. 11F) where a shirttails section is used with the shirttail portion depicted as being squared off and attached at the side seams as a continuation of the body of the back of the garment.

Figure 21A:
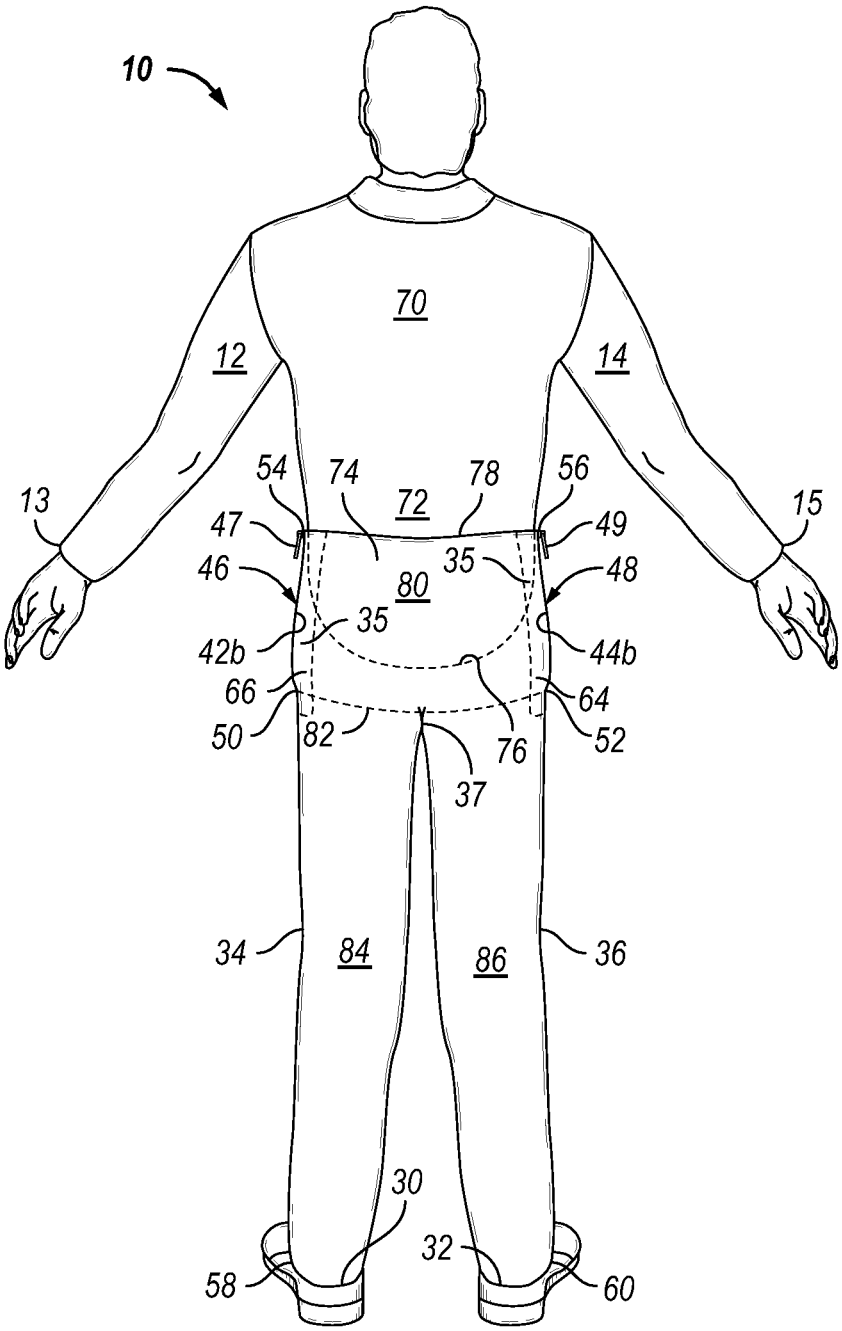

FIG. 21A illustrates a back view of a person wearing a one piece garment (e.g., coveralls, etc.) showing a drop seat panel according to one aspect of the present disclosure (similar to FIG. 1B) where the drop seat panel is shown in the closed position, and where zipper guards are illustrated.

Figure 21B:
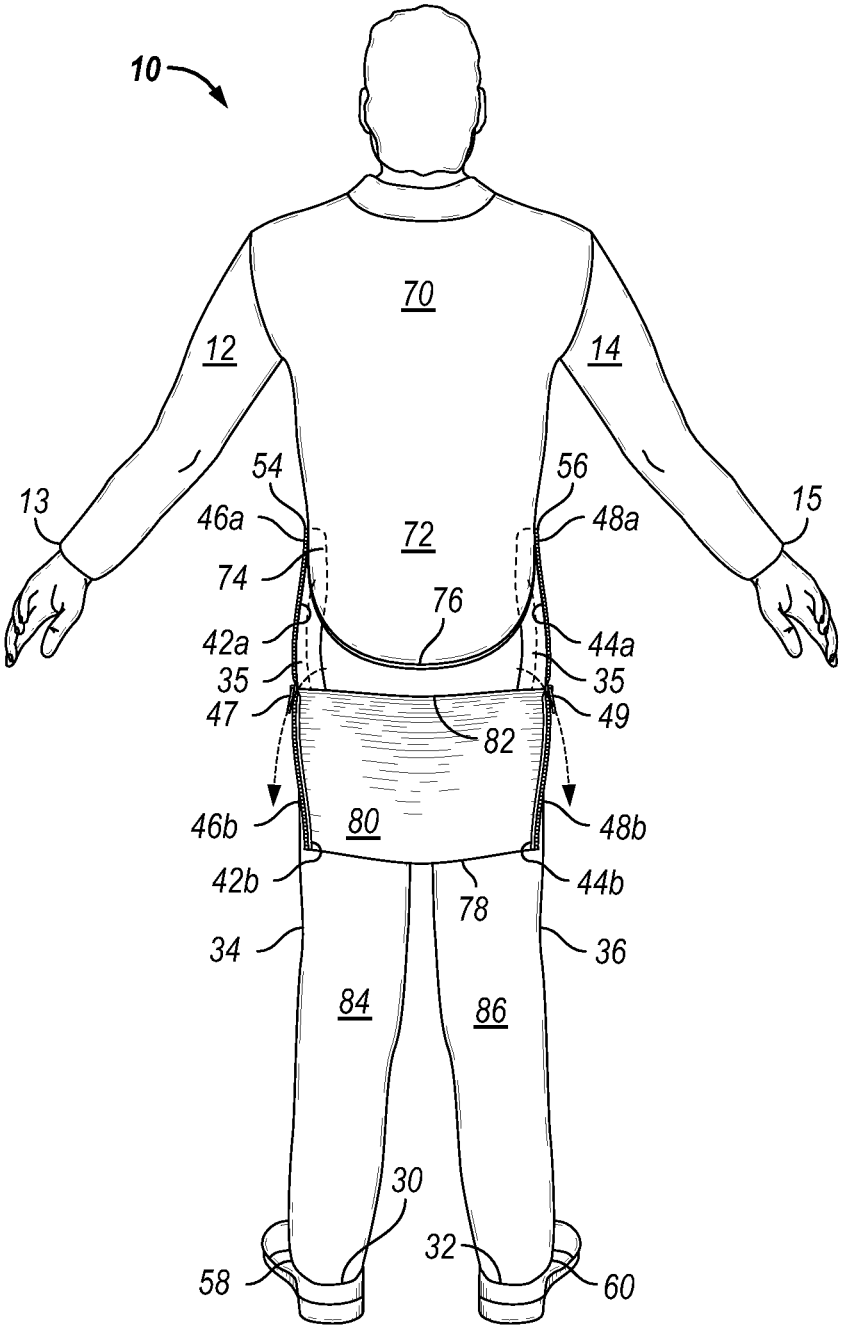

FIG. 21B illustrates a back view of a person wearing a one piece garment (e.g., coveralls, etc.) showing a drop seat panel according to one aspect of the present disclosure (similar to FIG. 2) where the drop seat panel is shown in the opened position, and where zipper guards are illustrated.

Figure 22:
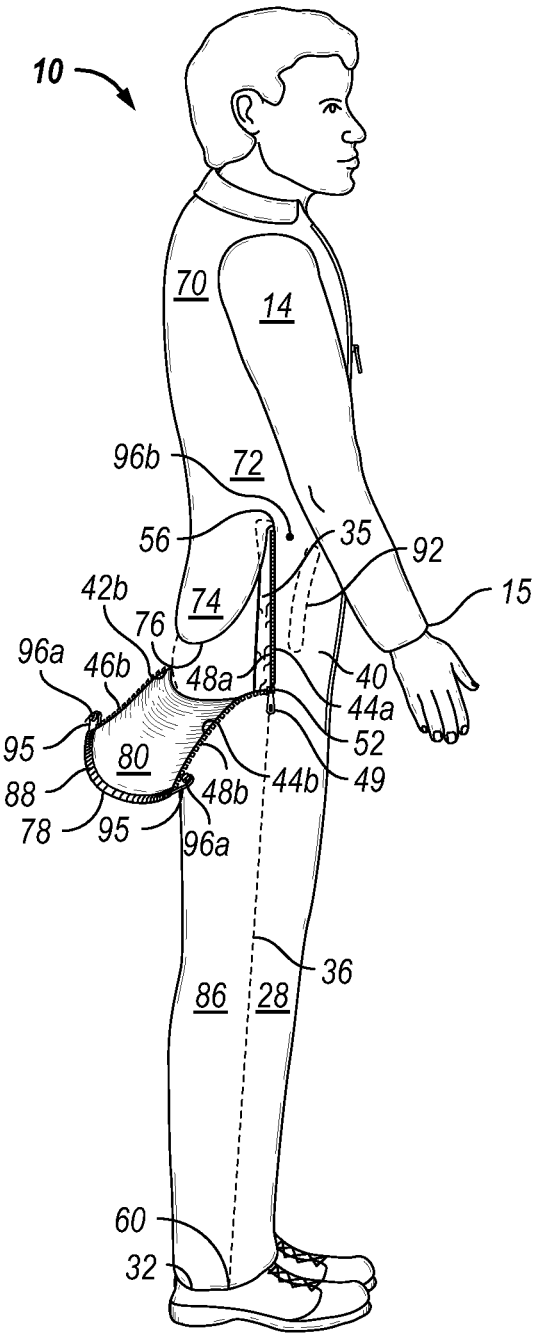

FIG. 22 illustrates a right side view of a person wearing a one piece garment (e.g., coveralls, etc.) showing a drop seat panel according to one aspect of the present disclosure (similar to FIG. 4B) where the drop seat panel is shown in the opened position, and where zipper guards are illustrated.

Figure 23A:
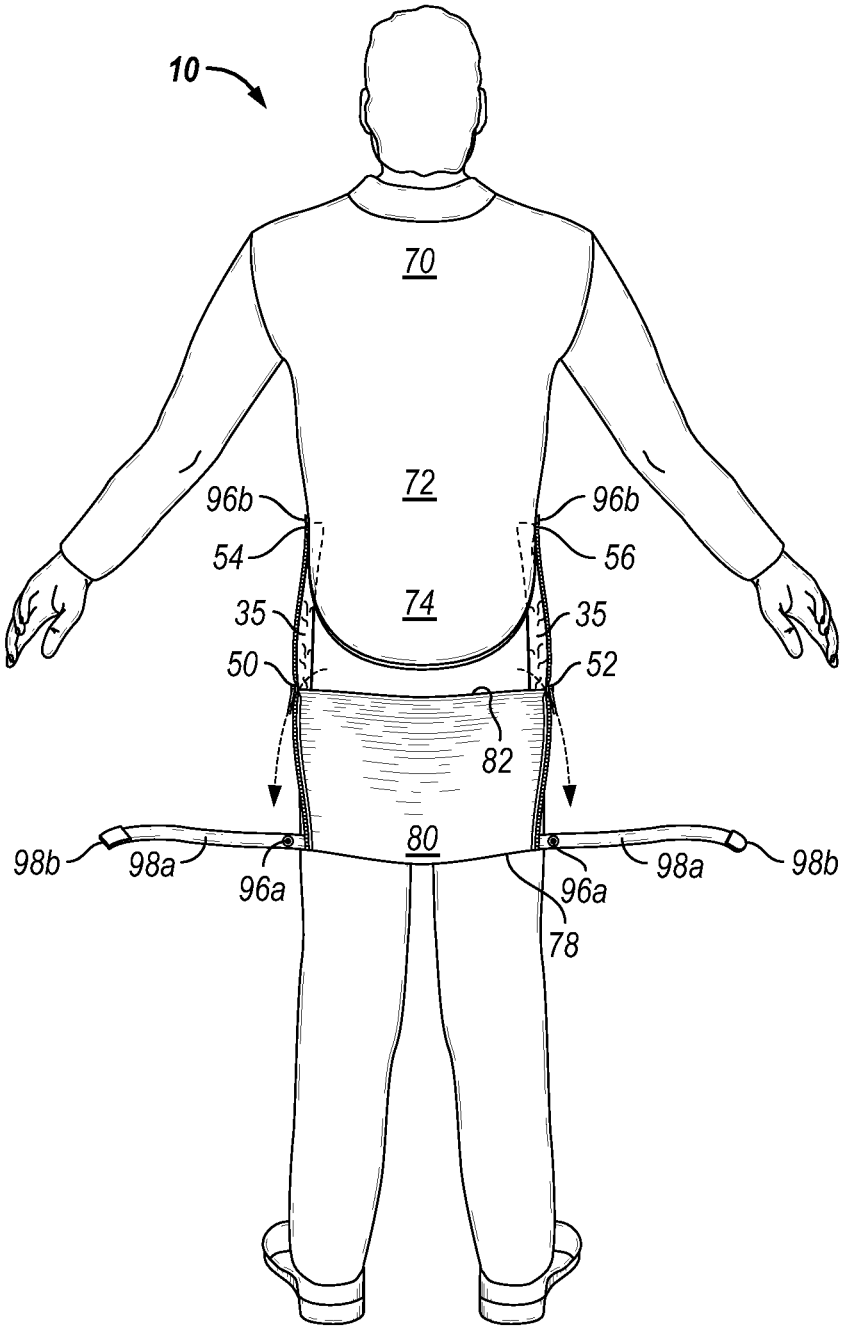

FIG. 23A illustrates a back view of a person wearing a one piece garment (e.g., coveralls, etc.) showing a drop seat panel according to one aspect of the present disclosure (similar to FIG. 5A) where the drop seat panel is shown in the opened position, and where zipper guards are illustrated.

Figure 23B:
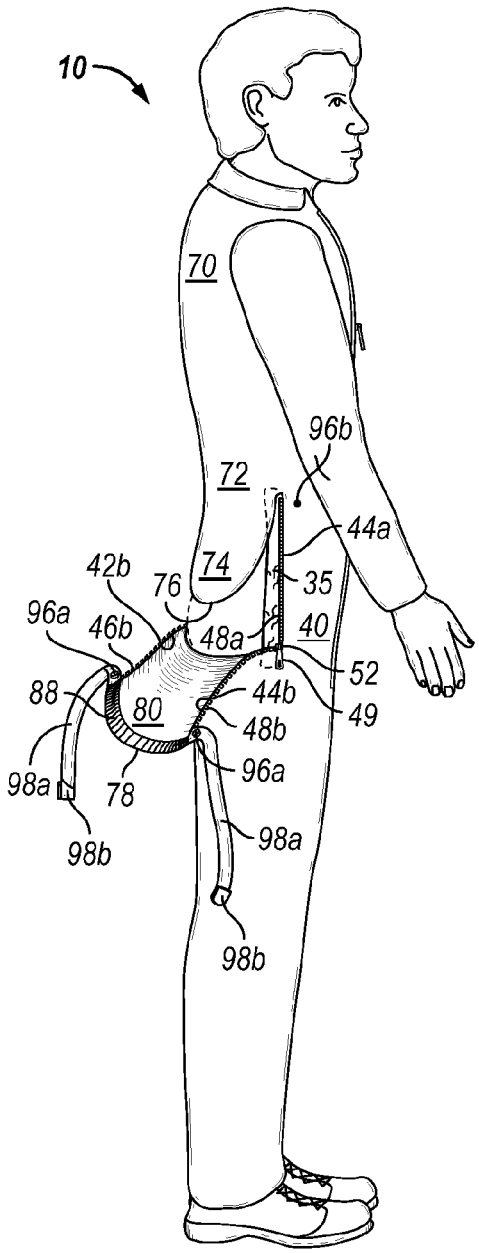

FIG. 23B illustrates a right side view of a person wearing a one piece garment (e.g., coveralls, etc.) showing a drop seat panel according to one aspect of the present disclosure (similar to FIG. 5B) where the drop seat panel is shown in the opened position, and where zipper guards are illustrated.

Figure 23C:
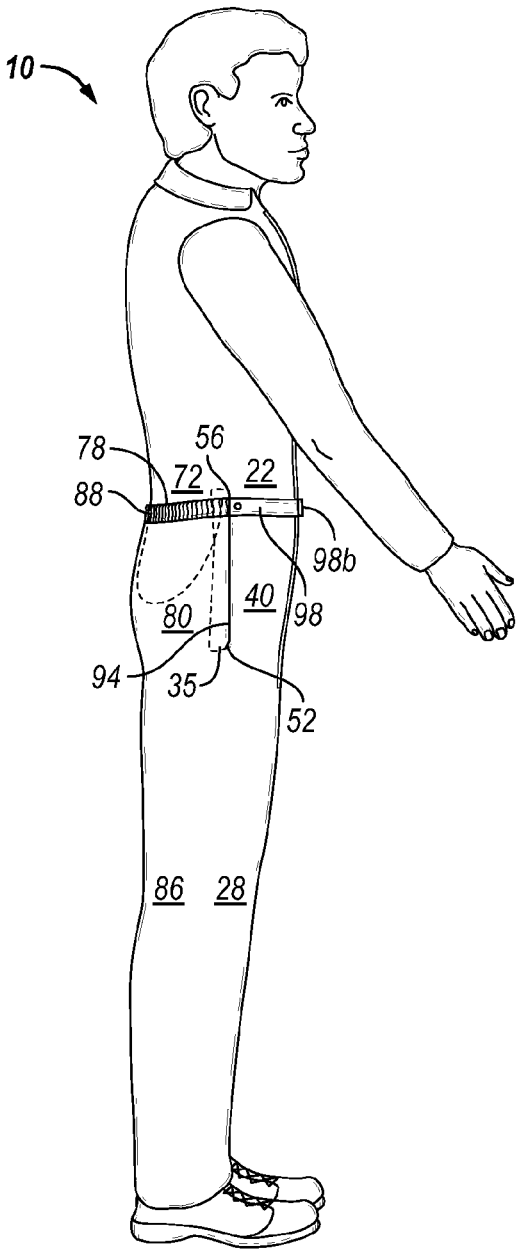

FIG. 23C illustrates a right side view of a person wearing a one piece garment (e.g., coveralls, etc.) showing a drop seat panel according to one aspect of the present disclosure (similar to FIG. 5C) where the drop seat panel is shown in the closed position, and where zipper guards are illustrated.

Figure 24A:
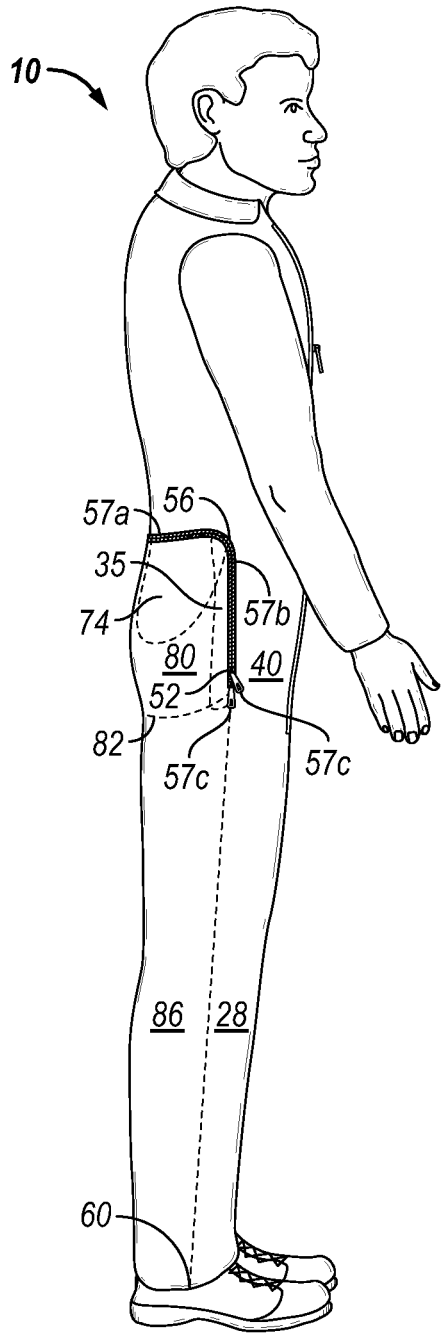

FIG. 24A illustrates a right side view of a person wearing a one piece garment (e.g., coveralls, etc.) showing a drop seat panel according to one aspect of the present disclosure (similar to FIG. 6A) where the drop seat panel is shown in the closed position, and where zipper guards are illustrated.

Figure 24B:
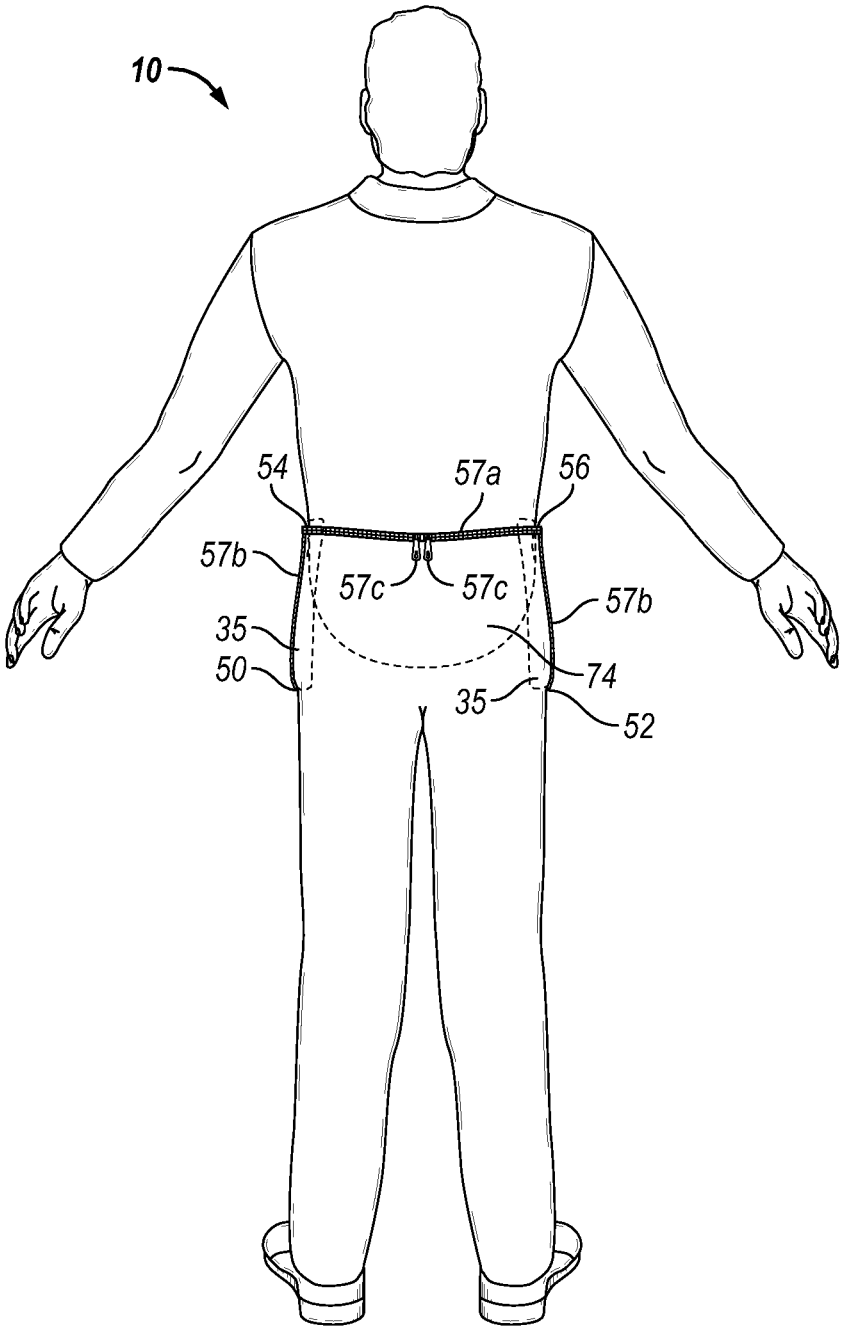

FIG. 24B illustrates a back view of a person wearing a one piece garment (e.g., coveralls, etc.) showing a drop seat panel according to one aspect of the present disclosure (similar to FIG. 6C) where the drop seat panel is shown in the closed position, and where zipper guards are illustrated.

Figure 24C:
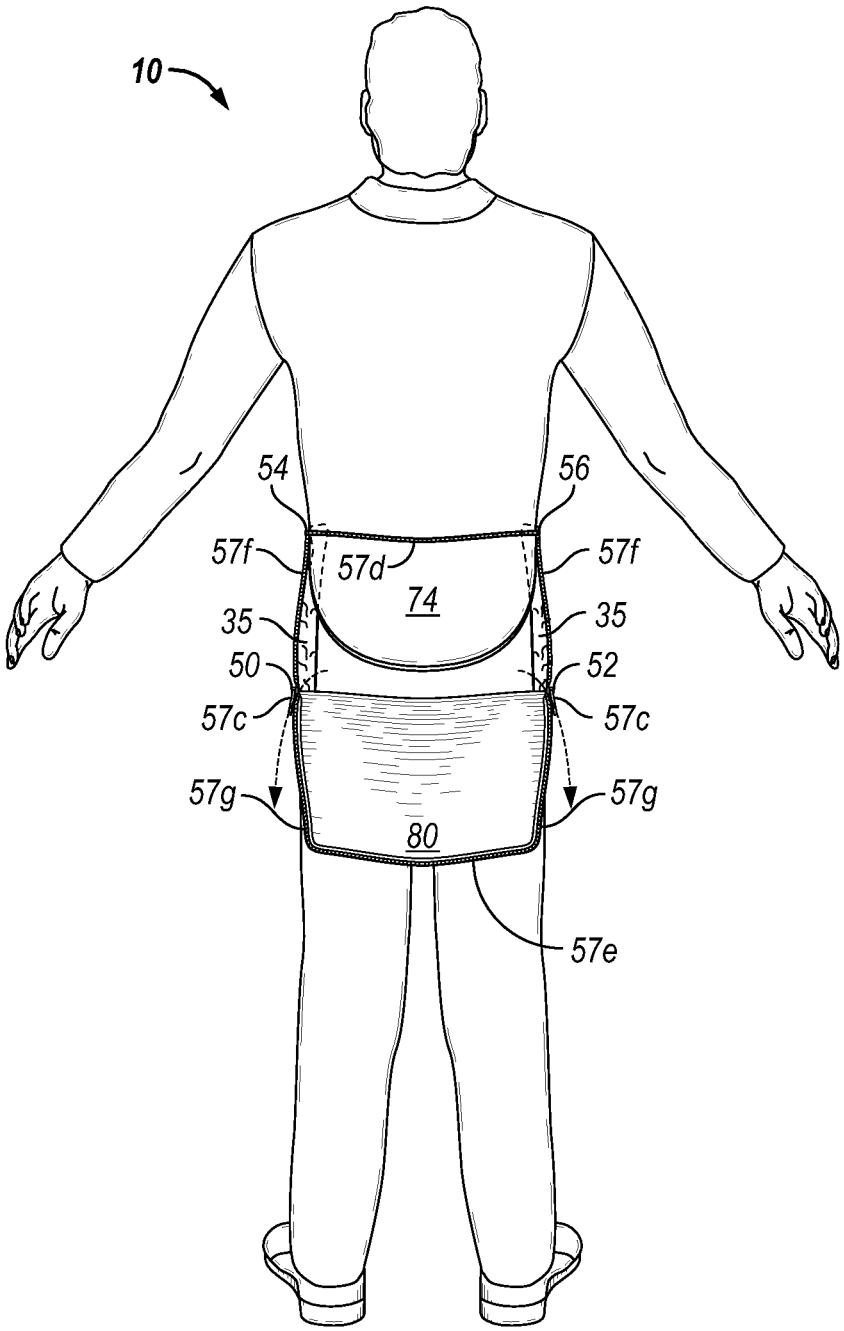

FIG. 24C illustrates a back view of a person wearing a one piece garment (e.g., coveralls, etc.) showing a drop seat panel according to one aspect of the present disclosure (similar to FIG. 6D) where the drop seat panel is shown in the opened position, and where zipper guards are illustrated.

Figure 25:
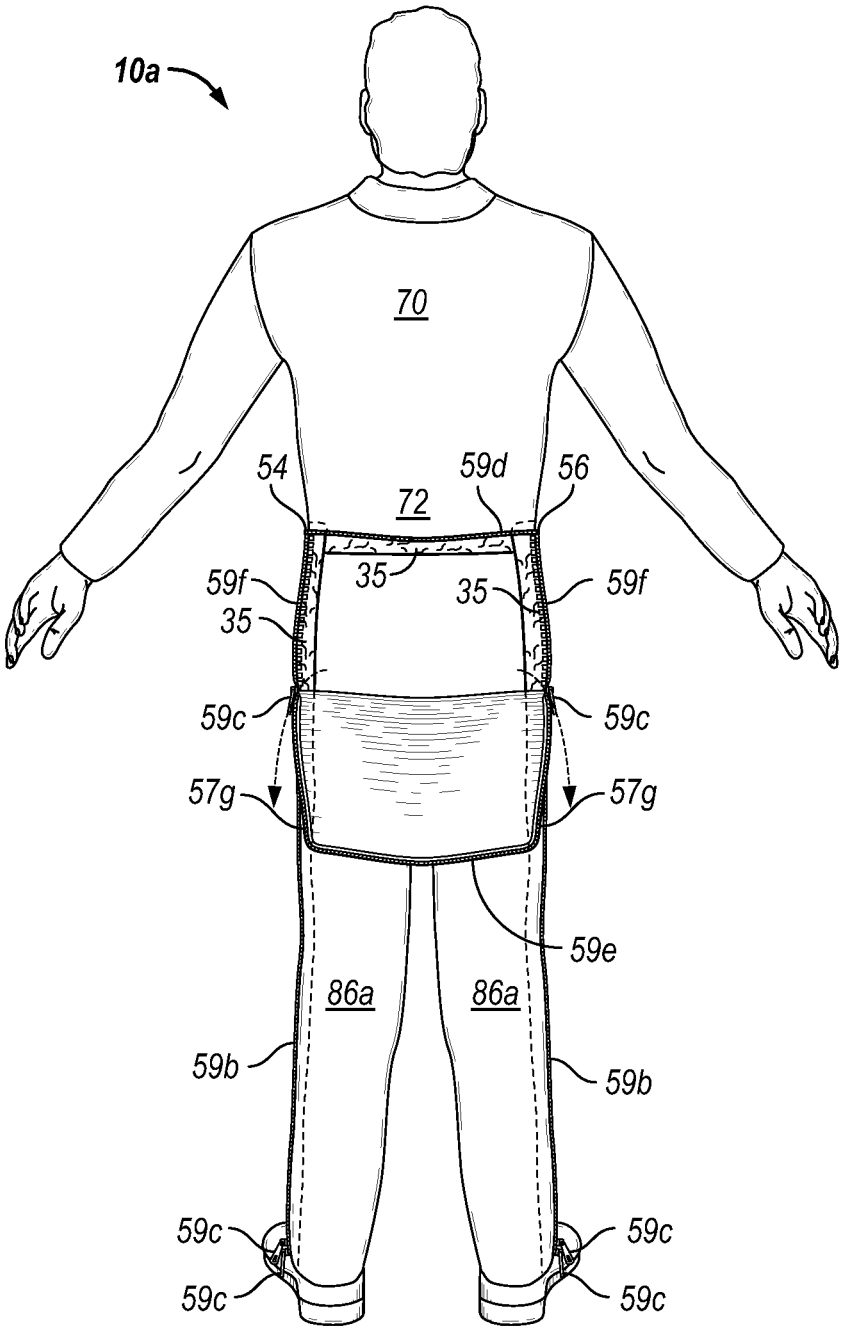

FIG. 25 illustrates a back view of a person wearing a one piece garment (e.g., coveralls, etc.) showing a drop seat panel according to one aspect of the present disclosure (similar to FIG. 7D) where the drop seat panel is shown in the opened position, and where zipper guards are illustrated.

Figure 26A:
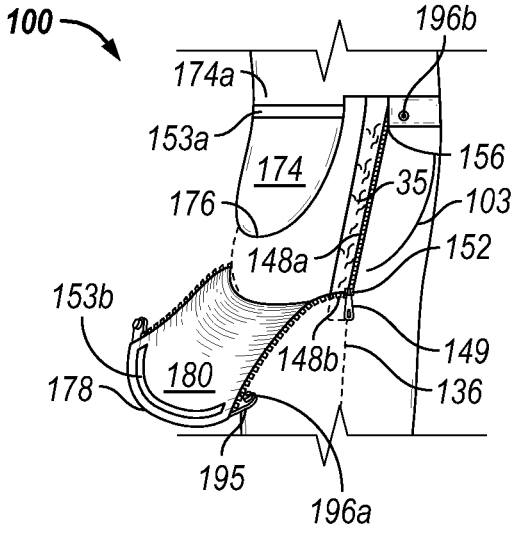

FIG. 26A illustrates a right side view of the waist section of an embodiment of the present disclosure that modifies an existing set of prior art coveralls (bibs, etc.) to outfit the coveralls with a drop seat panel according to one aspect of the present disclosure (similar to FIG. 10B) where the drop seat panel is shown in the opened position, and where zipper guards are illustrated.

Figure 26B:
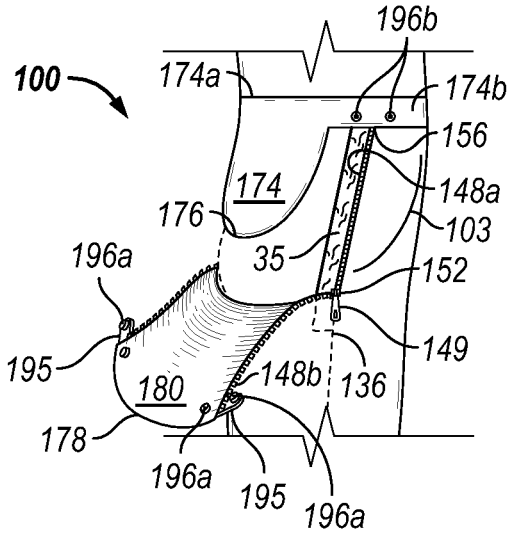

FIG. 26B illustrates a right side view of the waist section of an embodiment of the present disclosure that modifies an existing set of prior art coveralls (bibs, etc.) to outfit the coveralls with a drop seat panel according to one aspect of the present disclosure (similar to FIG. 10D) where the drop seat panel is shown in the opened position, and where zipper guards are illustrated.

Figure 27A:
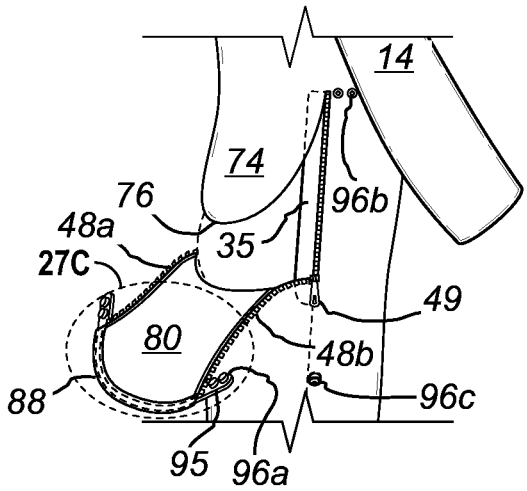

FIG. 27A illustrates a right side view of the waist section of an embodiment of the present disclosure (similar to FIGS. 4B and 22) according to one aspect of the present disclosure where the drop seat panel is shown in the opened position, where zipper guards are illustrated, and where a modified waistband is employed.

Figure 27B:
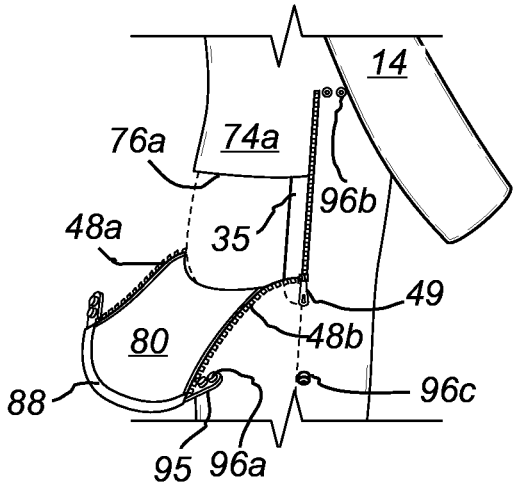

FIG. 27B illustrates a right side view of the waist section of an embodiment of the present disclosure (similar to FIGS. 15B, 15D, 19D, 19F) according to one aspect of the present disclosure where the drop seat panel is shown in the opened position, where zipper guards are illustrated, and where a modified waistband is employed.

Figure 27C:
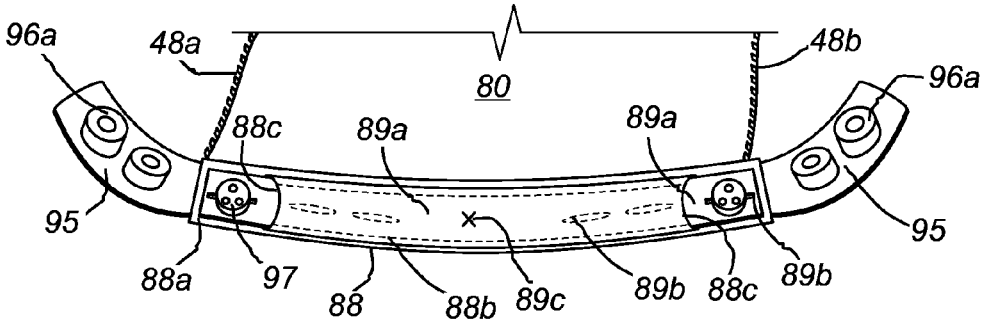

FIG. 27C illustrates a modified waistband, such as depicted in FIGS. 27A and 27B, attached to the upper horizontal edge of the drop seat panel according to one aspect of the present disclosure.

Figure 27D:
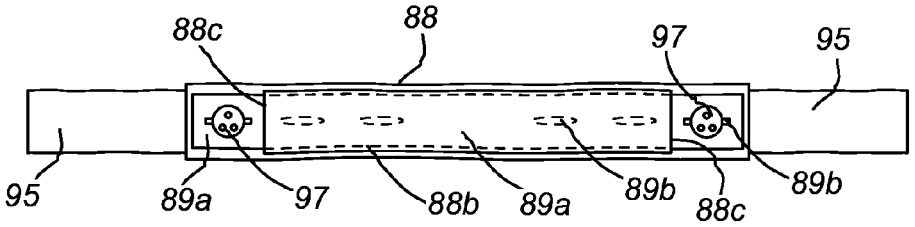

FIG. 27D illustrates a top plan view of a modified waistband, such as depicted in FIGS. 27A, 27B, and 27C that can be attached to the upper horizontal edge of the drop seat panel according to one aspect of the present disclosure.

Figure 27E:
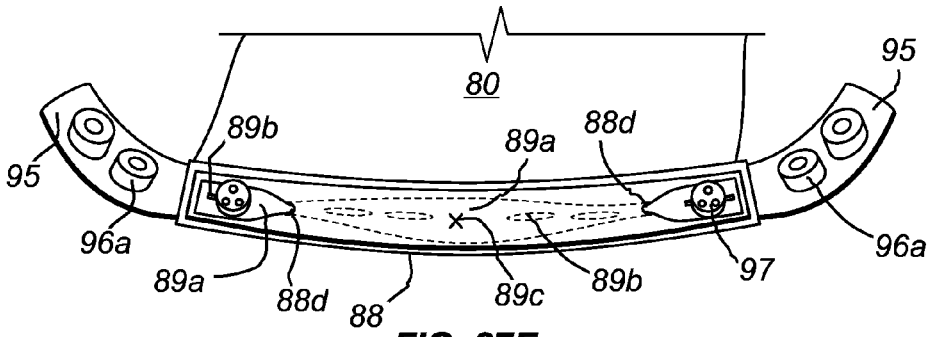

FIG. 27E illustrates another modified waistband, such as depicted in FIGS. 27A and 27B, attached to the upper horizontal edge of the drop seat panel according to another aspect of the present disclosure.

It will be appreciated that the foregoing drawings illustrate only certain embodiments of the invention and that numerous other variations may be created within the scope of the described invention.

DETAILED DESCRIPTION OF INVENTION

The above general description and the following detailed description are merely illustrative of the subject invention and additional modes, advantages and particulars of this invention will be readily suggested to those skilled in the art without departing from the spirit and scope of the invention.

Figure 1A:
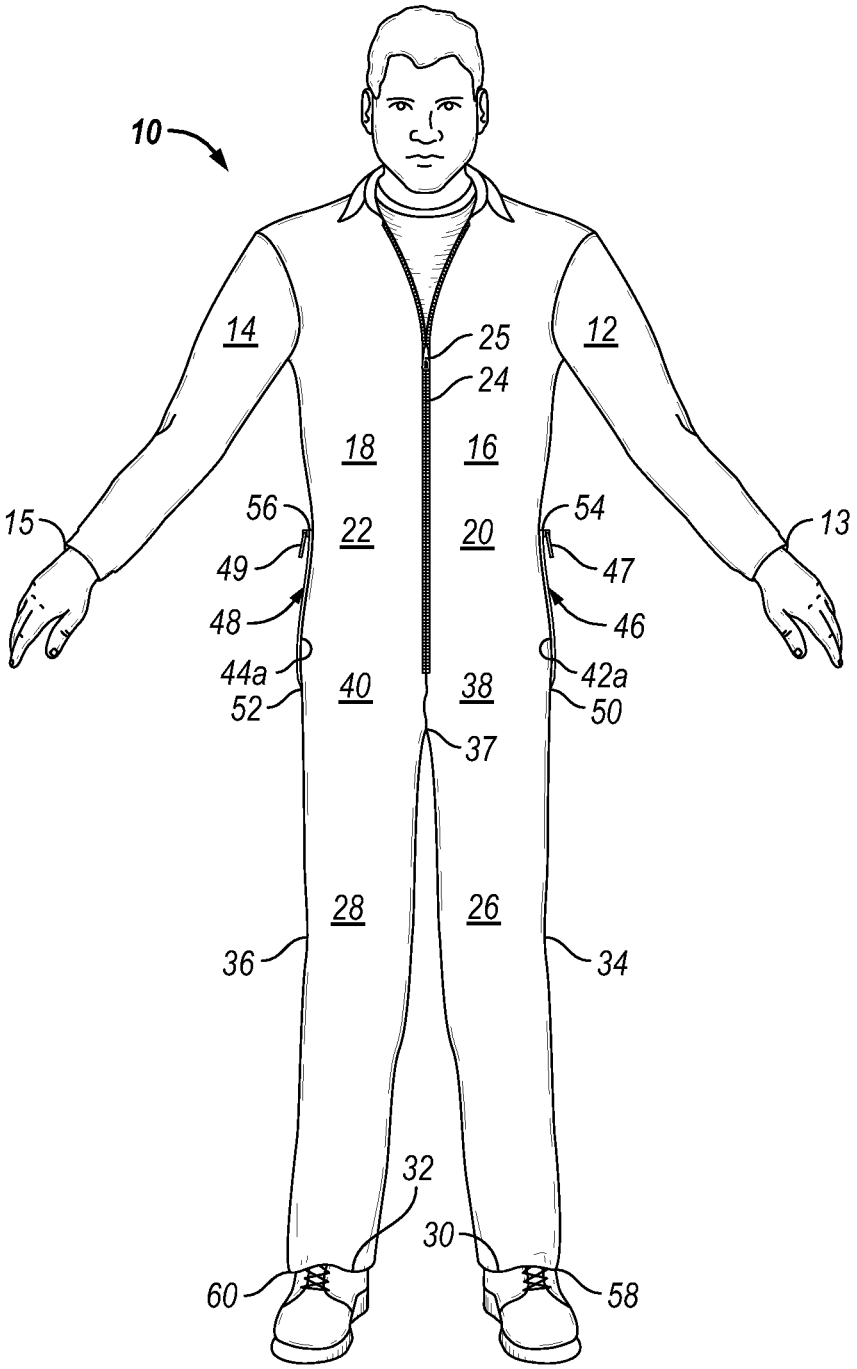
FIG. 1A illustrates a front view of a person wearing a one piece garment (e.g., coveralls, personal protective clothing, winter snow suit, jump suit, flight suit, disposable coveralls, pajamas, and the like, etc.) having a drop seat panel according to one aspect of the present disclosure.
Figure 1B:
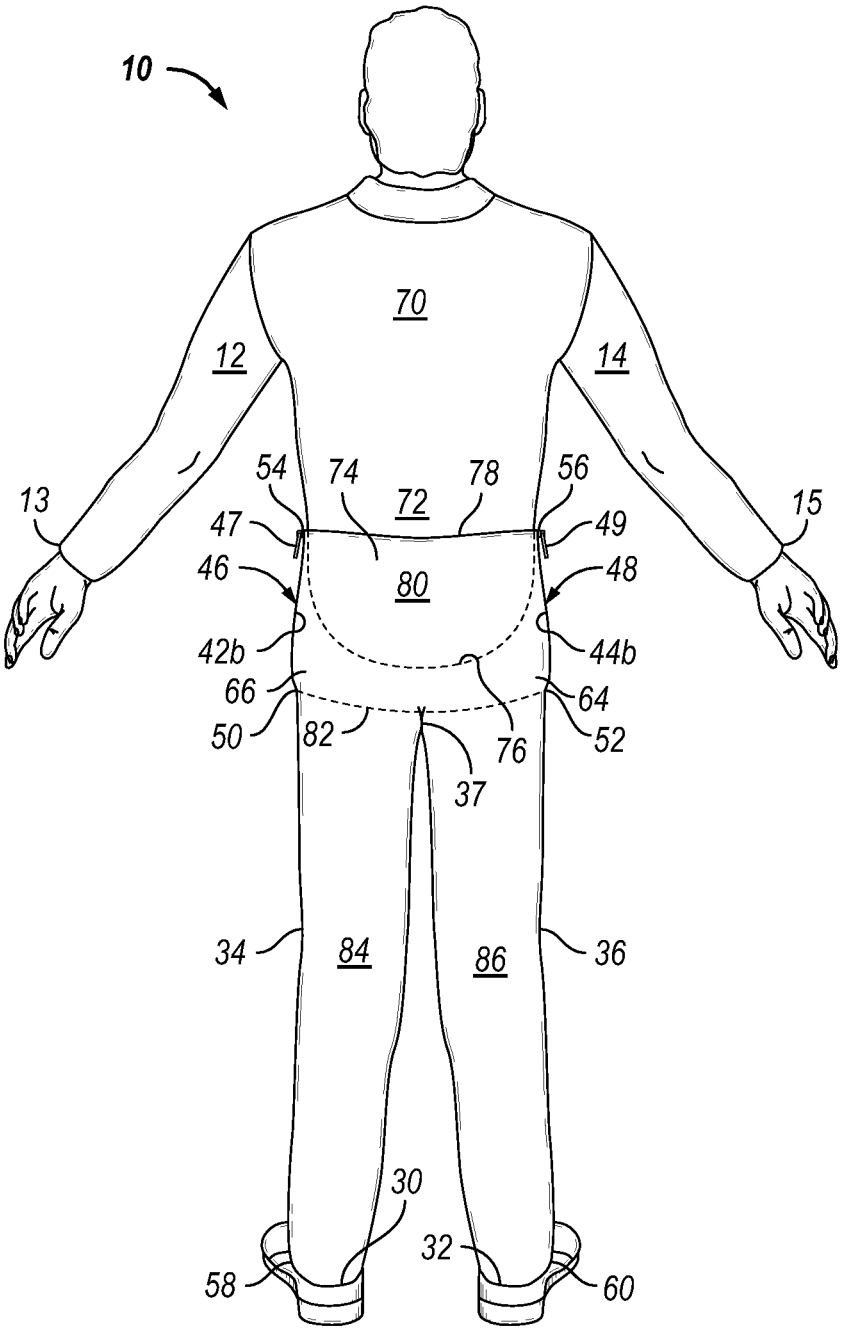
FIG. 1B illustrates a back view of a person wearing a one piece garment (e.g., coveralls, etc.) showing a drop seat panel according to one aspect of the present disclosure where the drop seat panel is shown in the closed position.
Figure 2:
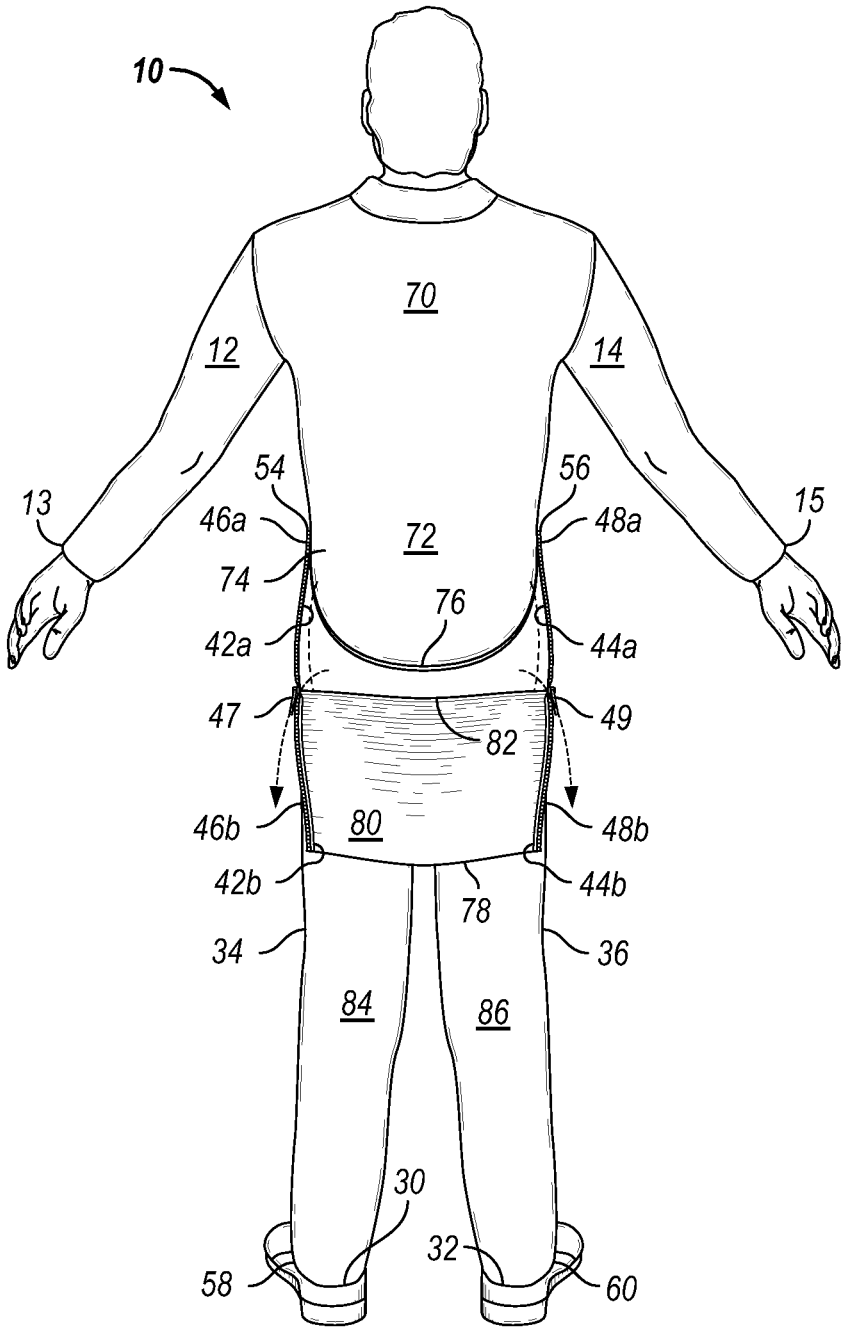
FIG. 2 illustrates a back view of a person wearing a one piece garment (e.g., coveralls, etc.) showing a drop seat panel according to one aspect of the present disclosure where the drop seat panel is shown in the opened position.
Figure 3:
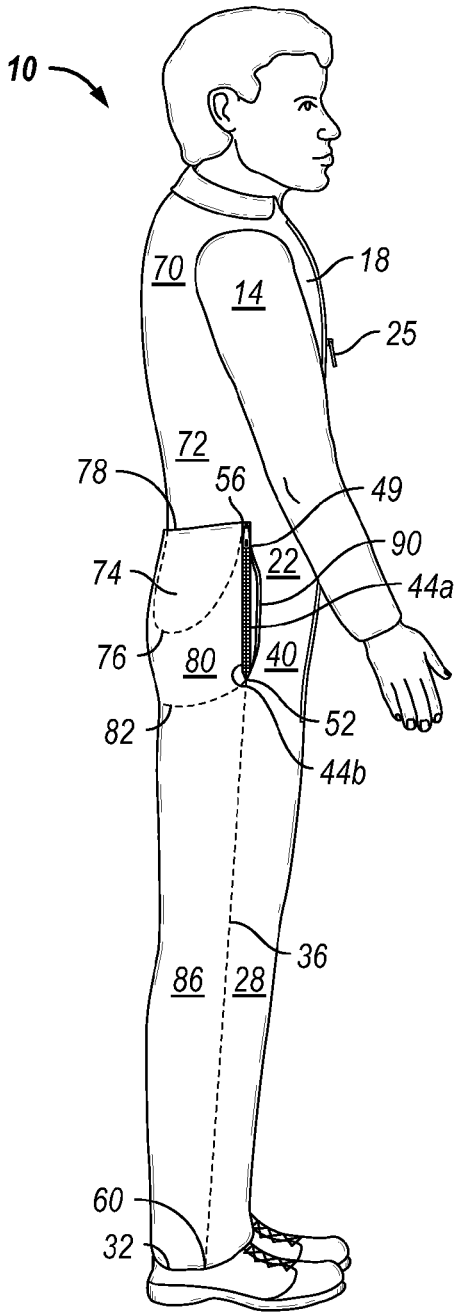
FIG. 3 illustrates a right side view of a person wearing a one piece garment (e.g., coveralls, etc.) showing a drop seat panel configured according to one aspect of the present disclosure where the drop seat panel is shown in the closed position.

Referring to FIGS. 1A. 1B, 2, and 3 there is shown and described a one-piece garment 10 embodiment of the present disclosure. FIG. 1A illustrates a front view of a person wearing a one piece garment (e.g., coveralls, personal protective clothing, winter snow suit, jump suit, flight suit, disposable coveralls, pajamas, and the like, etc.) having a drop seat panel 80 (80*a*, 80*b*) according to one aspect of the present disclosure. FIG. 1B illustrates a back view of a person wearing a one piece garment (e.g., coveralls, etc.) showing a drop seat panel 80 according to one aspect of the present disclosure where the drop seat panel is shown in the closed position. FIG. 2 illustrates a back view of a person wearing a one piece garment (e.g., coveralls, etc.) showing a drop seat panel according to one aspect of the present disclosure where the drop seat panel is shown in the opened position. FIG. 3 illustrates a right side view of a person wearing a one piece garment (e.g., coveralls, etc.) showing a drop seat panel configured according to one aspect of the present disclosure where the drop seat panel is shown in the closed position.

In one embodiment of the present disclosure, this one-piece garment 10 has a left sleeve section 12, a left sleeve cuff 13, a right sleeve section 14, a right sleeve cuff 15, a left upper torso section 16, right upper torso section 18, left front waist section 20, right front waist section 22, front zipper/enclosure 24, front zipper pull 25 (but buttons, snaps and other suitable enclosure mechanisms could be employed as are known in the art). The one-piece garment 10 also has a left pant leg front section 26 (26*a*, 26*b*), right pant leg front section 28 (28*a*, 28*b*), left pant leg cuff 30, right pant leg cuff 32, left pant leg outside edge/seam 34, right pant leg outside edge/seam 36, crotch/inseam 37, left side front crotch/pelvic region (lower torso) 38 (38*a*, 38*b*), right side front crotch/pelvic region (lower torso) 40 (40*a*, 40*b*). Although the one-piece garment 10 embodiment depicted in FIGS. 1A. 1B, 2, and 3 is shown as coveralls having long-sleeves and full length legs, the arms could be short sleeved or sleeveless, and the leg section could be full length, shorts length (or variations in between, such as culottes) or have removable leg sections that convert the garment from full length pant legs to short length pant legs.

The one-piece garment 10 is equipped with a drop seat panel 80 according to the various embodiments described herein. For example, in one embodiment, the drop seat panel 80 comprises left side front drop seat panel seam 42*a*, left side back drop seat panel seam 42*b*, right side front drop seat panel seam 44*a*, right side back drop seat panel seam 44*b*, left side drop seat panel zipper 46, left side drop seat panel front half of zipper 46*a*, left side drop seat panel back half of zipper 46*b*, left side drop seat panel zipper pull 47, right side drop seat panel zipper 48, right side drop seat panel front half of zipper 48*a*, right side drop seat panel back half of zipper 48*b*, right side drop seat panel zipper pull 49, left side drop seat panel seam bottom 50, right side drop seat panel seam bottom 52, left side drop seat panel seam top 54 (left pant leg outside edge/seam top), right side drop seat panel seam top 56 (right pant leg outside edge/seam top), left pant leg outside edge/seam bottom 58, right pant leg outside edge/seam bottom 60, left side rear pelvic region 62, right side rear pelvic region 64, left pant leg back section 66, right pant leg back section 68, garment back upper torso section 70 (70*a*, 70*b*), garment back waist section 72 (72*b*), garment upper torso tuck/shirttail section 74, lower edge 76 of garment upper torso tuck/shirttail section 74, back waist seam/drop seat panel top seam 78, drop seat panel fold line 82, left pant leg back section 84, right pant leg back section 86 (86*a*, 86*b*). In this embodiment, the side enclosures (here shown as zippers 46, 48) can be opened by pulling down on the respective zipper pulls 47, 49. In this embodiment, the side enclosures (shown here as zippers 46, 48) are installed along the outside seams 34, 36 of the leg section of the one-piece garment 10. The length of the side enclosures can vary depending on the size of the garment, but will typically begin at their lowest position 50, 52, in the region of the crotch 38, 40 and extend upward to their top position 54, 56 in the area of the waist 20, 22. In one embodiment, the length of the side enclosures (e.g., zippers 46, 48) is about 9 inches in length, or a range of about 5 inches or more for a typical adult-sized one-piece garment, but other lengths can be employed and can be tailored to the clothing sizes, fabric types (e.g., ability of fabric to stretch) and styles required by the users.

A pocket 92 is shown in this embodiment as an optional accessory, but it will be understood that any variety of accessories, such as pockets, loops, and other external attachments known in the art may be used on this one-piece garment. If back pockets are installed on the outside of the drop panel 80, it is preferred that the pockets have a zippered top or other top enclosure to prevent contents from spilling out when the drop down panel is in its opened position.

When the drop seat panel 80 is opened, this facilitates the wearer of the one-piece garment to use the rest room or attend to other personal or individual needs without being required to remove the one-piece garment 10. This easy access individual needs one piece garment 10 allows the wearer simple and quick access to care for individual needs without partial or complete removal of the garment thereby reducing time required and eliminating the difficulty, frustration, embarrassment, safety, and health risk of an ordinary one piece garment. For example, where a user wears a one piece garment such as the coveralls style embodiment as described herein, the user puts on the one piece garment 10 as with any other one piece garment. The front enclosure 24 can be zipped (or buttoned or otherwise fastened using provided fasteners) from the crotch to the neckline as desired (or with respect to halter embodiments where there is no front enclosure, then the halter ties would be tied behind the user's neck). When needing to care for individual need, the wearer opens the side enclosures (here shown as zippers 46, 48 by pulling down on the respective zipper pulls 47, 49). In this embodiment, the side zippers 46, 48 start at the waistband area 56, 54 and go down the side seams to the end of the desired zipper length 50, 52. Once the side zippers are unzipped, the back bottom or drop down panel 80 of the one piece garment 10 will fall down into the open position (e.g., FIG. 2). In this embodiment, the lower back torso section 72 (72*b*) is outfitted with a shirttail tuck section 74 that can be tucked behind the drop down panel 80 when the drop down panel is in its closed position (e.g., FIG. 1B).

When the wearer's individual needs have been taken care of, the wearer closes the side enclosures (here shown as zippers 46, 48 by pulling up on the respective zipper pulls 47, 49). The user can then ensure that the shirttail section 74 is tucked in behind the drop down panel 80.

Figure 4A:
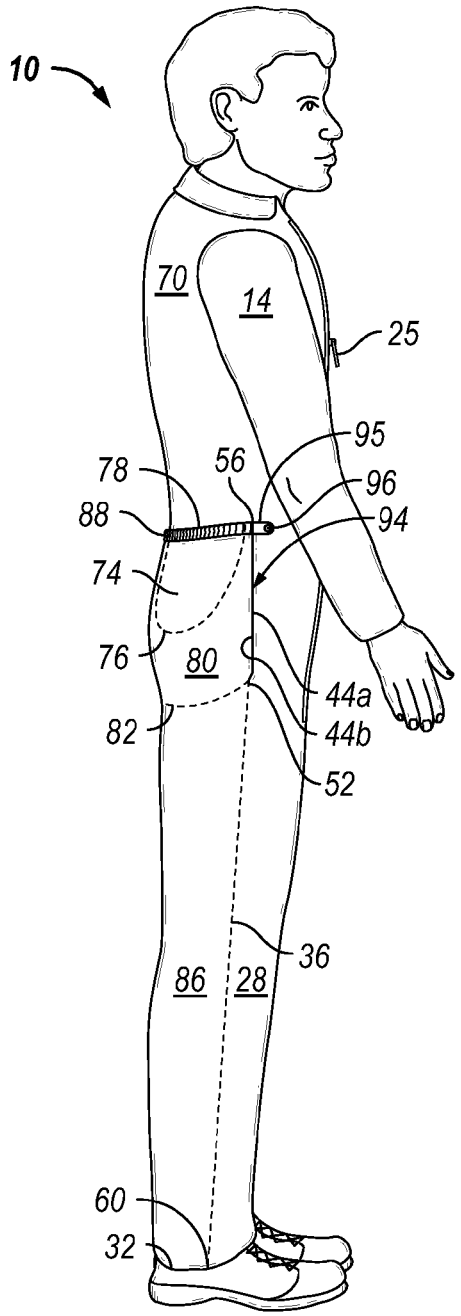
FIG. 4A illustrates a right side view of a person wearing a one piece garment (e.g., coveralls, etc.) showing a drop seat panel configured according to another aspect of the present disclosure where the drop seat panel is shown in the closed position.
Figure 4B:
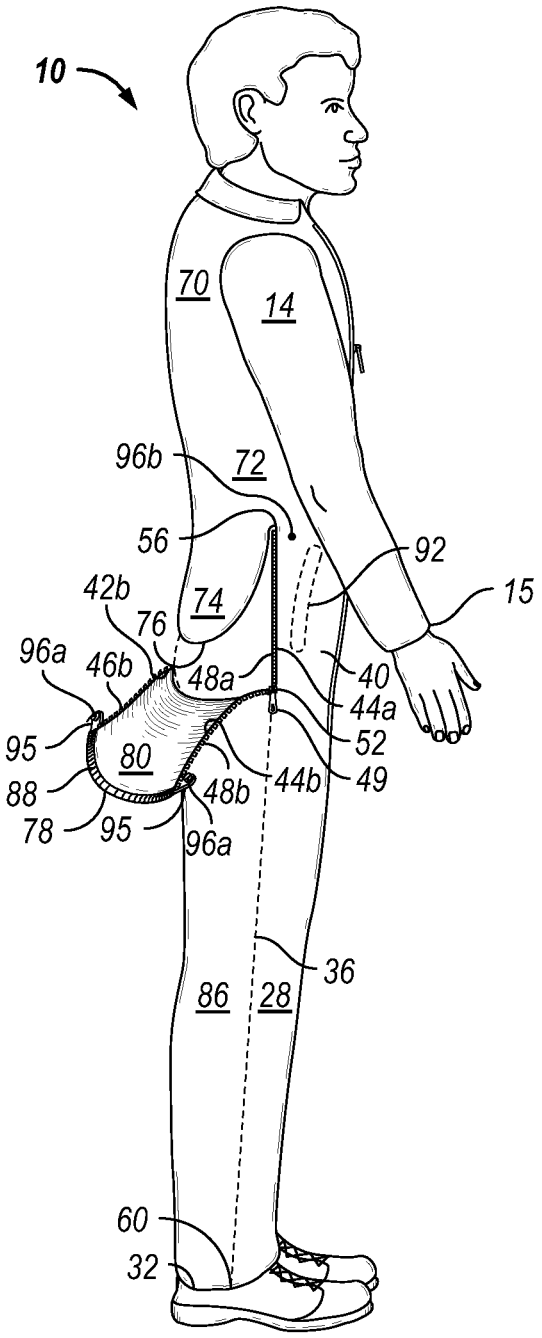
FIG. 4B illustrates a right side view of a person wearing a one piece garment (e.g., coveralls, etc.) showing a drop seat panel configured according to another aspect of the present disclosure where the drop seat panel is shown in the opened position.

FIG. 4A illustrates a right side view of a person wearing a one piece garment (e.g., coveralls, etc.) showing a drop seat panel configured according to another aspect of the present disclosure where the drop seat panel is shown in the closed position. FIG. 4B illustrates a right side view of a person wearing a one piece garment (e.g., coveralls, etc.) showing a drop seat panel configured according to another aspect of the present disclosure where the drop seat panel is shown in the opened position. In this embodiment, the side enclosures (e.g., zippers 46, 48) are hidden behind a seam cover 94. If a zipper is used as the side enclosure (e.g., zippers 46, 48), the zipper can be a standard zipper, installed using the centered method, lapped method, as well as invisible zipper method that sews in the zipper in a manner that "disappears" into the garment seam. The zipper style can be selected and can be installed in suitable fashion to provide the strength, durability and style desired for the particular style of garment. As such, as will be understood to those of ordinary skill in the art, the zippers can be installed with interfacing along the seam allowance, etc. Also in this embodiment, if desired, the back waist seam/drop seat panel top seam 78 can be outfitted with elastic waist band material 88 and snap tabs 95 and snaps 96 (96*a*, 96*b*) can be added to the upper outside corners of the drop seat panel 80 to assist in securing the panel 80 in its closed position. Although the snap tabs are shown being attached to the drop seat panel 80, for attachment to a snap 96*b* located on the unitary portion of the garment, the snap tabs 95 could be mounted on the unitary portion of the garment (e.g., where snap 96*b* is located) and the snap 96*b* could be located on the drop panel 80. The snaps are optional if extra support is desired. A pocket 92 is shown in this embodiment as an optional accessory, but it will be understood that any variety of accessories, such as pockets, loops, and other external attachments known in the art may be used on this one-piece garment. If back pockets are installed on the outside of the drop panel 80, it is preferred that the pockets have a zippered top or other top enclosure to prevent contents from spilling out when the drop down panel is in its opened position.

Figure 4C:
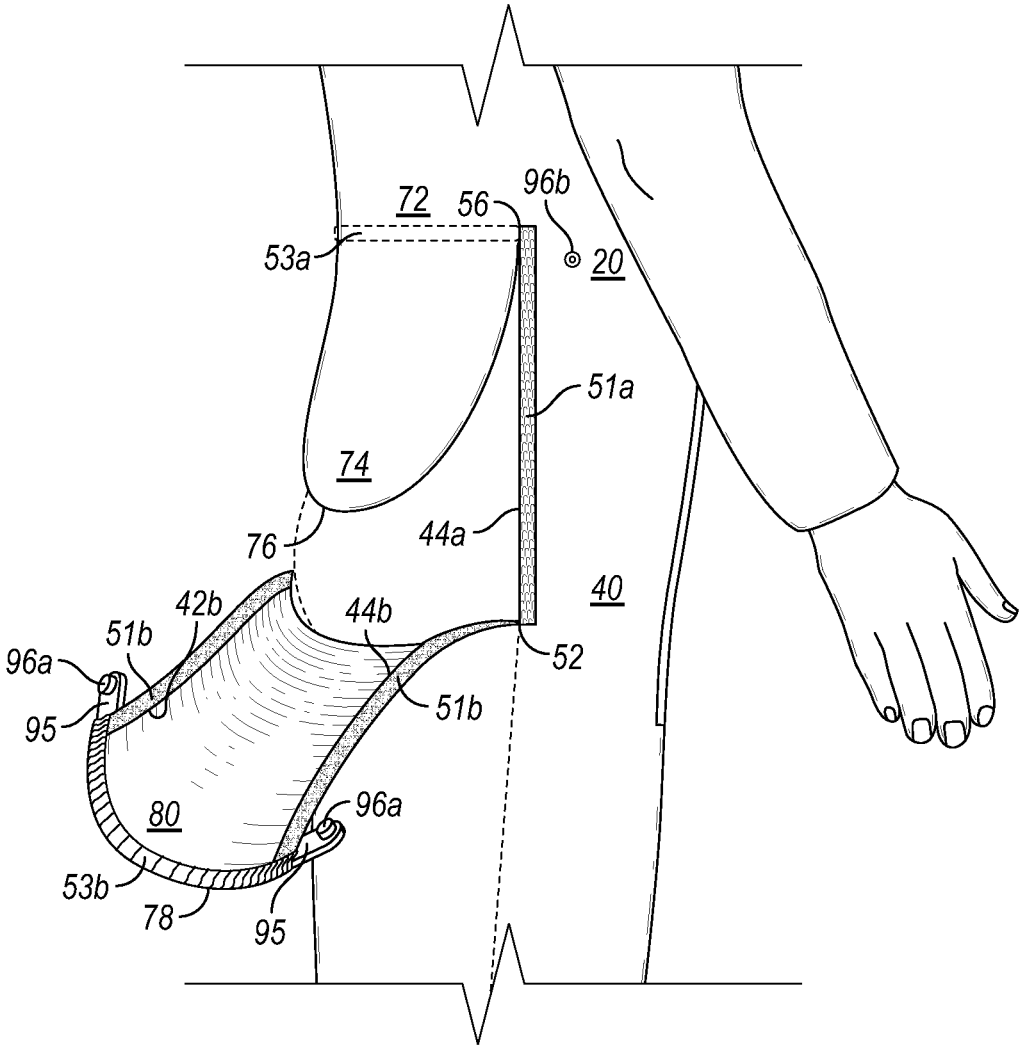
FIG. 4C illustrates a right side view of a person wearing a one piece garment (e.g., coveralls, etc.) showing a drop seat panel configured according to another aspect of the present disclosure where the drop seat panel is shown in the opened position.

Referring now to FIG. 4C, there is illustrated a right side view of a person wearing a one piece garment (e.g., coveralls, etc.) showing a drop seat panel configured according to another aspect of the present disclosure where the drop seat panel is shown in the opened position. In this embodiment, rather than using zippers (46, 48) for the side enclosures, other fastener materials can be employed, such as hook and loop fastener strips (e.g., Velcro® brand fasteners) 51*a*, 51*b* or a series of snaps or buttons or clips or other known fasteners (not shown) or combinations thereof. Although shown as a single continuous strip 51*a*, a plurality of hook and loop or other fasteners could be employed in this area to accomplish this closure. Additionally, if desired, another embodiment uses a fastening mechanism 53*b* along the top edge 78 of the drop down panel 80, such as, a hook and loop fastener strip (e.g., Velcro® brand fasteners) or series of snaps or buttons or clips or other known fasteners (not shown) or combinations thereof that would attach or fasten with fasteners 53*a* in the garment back waist section 72 (72*b*).

Figure 5A:
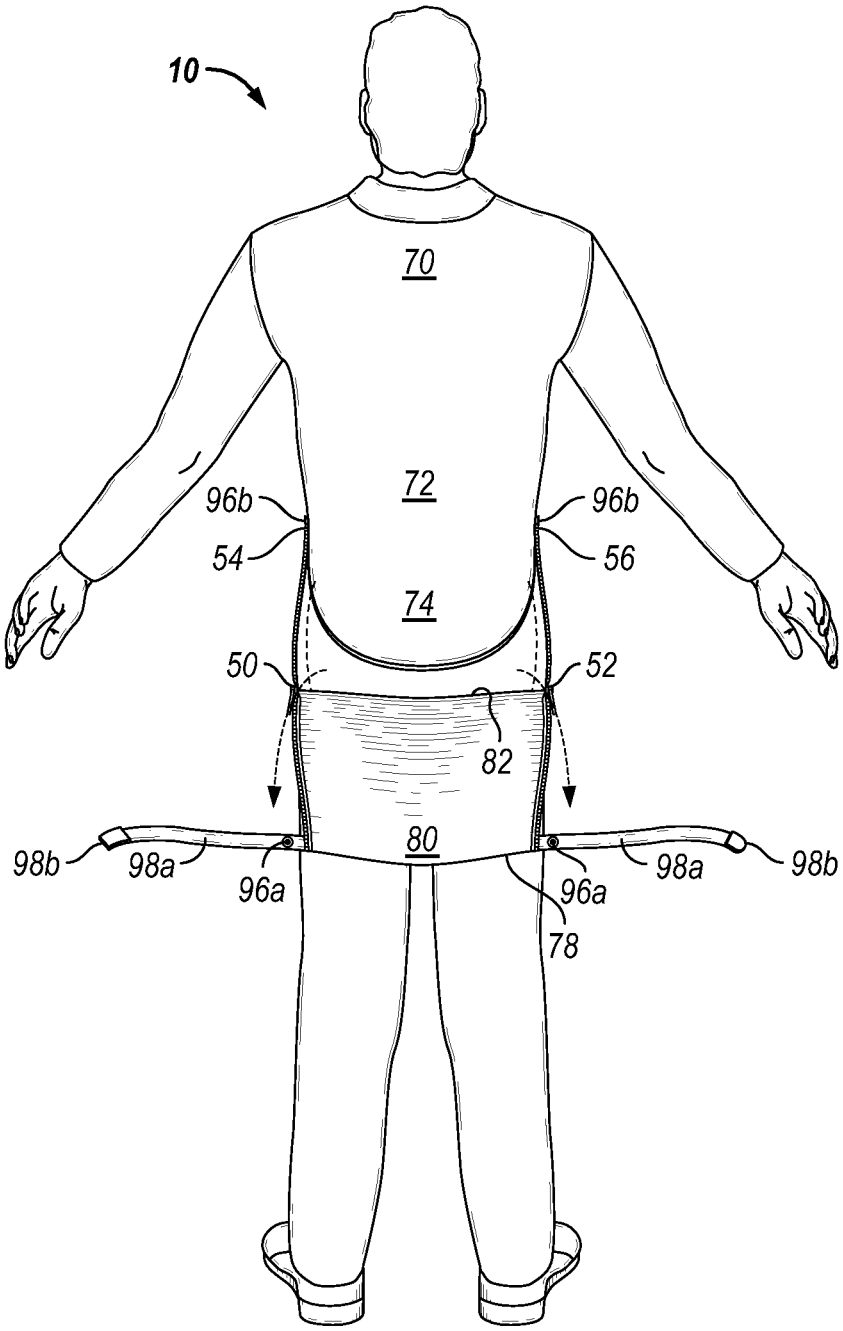
FIG. 5A illustrates a back view of a person wearing a one piece garment (e.g., coveralls, etc.) showing a drop seat panel according to another aspect of the present disclosure where the drop seat panel is shown in the closed position.
Figure 5B:
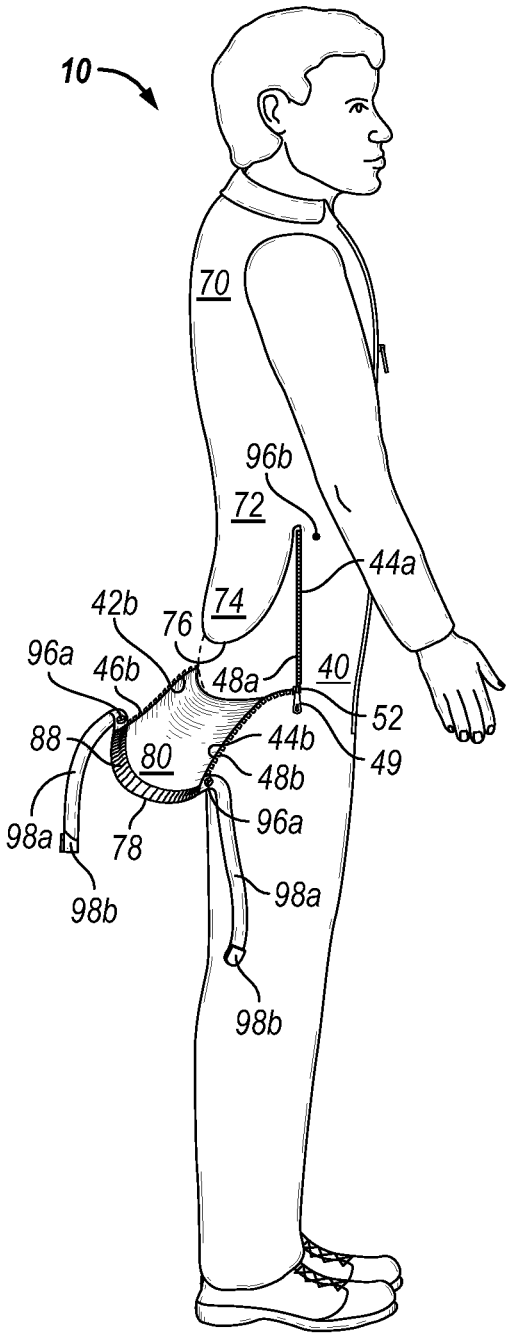
FIG. 5B illustrates a right side view of a person wearing a one piece garment (e.g., coveralls, etc.) showing a drop seat panel configured according to one aspect of the present disclosure where the drop seat panel is shown in the opened position.
Figure 5C:
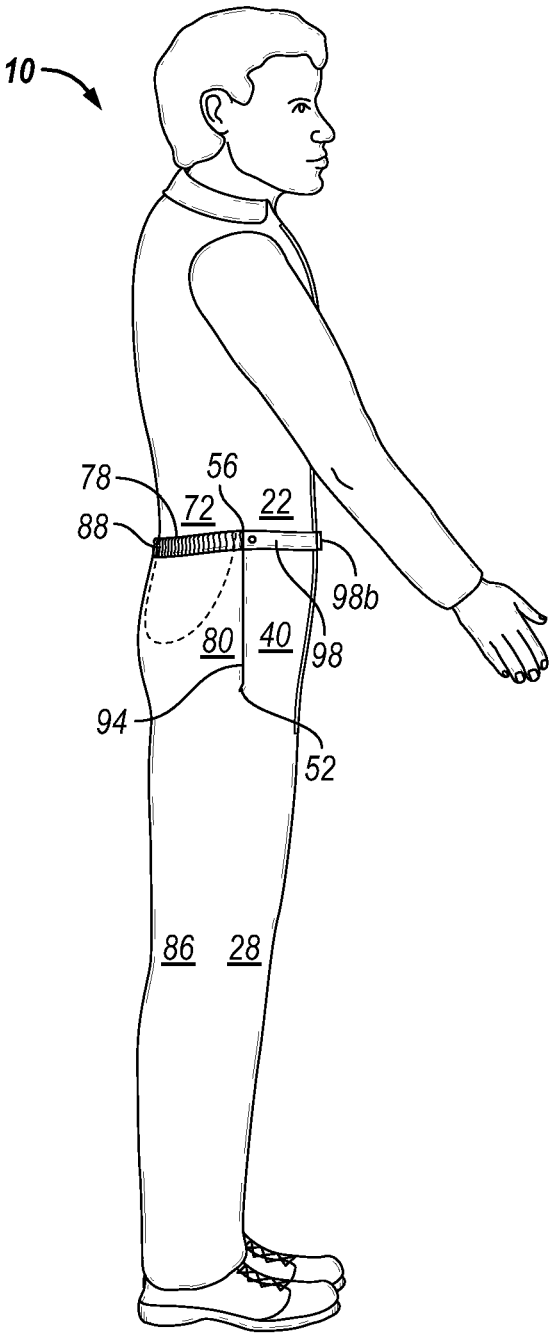
FIG. 5C illustrates a right side view of a person wearing a one piece garment (e.g., coveralls, etc.) showing a drop seat panel configured according to another aspect of the present disclosure where the drop seat panel is shown in the closed position.

FIG. 5A illustrates a back view of a person wearing a one piece garment (e.g., coveralls, etc.) showing a drop seat panel according to another aspect of the present disclosure where the drop seat panel is shown in the closed position. FIG. 5B illustrates a right side view of a person wearing a one piece garment (e.g., coveralls, etc.) showing a drop seat panel configured according to one aspect of the present disclosure where the drop seat panel is shown in the opened position. FIG. 5C illustrates a right side view of a person wearing a one piece garment (e.g., coveralls, etc.) showing a drop seat panel configured according to another aspect of the present disclosure where the drop seat panel is shown in the closed position. In the embodiment illustrated in FIGS. 5A-C, a belt 98*a* (with suitable buckle or fastening device 98*b*) can be attached to the upper outside corners of the drop seat panel 80 to assist in securing the panel 80 in its closed position. Snap tabs 95 and snaps 96 (96*a*, 96*b*) can also be added to provide additional closure across the region above the top of the side enclosures 56, 54. Also in this embodiment, if desired, the back waist seam/drop seat panel top seam 78 can be outfitted with elastic waist band material 88.

Figure 6A:
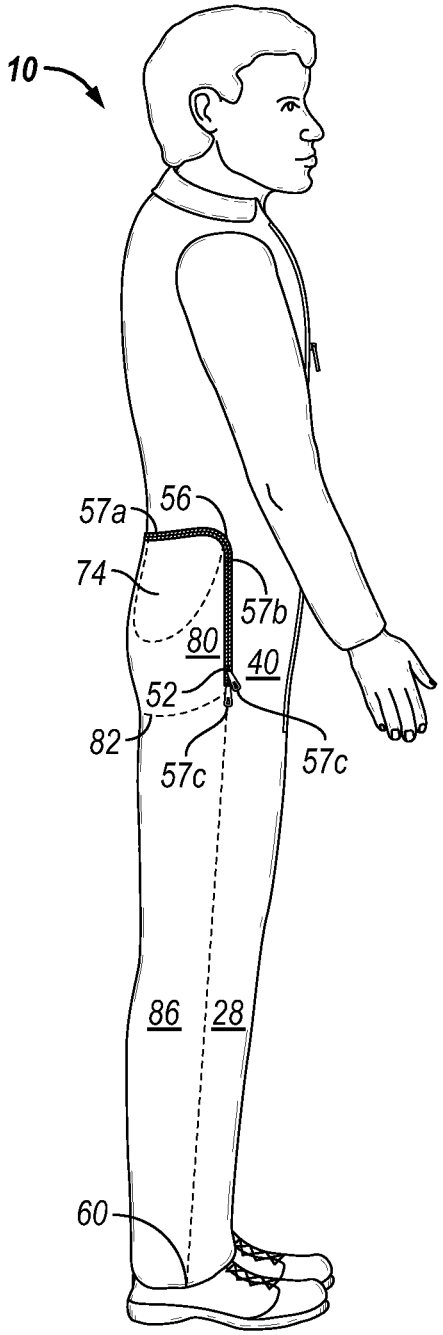
FIG. 6A illustrates a right side view of a person wearing a one piece garment (e.g., coveralls, etc.) showing a drop seat panel configured according to another aspect of the present disclosure where the drop seat panel is shown in the closed position (shown here with fully zipperable seam extending from right leg drop seat seam to left leg drop seat seam).
Figure 6B:
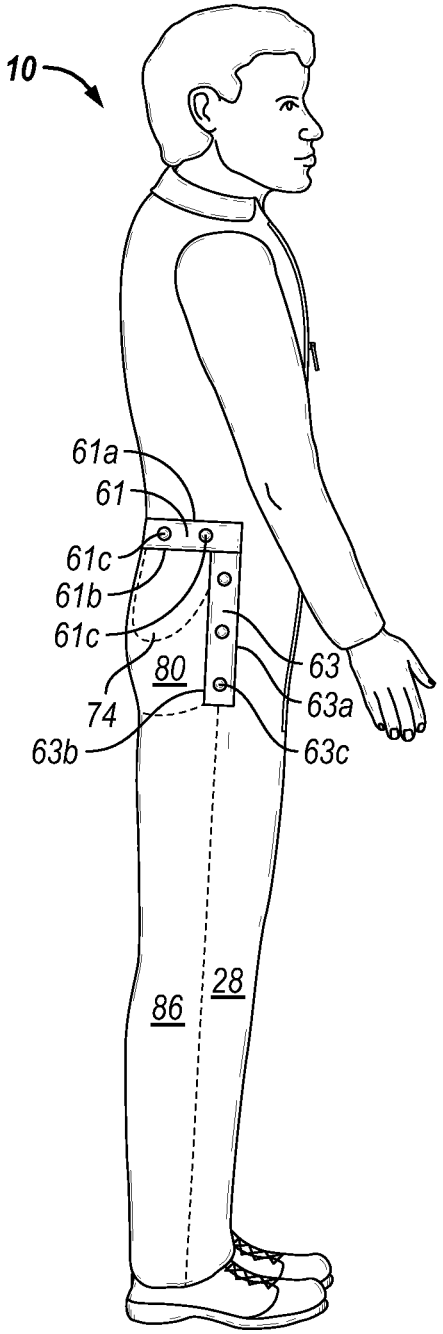
FIG. 6B illustrates a right side view of a person wearing a one piece garment (e.g., coveralls, etc.) showing a drop seat panel configured according to another aspect of the present disclosure where the drop seat panel is shown in the closed position. The openable seam is shown covered by a wind/storm flap.
Figure 6C:
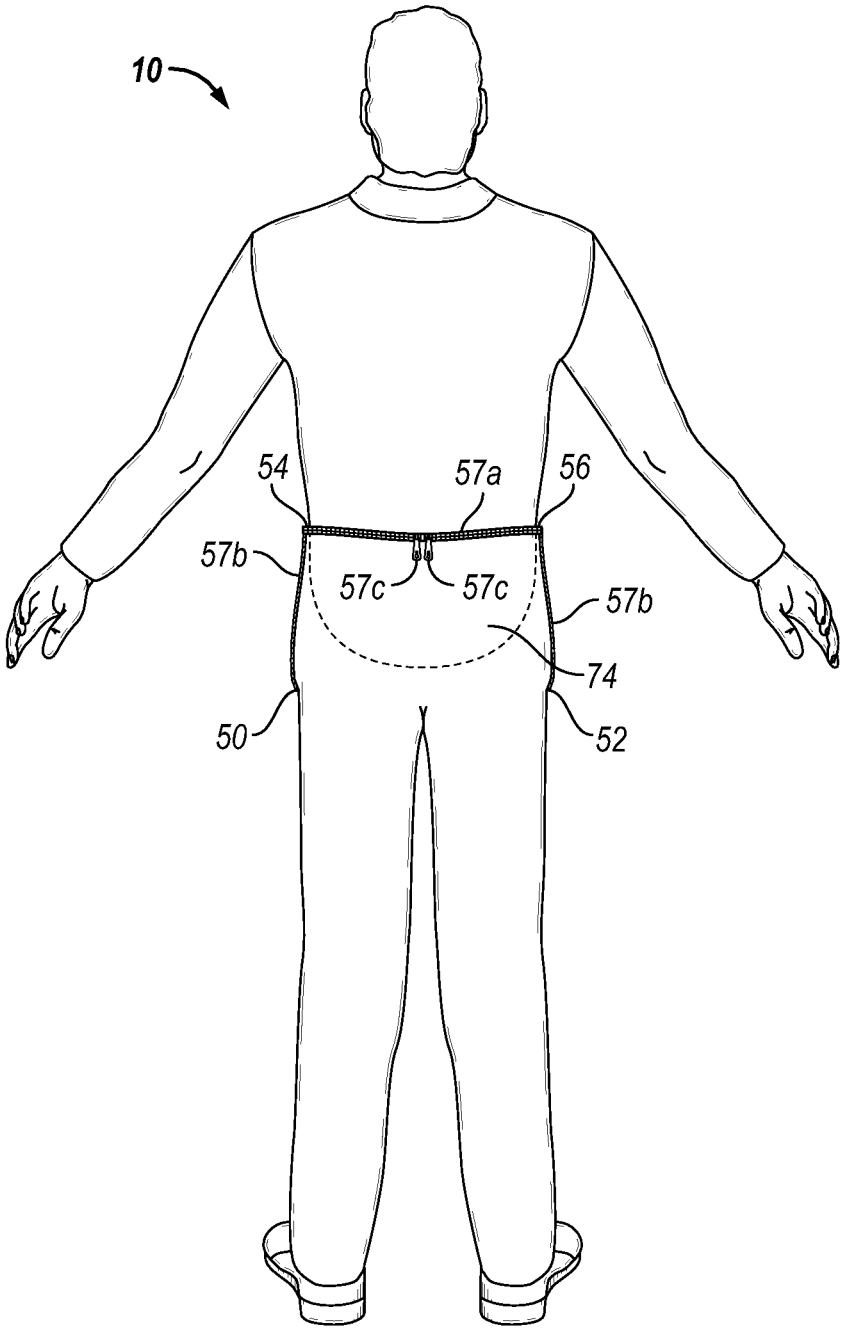
FIG. 6C illustrates a back side view of a person wearing a one piece garment (e.g., coveralls, etc.) showing a drop seat panel configured according to another aspect of the present disclosure where the drop seat panel is shown in the closed position (shown here with fully zipperable seam extending from right leg drop seat seam to left leg drop seat seam).
Figure 6D:
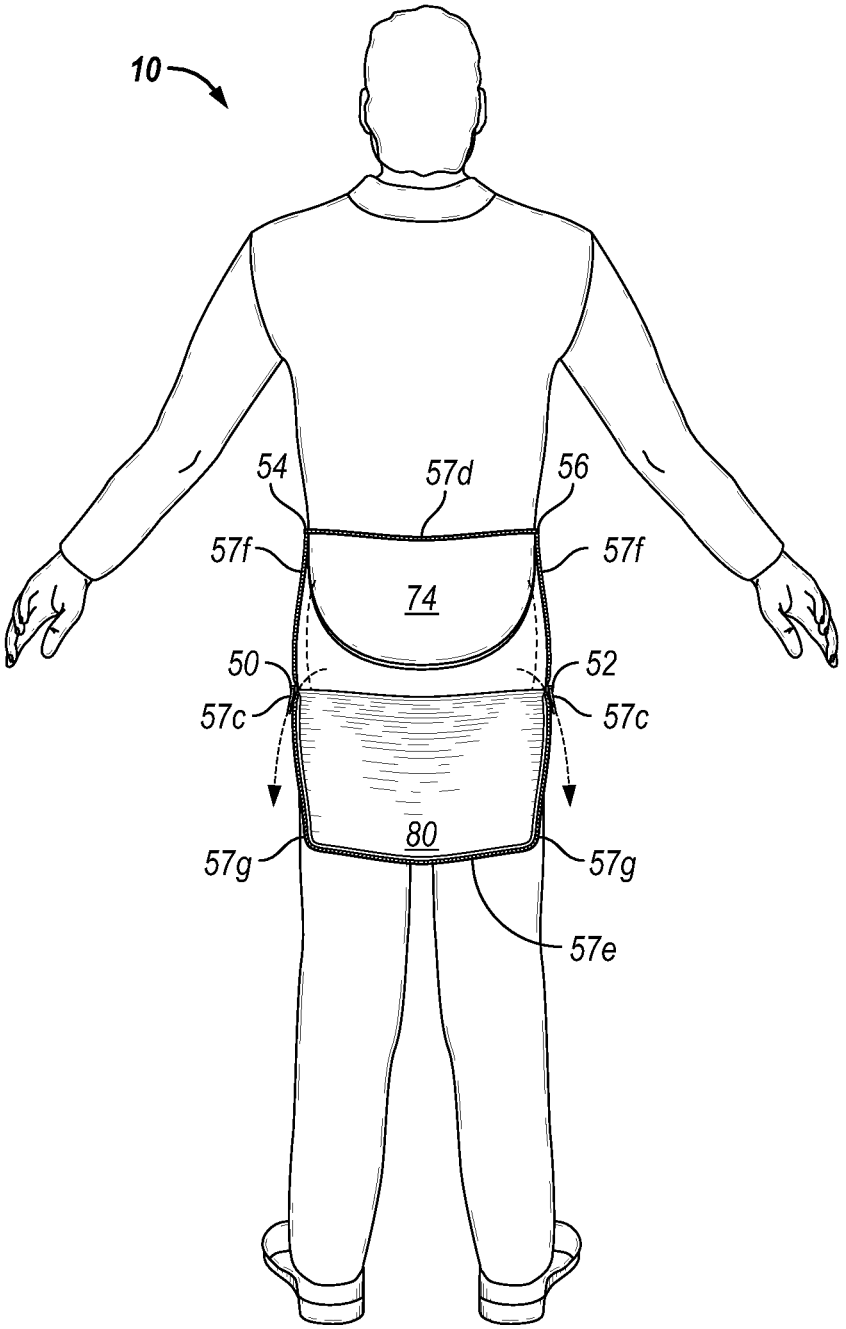
FIG. 6D illustrates a back side view of a person wearing a one piece garment (e.g., coveralls, etc.) showing a drop seat panel configured according to another aspect of the present disclosure where the drop seat panel is shown in the opened position (shown here with fully zipperable seam extending from right leg drop seat seam to left leg drop seat seam).

FIG. 6A illustrates a right side view of a person wearing a one piece garment 10 (e.g., coveralls, etc.) showing a drop seat panel configured according to another aspect of the present disclosure where the drop seat panel is shown in the closed position (shown here with fully zipperable seam extending from right leg drop seat seam to left leg drop seat seam). FIG. 6B illustrates a right side view of a person wearing a one piece garment 10 (e.g., coveralls, etc.) showing a drop seat panel configured according to another aspect of the present disclosure where the drop seat panel is shown in the closed position. The openable seam is shown covered by a wind/storm flap. FIG. 6C illustrates a back side view of a person wearing a one piece garment 10 (e.g., coveralls, etc.) showing a drop seat panel configured according to another aspect of the present disclosure where the drop seat panel is shown in the closed position (shown here with fully zipperable seam extending from right leg drop seat seam to left leg drop seat seam). FIG. 6D illustrates a back side view of a person wearing a one piece garment 10 (e.g., coveralls, etc.) showing a drop seat panel configured according to another aspect of the present disclosure where the drop seat panel is shown in the opened position (shown here with fully zipperable seam extending from right leg drop seat seam to left leg drop seat seam).

Referring now to FIGS. 6A-6C, there is shown an embodiment in which the sides and top edges of the drop down panel 80 are fully zippered with zipper 57. In this embodiment, the zipper track extends from right side drop seat panel seam bottom 52, up to right side drop seat panel seam top 56 (right pant leg outside edge/seam top), then across to left side drop seat panel seam top 54 (left pant leg outside edge/seam top), and finally down to left side drop seat panel seam bottom 50. In this embodiment, the zipper 57 comprises a back zipper section 57*a*, side zipper sections 57*b* and zipper pulls 57*c*. Single or multiple zipper pulls 57*c* can be employed so that the zipper is configured sufficiently to permit the drop seat to be opened. When opened, there is illustrated the back zipper section upper half 57*d*, back zipper section lower half 57*e*, side zipper section front half 57*f* and side zipper section back half 57*g*. In this embodiment, a shirttail tuck section 74 is illustrated as an optional feature. FIG. 6B also illustrates that storm/wind flaps 61, 63 can be employed to cover the zipper enclosure 57. It will be understood to those with the benefit of this disclosure that any of the drop down flap enclosures (e.g., zippers, hook and loop fasteners, buttons, snaps, or combinations thereof, etc.) can be covered with a storm/wind flap. In this embodiment, the back zipper section 57*a* is covered with a storm/wind flap 61 having a drop seat flap back section storm/wind flap attachment seam 61*a* located above the zipper 57*a*, a drop seat flap back section storm/wind flap opening edge 61*b* that can be pulled back to reveal the zipper 57*a*, or in use, pulled down over the zipper section 57*a*, and snapped or fastened in place with drop seat flap back section storm/wind flap fasteners/snaps 61*c* (any suitable fastener can be used, but snaps are most commonly used) or combinations thereof. Similarly, the side opening zippers 57*b* are may also be covered with a drop seat flap side section storm/wind flap 63 having a drop seat flap side section storm/wind flap attachment seam 63*a*, a drop seat flap side section storm/wind flap opening edge 63*b* that can be pulled back to reveal the zipper sections 57*b*, or in use, pulled down over the zipper sections 57*b*, and snapped or fastened in place with drop seat flap side section storm/wind flap fasteners/snaps 63*c* (any suitable fastener can be used, but snaps are most commonly used) or combinations thereof.

Figure 7A:
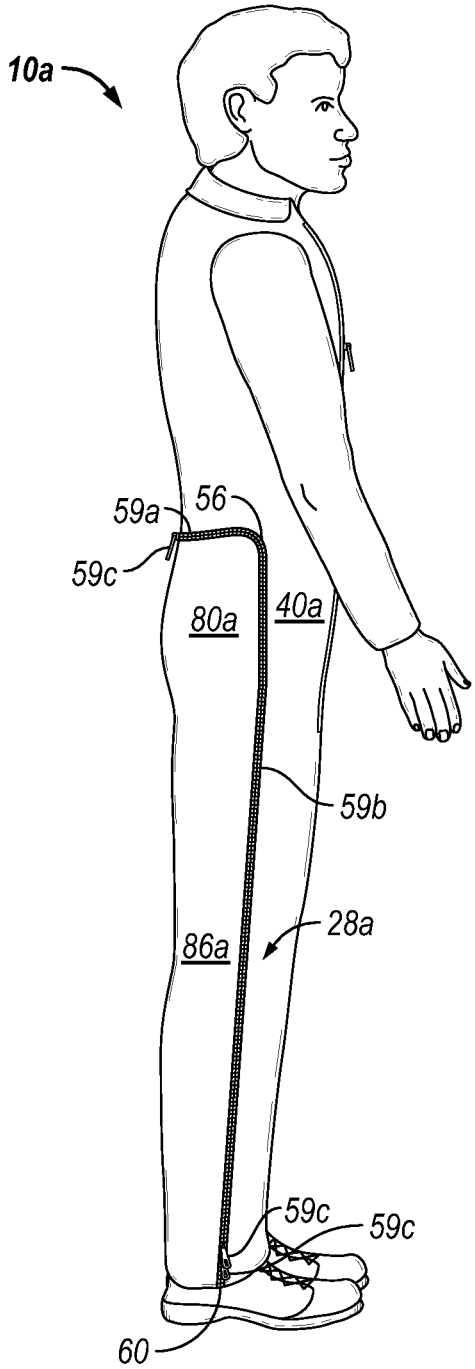
FIG. 7A illustrates a right side view of a person wearing a one piece garment (e.g., coveralls, etc.) showing a drop seat panel configured according to another aspect of the present disclosure where the drop seat panel is shown in the closed position (shown here with fully zipperable seam extending from right leg bottom cuff to left leg bottom cuff).
Figure 7B:
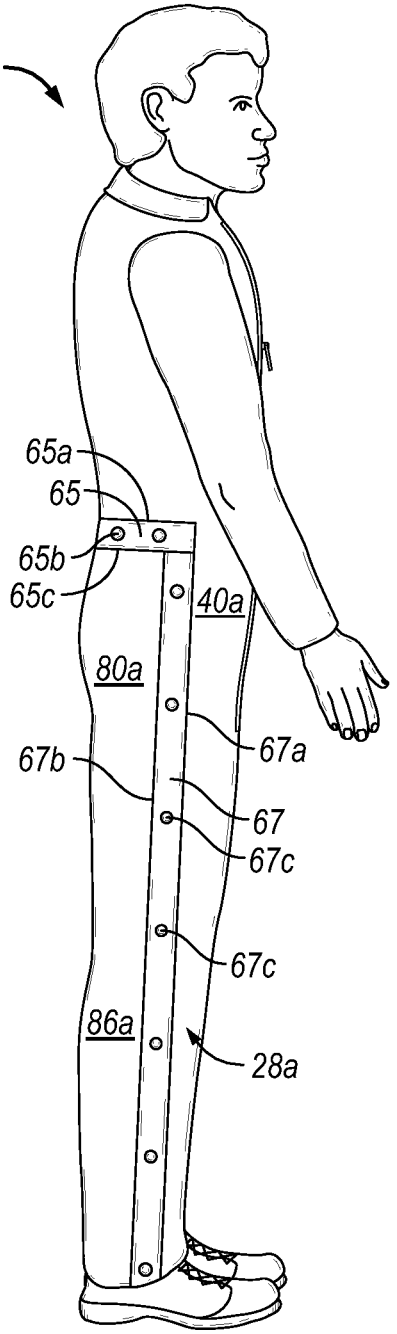
FIG. 7B illustrates a right side view of a person wearing a one piece garment (e.g., coveralls, etc.) showing a drop seat panel configured according to another aspect of the present disclosure where the drop seat panel is shown in the closed position. The openable seam is shown covered by a wind/storm flap.
Figure 7C:
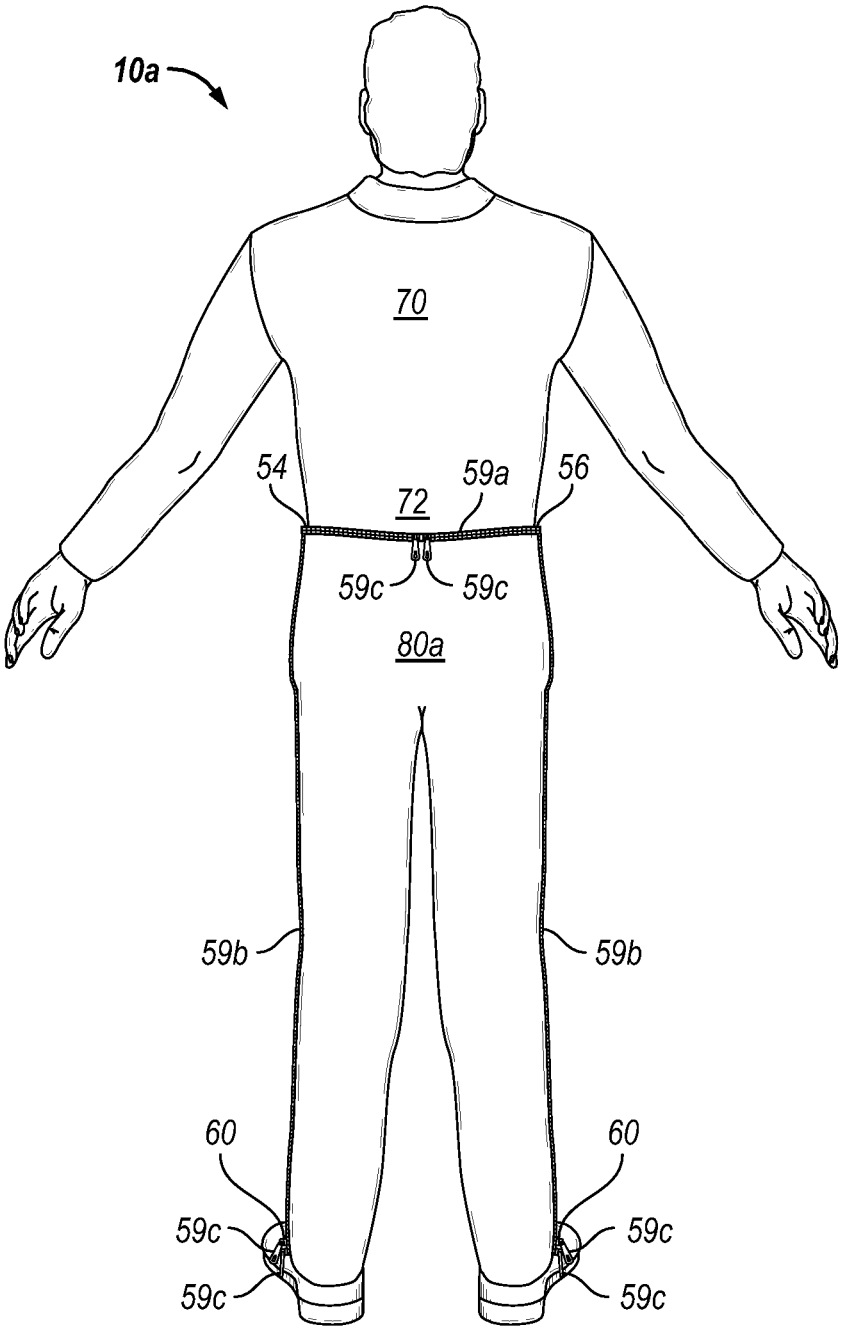
FIG. 7C illustrates a back side view of a person wearing a one piece garment (e.g., coveralls, etc.) showing a drop seat panel configured according to another aspect of the present disclosure where the drop seat panel is shown in the closed position (shown here with fully zipperable seam extending from right leg bottom cuff to left leg bottom cuff).
Figure 7D:
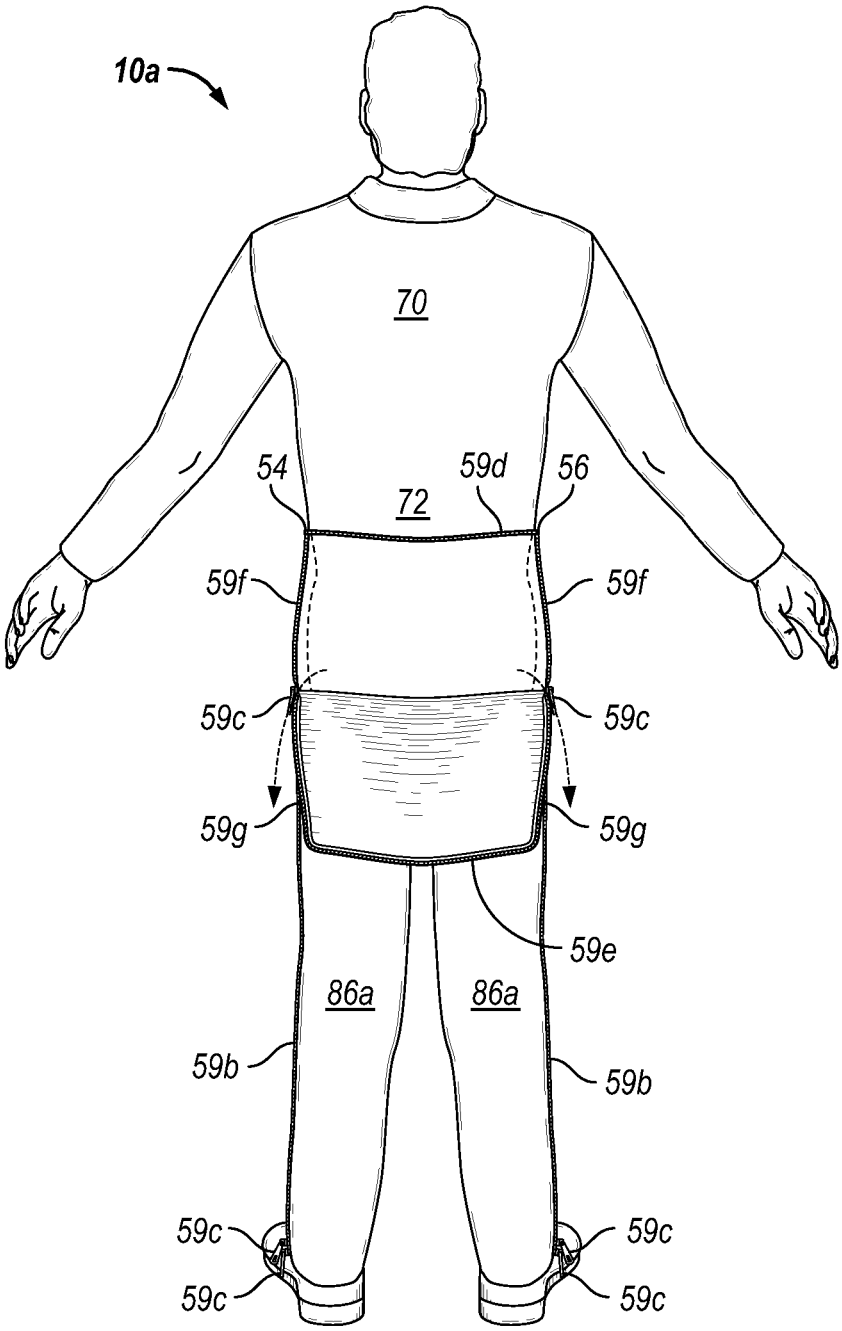
FIG. 7D illustrates a back side view of a person wearing a one piece garment (e.g., coveralls, etc.) showing a drop seat panel configured according to another aspect of the present disclosure where the drop seat panel is shown in the opened position (shown here with fully zipperable seam extending from right leg bottom cuff to left leg bottom cuff).

FIG. 7A illustrates a right side view of a person wearing a one piece garment 10*a* (e.g., coveralls, etc.) showing a drop seat panel configured according to another aspect of the present disclosure where the drop seat panel is shown in the closed position (shown here with fully zipperable seam extending from right leg bottom cuff to left leg bottom cuff). FIG. 7B illustrates a right side view of a person wearing a one piece garment 10*a* (e.g., coveralls, etc.) showing a drop seat panel configured according to another aspect of the present disclosure where the drop seat panel is shown in the closed position. The openable seam is shown covered by a wind/storm flap. FIG. 7C illustrates a back side view of a person wearing a one piece garment 10*a* (e.g., coveralls, etc.) showing a drop seat panel configured according to another aspect of the present disclosure where the drop seat panel is shown in the closed position (shown here with fully zipperable seam extending from right leg bottom cuff to left leg bottom cuff). FIG. 7D illustrates a back side view of a person wearing a one piece garment 10*a* (e.g., coveralls, etc.) showing a drop seat panel configured according to another aspect of the present disclosure where the drop seat panel is shown in the opened position (shown here with fully zipperable seam extending from right leg bottom cuff to left leg bottom cuff).

Referring now to FIGS. 7A-7C, there is shown an embodiment in which the sides and top edges of the drop down panel 80*a* are fully zippered with zipper 59. In this embodiment, the zipper track extends from right pant leg outside edge/seam bottom 60, up to right side drop seat panel seam top 56 (right pant leg outside edge/seam top), then across to left side drop seat panel seam top 54 (left pant leg outside edge/seam top), and finally down to left pant leg outside edge/seam bottom 58. In this embodiment, the zipper 59 comprises a back zipper section 59*a*, side zipper sections 59*b* and zipper pulls 59*c*. Single or multiple zipper pulls 59*c* can be employed so that the zipper is configured sufficiently to permit the drop seat to be opened and to also permit, e.g., an ankle to waist zippered opening. When opened, there is illustrated the back zipper section upper half 59*d*, back zipper section lower half 59*e*, side zipper section front half 59*f* and side zipper section back half 59*g*. In this embodiment, a shirttail tuck section 74 is illustrated as an optional feature. FIG. 7B also illustrates that storm/wind flaps 65, 67 can be employed to cover the zipper enclosure 59. It will be understood to those with the benefit of this disclosure that any of the drop down flap enclosures (e.g., zippers, hook and loop fasteners, buttons, snaps, or combinations thereof, etc.) can be covered with a storm/wind flap. In this embodiment, the back zipper section 59*a* is covered with a storm/wind flap 65 having a drop seat flap back section storm/wind flap attachment seam 65*a* located above the zipper 59*a*, a drop seat flap back section storm/wind flap opening edge 65*b* that can be pulled back to reveal the zipper 59*a*, or in use, pulled down over the zipper section 59*a*, and snapped or fastened in place with drop seat flap back section storm/wind flap fasteners/snaps 65*c* (any suitable fastener can be used, but snaps are most commonly used) or combinations thereof. Similarly, the side opening zippers 59*b* are may also be covered with a drop seat flap side section storm/wind flap 67 having a drop seat flap side section storm/wind flap attachment seam 67*a*, a drop seat flap side section storm/wind flap opening edge 67*b* that can be pulled back to reveal the zipper sections 59*b*, or in use, pulled down over the zipper sections 59*b*, and snapped or fastened in place with drop seat flap side section storm/wind flap fasteners/snaps 67*c* (any suitable fastener can be used, but snaps are most commonly used) or combinations thereof.

The storm/wind flaps described herein (61, 63, 65, 67) can be made of any suitable material, preferably wind and water resistant. The material selected could be colorful to add an accent, or be of a reflective and brightly colored material to add to safety visibility. A belt 98*a* (not shown in this embodiment) could also be added and use the same colors as the storm flaps so that the one-piece garment 10 has an outward appearance that looks like a standard one-piece garment without revealing the presence of the drop down panel 80 (80*a*, 80*b*).

The ankle and wrist regions of the one-piece jumpsuit can be outfitted with elastic. The seams can be serged seams. Seams can also be sewn and taped; seams can also be bound. The back sections of the one-piece coverall garments can be three-piece action-back, or bi-swing back style.

Although the above embodiments have illustrated a one-piece garment that resembles coveralls, any one-piece garment design (by way of example but not limitation: coveralls, overalls, hooded overalls, bib overalls, biberalls, personal protective clothing bibs and overalls, disposable coveralls, athletic bibs, ski bibs, snowsuits, jumpsuits, rompers, foul weather gear, work clothes, play clothes, laboratory and medical suits, hazardous materials handling suits, sportswear, formal wear, casual wear, and the like) can employ the benefits of the teachings of the present disclosure and be outfitted with a drop down panel as taught and described herein. These garments can be used in any area, such as, for example, industrial settings, cleanroom settings, medical settings, veterinary, correctional facilities, athletics, marine and aeronautics, home and gardening, mechanics, safety, maintenance and general cleanup, food processing, pharmaceuticals, electronics, manufacturing, agriculture, oil field services, law enforcement, commercial, personal, professional, recreational, military, etc., and can be used by any age, sex, or size person. For example, referring now to FIGS. 8A-8C there is disclosed a one piece bib coverall embodiment (sometimes also referred to as biberalls) 10*b*. Bibs are often used in the same settings as coveralls, but can include an outer garment coat being worn over the upper torso section 19 which can add complexity to attending to personal needs. In this embodiment, the upper torso section 19 covers a portion of the wearer's chest, and the lower back torso section 70*c* covers only a portion of the wearer's back, the sections 19 and 70*a* being connected at the top by shoulder straps 99 employing, e.g., shoulder strap adjustments/attachments 99*a*. The drop seat panel 80*a* can be outfitted in similar fashion to those described herein in connection with, e.g., FIGS. 1A-7D. Bib overalls can have elastic suspenders and a welted fly-front with a snap closure.

The drop seat panels of the present disclosure can be retrofitted onto existing coveralls and biberalls (and other one-piece garments). Numerous vendors exist offering one-piece garments, and the following represents only a small listing of those companies providing standard resuseble and/or disposable coveralls and bibs: Dickies® brand coveralls (Williamson-Dickie Mfg. Co., Fort Worth, Tex.; www.dickies.com); ARAMARK®, www.aramark.com, (Norwell, Mass.); ARAMARK® Nomex® 4.5-oz.; Carhartt, www.carhartt.com; Lakeland® MicroMax®; Kimberly-Clark Repel® and Kleenguard® Coveralls; Tempro® Disposable Coveralls; DuPont™ ProShield® NexGen® coverall; and DuPont Tychem® QC Hooded Coverall. DuPont™ Tyvek® Coveralls; Gempler's (www.gemplers.com); GEMPLER'S Blue Poly-coated Coveralls; KEY® Zip-to-the-Knee Long-sleeve Coveralls; and VF Workwear. These coverall and bib designs are incorporated herein by reference for all purposes and represent many coverall and bib styles and accessories that could be incorporated into the coveralls and bibs of the present invention.

Figure 9:
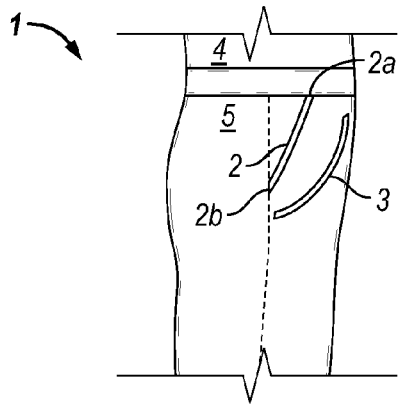
FIG. 9 (Prior Art)
FIG. 9 illustrates a right side view of the waist section of a typical prior art one piece coveralls garment having an access slot above the pocket entrance.
Figure 10A:
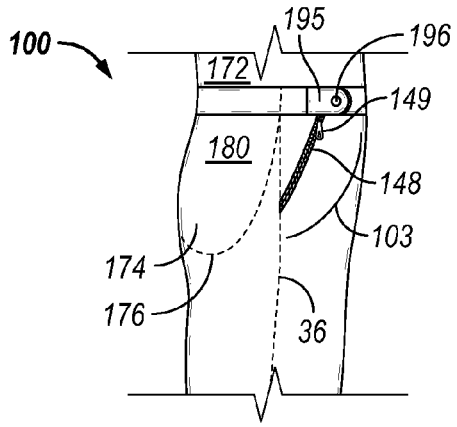
FIG. 10A illustrates a right side view of the waist section of an embodiment of the present disclosure that modifies an existing set of prior art coveralls (bibs, etc.) to outfit the coveralls with a a drop seat panel according to one aspect of the present disclosure where the drop seat panel is shown in the closed position.
Figure 10B:
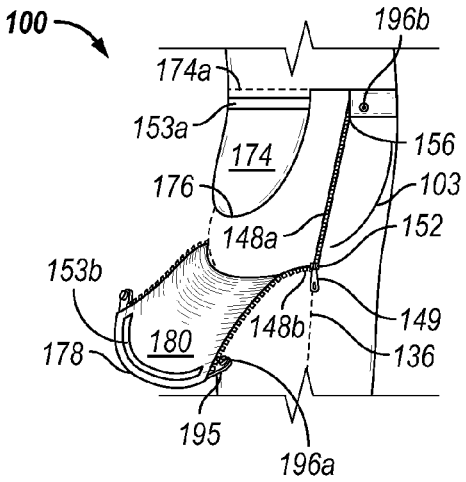
FIG. 10B illustrates a right side view of the waist section of an embodiment of the present disclosure that modifies an existing set of prior art coveralls (bibs, etc.) to outfit the coveralls with a drop seat panel according to one aspect of the present disclosure where the drop seat panel is shown in the opened position.
Figure 10C:
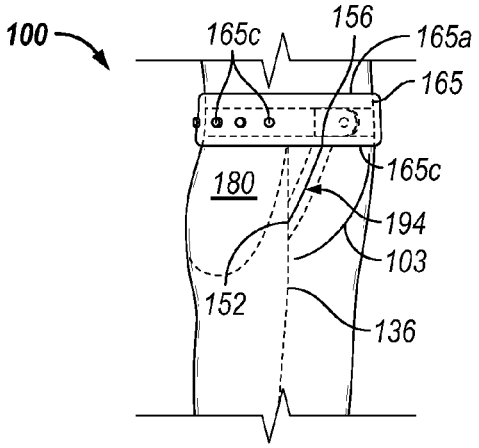
FIG. 10C illustrates a right side view of the waist section of an embodiment of the present disclosure that modifies an existing set of prior art coveralls (bibs, etc.) to outfit the coveralls with a drop seat panel according to one aspect of the present disclosure where the drop seat panel is shown in the closed position with a storm/wind flap covering the drop seat seams.
Figure 10D:
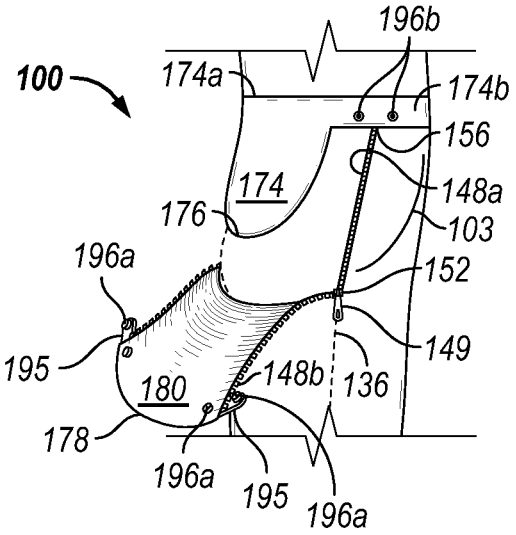
FIG. 10D illustrates a right side view of the waist section of an embodiment of the present disclosure that modifies an existing set of prior art coveralls (bibs, etc.) to outfit the coveralls with a drop seat panel according to one aspect of the present disclosure where the drop seat panel is shown in the opened position.

Referring now to FIG. 9 there is shown the waist/mid section of an example prior art one-piece garment 1. The prior art coveralls 1 typically employ side vent openings or pass through pockets 2 to permit the wearer to reach through the garment to inner pants pockets (not shown). The side vents extend from side vent top 2*a* to side vent bottom 2*b*. The prior art coveralls also typically have a pocket 3 below the side vent 2. The garment 1 has an upper torso section 4 and lower torso section 5. Using the teachings of the present disclosure enables one to retrofit the existing coveralls 1 into embodiments 100 having drop seat panels 180 by, e.g., cutting open a lateral seam along the waist section of the garment 1 between the side vent tops 2*a*. Zippers 148 (with pulls 149) can be installed in the side vents 2. A shirttail section 174 can be attached to the waist section 172 along cut seam 174*a*. The shirttail section 174 could be any desired length along the seam 174*a*, and can be optional. Suitable waist bands, snap tabs 195, and snaps 196 (and optional fastener material 153*a*, 153*b*) can be employed to secure the drop down panel 180 into its closed position (FIG. 10A). FIG. 10B shows a different view with the drop down panel 180 in its open position. Seams are depicted by references 36, 136. The pocket 103 remains unaffected by the modification. In this embodiment so configured, the one-piece garment of the present disclosure 100 retains use of the existing pocket 103, and much like with the description of prior embodiments, further comprises a right side drop seat panel zipper pull 149, right side drop seat panel seam bottom 152, optional hook and loop fastener strip (e.g., Velcro® brand fasteners) 153*a*, 153*b* or snaps/buttons, and right side drop seat panel seam top 156 (right pant leg outside edge/seam top). Zippers 148 are depicted as intersecting at seam bottom 152 with seam 36, 136, and extending diagonally upwardly away from the seam 36, 136 towards the front of the garment to seam top 156. Turning to FIG. 10B (where drop seat panel 180 is in an open position) and to FIG. 10C (where drop seat panel 180 is in a closed position), zipper 148 and seam 136 extend substantially diagonally upwardly beginning from seam bottom 152 to the front of the garment to seam top 156 when drop seat panel 180 is in a closed position. Referring back to FIG. 10C, this embodiment can also employ a drop seat flap back section storm/wind flap 165 that is attached above the seam 174*a* at drop seat flap back section storm/wind flap attachment seam 165*a*. The storm/wind flap 165 has an opening edge 165*b* and fasteners/snaps 165*c*. If desired for stylistic purposes, the side enclosure (e.g., zipper) 148 could be hidden 194. When the existing coveralls 1 are cut open along the line running across the back face between each side vent top 2*a* (e.g., FIG. 10D), there will be a need to add material to create a waist band section 174*b*. In one embodiment, the waist band section could be added to the top edge 178 of the drop down panel, in which case, suitable fasteners could be used to secure the waistband to the front and/or back torso sections. In another embodiment, the waist band section 174*b* can be added to the lower torso section as shown in FIG. 10D. It will be apparent to those having the benefit of the present disclosure that there exist many ways to modify existing coveralls/bibs/and other one-piece garments to contain a drop down panel as described herein.

Figure 11B:
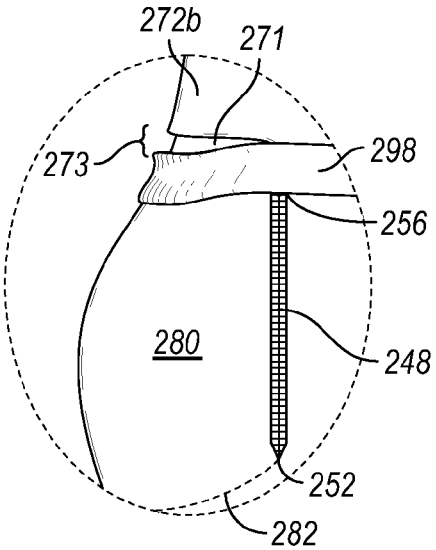
FIG. 11B illustrates the section labeled 11B in FIG. 11A showing an embodiment where no shirttails section is used.
Figure 11C:
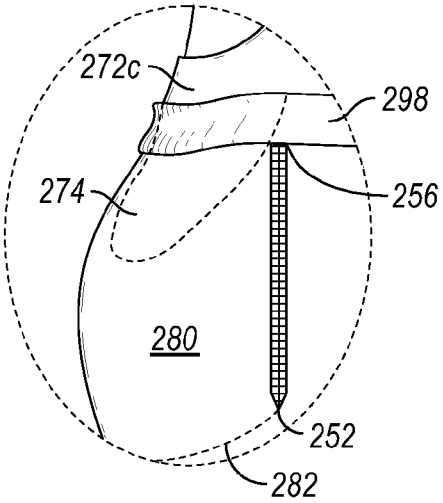
FIG. 11C illustrates the section labeled 11C in FIG. 11A showing an embodiment where a shirttails section is used.
Figure 11D:
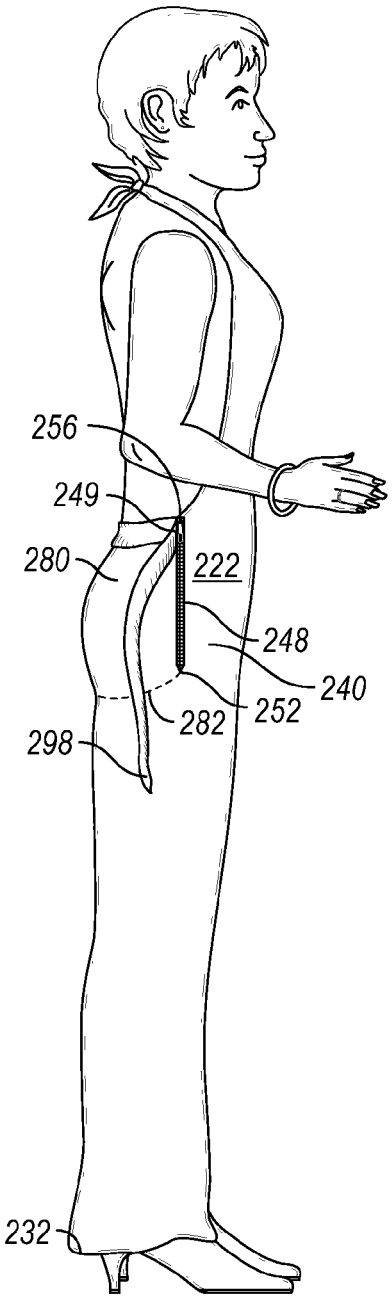
FIG. 11D illustrates a right side view of a person wearing a one piece garment (e.g., jumpsuit, halter jumpsuit, etc.) showing a drop seat panel configured according to another aspect of the present disclosure where the drop seat panel is shown in the closed position.
Figure 11E:
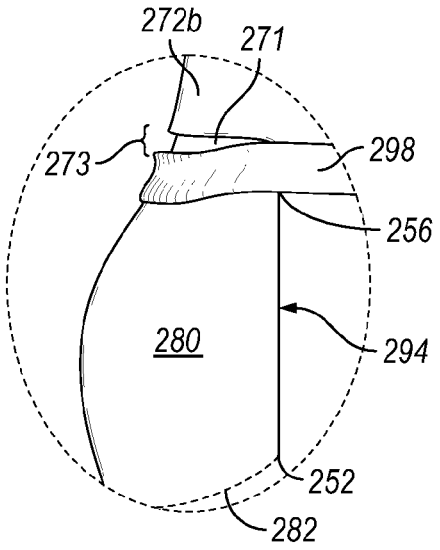
FIG. 11E illustrates the section labeled 11B in FIG. 11A showing an embodiment where no shirttails section is used, and where the drop seat side seam is hidden.
Figure 11F:
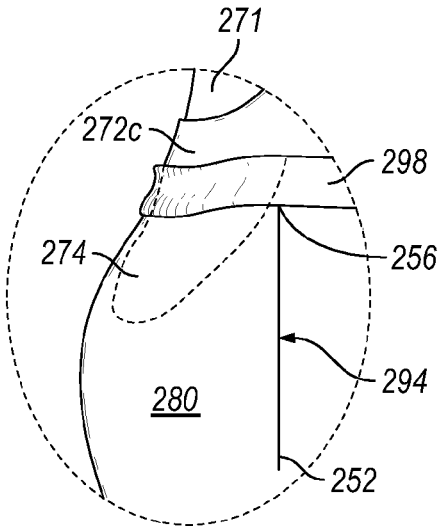
FIG. 11F illustrates the section labeled 11C in FIG. 11A showing an embodiment where a shirttails section is used, and where the drop seat side seam is hidden.

Additionally, although coveralls and bib embodiments were illustrated above, it is apparent from the present disclosure that the drop down seat panel of the present disclosure can be usefully employed with any type of one-piece garment. For example, a fashionable one-piece jumpsuits can be created as well for men, women, boys and girls. As yet another example embodiment of the present disclosure, a one-piece halter type garment 200 is illustrated in FIGS. 11A-F. In this embodiment, the drop down panel 280 can employ any of the embodiments described herein. For example, FIG. 11A shows a backless (open back 271) design where the upper torso front section 218 ties around the wearer's neck via ties (much like with a halter top style). In this backless design, the side enclosures 248 extend from the top of the enclosure 256 in the waist region downward a desired length to the bottom of the enclosure 252. This one-piece garment 200 has a right front waist section 222, right side front crotch/pelvic region (lower torso) 240, right side drop seat panel zipper 248, right side drop seat panel seam bottom 252, right side drop seat panel seam top 256 (right pant leg outside edge/seam top), a drop seat panel 280 that opens down on a drop seat panel fold line 282. In this embodiment, the enclosure is depicted as a zippered enclosure, and in the closed position, the zipper pull 249 remains hidden behind belt/sash/tie/rope 298 (which is optional). If desired for stylistic purposes, the side enclosure (e.g., zipper) 248 could be hidden 294 in seam 236. FIG. 11B illustrates a one-piece garment having a garment back waist section 272*b* that covers the wearers back but leaves a gap 273 above the waist. In FIG. 11C, there is depicted a one-piece garment having a garment back waist section 272*c* that includes fabric to cover a portion of the lower back, and also includes a shirttail tuck panel 274.

In some of the embodiments described above, the side snap tabs, side zippers that extend from the waistband down the side seams, the shirttail tuck panel and the elastic waistband all work together to make the one piece garment appear to look the same as an ordinary one piece garment. Only when the snaps are pulled and the side zippers are unzipped, does it become evident that the one piece garment of the present disclosure features a drop down panel.

The materials used for creating one-piece garments of the present disclosure are almost unlimited, constrained only by the type of use contemplated. For example, industrial PPE materials would be suitable for use with the present one-piece design for these types of applications. Disposable paper/cloth materials would be useful in those circumstances warranting single use.

Different jobs require different levels of protective clothing. DuPont offers a wide spectrum of protective clothing including fabrics, garments and accessories to meet those varying needs. From hazardous materials protection to cleanroom products, numerous fabrics exist for use on protective clothing. DuPont fabrics are used in many coverall products designed for many differing applications. Coveralls may be engineered of the following fabrics: Tyvek® IsoClean®—DuPont™ Tyvek® delivers the ideal balance of protection, durability and comfort. Made using a patented flash spinning process, Tyvek® provides an inherent barrier to particles, microorganisms and non-hazardous light liquid splash. Suprel™ LS—DuPont™ Suprel™ LS offers a more breathable alternative to Tyvek® for applications where durability and barrier are less critical. Suprel™ LS features a patented bi-component fabric based on DuPont Advanced Composite Technology. ProClean®—DuPont™ ProClean® offers non-hazardous light liquid splash protection for applications where durability and comfort are less critical. ProClean is made from a micro porous composite fabric. Tyvek® Micro-Clean® 2-1-2—DuPont™ Tyvek® Micro-Clean® 2-1-2 delivers the particle barrier, durability and comfort of Tyvek® with a unique blue color. Proprietary blue polymeric resin coating is applied to Tyvek® fabric. DuPont coveralls are offered with both bound and serged seams and available with the following processing options: clean-processed and sterile; sterile; clean-processed; bulk packaged; individually packaged.

Other fabrics include, for example, laminated polypropylene (100% latex free to help eliminate skin allergies); plain wave polyester filament fabric with a carbon yarn sheathed in polyester and constructed with silicone-free thread; herringbone weave polyester filament fabric; taffeta polyester; Indura® Ultra Soft® FR material; waterproof 2-layer PVC/polyester laminate; Arclite™ HiVis™ Foul Weather Bib-Style Trousers with an Arc Rating of 9.0 ATPV (Fluorescent Orange-Red), 7.0 ATPV (Fluorescent Yellow-Green), meeting NFPA 70E Hazard Risk Category 2 (Fluorescent Orange-Red), Category 1 (Fluorescent Yellow-Green), ANSI Class 3 Level 2 Compliance, 100% waterproof, moisture barrier is flame-resistant synthetic leather. 3M® Scotchlite™ reflective trim, significantly reduces burn injury, gives the wearer escape time and increases chances of survival; Nomex®; Nomex IIIA fabric; Indura® flame resistant materials; insultating materials, e.g., cotton SteelGuard™ duck or 7-oz. 65% polyester/35% cotton twill, both with 4-oz. polyester fiberfill insulation quilted to a nylon tricot lining; 100% acrylic shell insulated with 8-oz. polyester Hollofil®; 0.30 mm PVC Coveralls; 3M™ Scotchlite™ Reflective Material; and Durable Tychem® QC (polyethylene-coated Tyvek®).

Various one-piece garments may serve as personal protection, and include: Level A Training Suits, such as the Tychem®TK training suit—high visibility training suit featuring the panavision visor in both front and rear entry configuration.

Cleanroom applications include: pharmaceutical, biotech, medical device, microelectrolnics, non-sterile cleanrooms, ultraclean electronic applications, general applications, ATPV, A list of cleanroom fabrics and garment features can be found on Aramark's website, www. aramark-cleanroom-.com/widgets/cleanroom extractable/fab_garment_features.pdf. These fabrics include: Starshield (99% HiD Poly 1% Carbon), Maxima ESD (99% HiD Poly 1% Carbon), Integrity 1800 (99% HiD Poly 1% Carbon), C3 (99% Poly 1% Carbon), C4 & C5 (99% HiD 1% Carbon), Integrity 2000 (99% Poly 1% Carbon), Taffeta (100% Poly), Flame Resistant (98% Nomex 2% Carbon), Tyvek (Spundbound Polyolefin), Polypropylene (Spunbound Polypropylene), and SMS. SMS (spunbond-meltdblown-spunbond) fabric is strong, lightweight and breathable, designed to be a first-line disposable barrier and protect from submicron size particles including fine dust, fibers and light liquid sprays.

Although many fabrics have been noted above with respect to their specific utility for various one-piece garment applications, it will be understood that the garment of the present disclosure can be made from any suitable fabric (whether from natural or synthetic sources). The manufacturing techniques used to make the prior art one-piece garments noted above can also be employed herein. The sewing and fabrication techniques applied will be known to those of ordinary skill in the art having the benefit of the present disclosure.

Reference is now made to new FIGS. 12A through 27E. These new drawings, where applicable, employ like reference numerals as in prior embodiments, sometimes with a slight numeric (e.g., 74*a* vs. 174*a*) or alpha numeric change (e.g., 74 vs. 74*a*). The above descriptions regarding such elements are incorporated herein.

Although in the prior figures, the shirttail section 74 has been depicted as a tuckable shirttail, referring now to FIGS. 12A-12B, 13A-13B, 14, 15A-15D, 16A-16F, 17A-17G, 18A-18B, 19A-19E, 20A-20B, and 27B there is shown a shirttail section 74*a*, 174*a* that has a lower edge 76*a*, 176*a*, that is shown being oriented substantially parallel to the waist (but it could have some curvature). In these embodiments, the shirttail section 74*a*, 174*a* extends downwardly along the seams 42*a* and 44*a* along part of the zipper. The shirttail section 74*a*, 174*a* is substantially "squared off" and attached at its left and right edges along respective seams (e.g., 42*a* and 44*a*) thereby creating an extension of the garment back waist section 72 that extends below the waistline. In this embodiment, there is no "tail" to tuck in, rather, the shirttail section 74*a*, 174*a* remains as a fixed structure. In these embodiments, when the drop down seat panel, e.g., 80, 80*a*, 80*b*, 180, 280, is opened, the opening is narrower than in the other embodiments, e.g., those in FIG. 5A thereby providing more personal protection for the wearer during the time the drop seat panel is opened. This "squared off" shirttail design provides for a more personal fit for the wearer. It prevents the shirttail from crawling up, and provides additional cloth protection beneath the upper overlapping region of the drop seat panel. This provides a zone of overlap extending below the waistline. This design also minimizes the exposed skin area when the seat panel is opened thereby increasing the personal protection value of the garment. The opposed sides of the "squared off" shirttail region can be attached to the adjacent fabric, to the adjacent seams, to the zipper guard or be integrated into the design in a seamless or unitary fashion using known clothing fabrication techniques.

As discussed above, many of the embodiments employ zippers to permit the opening and closing of the drop seat panel. As an additional feature, these zippers could be designed to have a zipper shield 35 installed to provide protection between the wearer's skin and the inside of the zipper, or to otherwise provide an additional barrier behind the zipper thereby also enhancing the personal protection of the wearer. These zipper shields can be sewn in or otherwise attached along the zipper seams, and be of a width extending outwardly behind the zippers sufficient to provide backing of, or otherwise cover, the inside face of the zipper. Representative zipper shields are illustrated in FIGS. 12B, 13B, 15D, 16D-16F, 17E-17G, 19E-19F, 21A-21B, 22, 23A-23C, 24A-24C, 25, 26A-26B, and 27A-27B. The zipper shields can be formed from the same material as the garment, or can be any other desired material suitable for this use. In a preferred embodiment, the zipper shields 35 are attached or sewn onto the body of the garment along the front halves of the zipper(s) rather than being sewn or attached onto the rear halves of the zipper(s) on the drop seat panel, e.g., 80. The zipper shield or zipper guard increases the protection of the wearer by shielding the wearer from the possibility that the wearer's skin could contact the zipper (i.e., contact a metal zipper which could pose occupational health risks depending on the environment).

Additionally, for example, when a user is using the drop seat, it would be desirable to prevent the drop seat, e.g., 80, from dangling downward and potentially contacting the floor or other area where it could become soiled. As such, referring to FIGS. 27A and 27B, in another embodiment an additional one or more snaps 96*c* or other fasteners could be installed on the garment, here, preferably along the seam, below the bottom of the zipper, to permit at least one of the mated snaps 96*a* to mate with snap 96*c* to secure the drop seat panel 80 upper edge 88 close to the garment when the drop seat panel 80 is open.

Also, referring now to FIGS. 27A, 27B, 27C, 27D and 27E, as an additional feature, the garment elastic waistband 88 can be modified to provide additional adjustability in the elastic to permit a closer, more comfortable fit for the wearer. For example, referring to section 27C of FIG. 27A, there is depicted a drop panel 80 having an upper elastic waistband 88 as described previously. Referring now to FIGS. 27C, 27D and 27E, in one embodiment, the waistband 88 is modified to include an additional elastic material 89*a* having a series of button holes 89*b* disposed in spaced relation from each opposed end of the elastic 89*a*. The elastic 89*a* is embedded within the waistband 88 inside face 88*a* in a channel 88*b*, with each end of the elastic 89*a* emerging through slots 88*c* (wide, perpendicular slots) or 88*d* (narrow slot) or the like. Attached to the waistband inside face 88*a* proximate both outer ends of the waistband 88 are buttons 97 for receiving the desired button hole 89*b* of the elastic material 89*a*. In one embodiment, the elastic material 89*c* is secured to the waistband 88 at its centerpoint 89*c* via a stitch or other attachment to prevent the elastic from being pulled out of the channel 88*b*. The user can then adjust the tension on the waistband 88 by adjusting the tightness of the elastic material 89*a*, and securing the ends of the elastic to the buttons 97. Although the additional elastic band 89*a* is depicted as a rectangular band, other suitable elastic materials could be employed using appropriate fasteners, including, for example, use of elastic cord securable by cord adjuster locks (not shown) instead of buttons. This elastic 89*a* permits additional adjustability over the elastic present in waistband 88 to provide the wearer with a safer fit (by reducing gaps), a more secure fit, and a more personal fit.

Many variations of the present disclosure will be apparent to one of ordinary skill in the art having the benefit of the present disclosure. For example, the length of the opening from the waistband down the side seam can vary. The zipper lengths can be changed. Instead of the zipper, other standard clothing devices may be used to secure the sides from the waistband down the side seam to the bottom of the opening length. Pockets can be placed in any area needed on the one piece garment, such as, for example, tool pockets, pencil pockets and the like, etc. The sleeves can be made with or without cuffs. Sleeves or cuffs may be secured by using any standard clothing devices. Any type of fabric can be used to construct the one piece garment. Reflective tape can be sewn on the one piece garment. Standard clothing devices or other method of securing the bottom pants of the one piece garment can be applied. The one piece garment can be lined with various choices of lining which can be permanent or removable. The one piece garment can be made with or without a collar. Different types of collars may be used. The sleeves can be long, short, or sleeveless. The pant length can be long, short, or capri. A hood, lined or unlined, can be added to the one piece garment. The lining of the hood can be permanent or removable. The hood can be permanent or removable. Designs of any kind including but not limited to pleats, darts, sewn creases, can be added, or made onto the one piece garment. More than one color of fabric can be use to make the Easy Access Individual Needs One Piece Garment.

This specification is to be construed as illustrative only and is for the purpose of teaching those skilled in the art the manner of carrying out the invention. It is to be understood that the forms of the invention herein shown and described are to be taken as the presently preferred embodiments. As already stated, various changes may be made in the shape, size and arrangement of components or adjustments made in the steps of the method without departing from the scope of this invention. For example, equivalent elements may be substituted for those illustrated and described herein and certain features of the invention may be utilized independently of the use of other features, all as would be apparent to one skilled in the art after having the benefit of this description of the invention. Further modifications and alternative embodiments of this invention will be apparent to those skilled in the art in view of this specification.

I claim:

1. A one piece garment having a front side and a rear side comprising:

a. an upper torso section to be worn over at least a part of the upper portion of a human torso, comprising:
   i. an upper torso front panel,
   ii. an upper torso rear panel,
   iii. an upper torso right side, and
   iv. an upper torso left side,
      said upper torso section front panel meeting said upper torso rear panel section at said upper torso left side and said upper torso right side;

b. a lower torso section to be worn over at least a part of the lower portion of a human torso and at least the upper portion of the legs comprising:
   i. a lower torso front panel,
   ii. a lower torso rear panel,
   iii. a lower torso section right side,
   iv. a lower torso section left side,
      said lower torso section front panel meeting said lower torso rear panel section at said lower torso section left side and said lower torso section right side,
   v. a left side seam located along an intersection of said meeting of said lower torso rear panel section and said lower torso front panel section at said lower torso left side, and
   vi. a right side seam located along an intersection of said meeting of said lower torso rear panel section and said lower torso front panel section at said lower torso right side,
      said lower torso front panel being permanently connected with said upper torso section front panel between said left side seam and said right side seam, said lower torso rear panel being removably attachable with said upper torso section rear panel between said left side seam and said right side seam; and c. a drop seat panel capable of being opened and closed comprising:
   i. a drop seat panel top edge having left and right ends extending between said left side seam and said right side seam,
   ii. a bottom fold line having left and right ends, opposite said drop panel top edge, permanently attached to said lower torso section rear panel and extending between said left side seam and said right side seam,
   iii. a drop seat panel left side edge, having a drop seat panel left side edge top end and a drop seat panel left side edge bottom end, said drop seat panel left side edge extending downwardly from said drop seat panel left side edge top end along said left side seam to said drop seat panel left side edge bottom end at said drop panel bottom fold line left end, at least a portion of said drop seat panel left side edge being removably attachable to said lower torso front panel left side seam, said left side seam extending substantially diagonally upwardly from said drop seat panel left side edge bottom end towards said garment front side along said drop seat panel left side edge to said drop seat panel left side edge top end, when said drop seat panel is closed,
   iv. a drop seat panel right side edge, having a drop seat panel right side edge top end and a drop seat panel right side edge bottom end, said drop seat panel right side edge extending downwardly from said drop seat panel right side edge top end along said right side seam to said drop seat panel right side edge bottom end at said drop panel bottom fold line right end, at least a portion of said drop seat panel right side edge being removably attachable to said lower torso front panel right side seam, said right side seam extending substantially diagonally upwardly from said drop seat panel right side edge bottom end towards said garment front side along said drop seat panel right side edge to said drop seat panel right side edge top end, when said drop seat panel is closed,
   v. a drop seat panel left seam zipper fastener for removably attaching said at least a portion of said drop panel left side edge to said lower torso front panel along said left side seam, said left side seam further comprising a flap of material extending outwardly behind said zipper, and
   vi. a drop seat panel right seam zipper fastener for removably attaching said at least a portion of said drop panel right side edge to said lower torso front panel along said right side seam, said right side seam further comprising a flap of material extending outwardly behind said zipper.

2. The one piece garment of claim 1 wherein said zippers are hidden within said respective left or right seams.

3. The one piece garment of claim 1 wherein said drop panel right side edge and said drop panel left side edge have lengths extending from about a waist region of the human torso to the bottom of a pants leg section.

4. The one piece garment of claim 1 wherein said drop panel right side edge and said drop panel left side edge have lengths extending from about the waist region of the human torso to the ankles region of the human.

5. The one piece garment of claim 1 wherein said drop panel top edge is removably attachable to said upper torso section rear panel and said garment further comprises a drop panel top edge zipper fastener for removably connecting said drop panel top edge to said upper torso section rear panel, said upper torso section rear panel further comprising a flap of material extending outwardly behind said zipper.

6. The one piece garment of claim 5 wherein said drop panel left seam, said drop panel right seam, and said drop panel top edge further comprise a unitary zipper enclosure to permit said desired removable attachment.

7. The one piece garment of claim 6 wherein said zipper extends between said drop panel bottom fold line left end, said left side seam, said drop panel top edge left side, said drop panel top edge, said drop panel top edge right side, said right side seam, and said drop panel bottom fold line right end.

8. The one piece garment of claim 1 wherein said drop seat panel top edge left end and drop seat panel top edge right end further comprise additional fasteners for fastening to said lower torso front panel, said fasteners being selected from the group consisting of: snaps, snap tabs, buttons, clips, hooks, belts, sashes, ropes, and ties.

9. The one piece garment of claim 1 wherein said left side seam and said right side seam are substantially diagonal in orientation.

10. The one piece garment of claim 1 wherein said upper torso rear panel further comprises a shirttail tuck panel extending downwardly below a waist region of the human torso, the shirttail panel having left and right side edges defining the depth of the shirttail and a lower edge extending between the left and right side edges of the shirttail tuck panel.

11. The one piece garment of claim 10 wherein the shirttail tuck panel left and right side edges are respectively attached to the lower torso front panel left side and right side seams.

12. The one piece garment of claim 11 wherein the shirttail tuck panel lower edge is substantially parallel to the waist region.

13. The one piece garment of claim 10 wherein the shirttail extends downwardly to a depth of about half way down the right and left side zipper seams.

14. The one piece garment of claim 1 wherein said drop panel top edge has elastic waist band material attached thereto or integrated therein.

15. The one piece garment of claim 14 wherein the elastic waist band material further comprises:

a. an inside face, b. an elastic band having opposed ends and comprising a plurality of button holes along its length, c. a channel in the inside face for housing the elastic band, the channel having opposed slots, the elastic band opposed ends extending outwardly from within said channel through said respectively opposed slots, d. a first button attached to the inside face proximate one of said slots for securing the elastic band via one of said button holes and a second button attached to the inside face proximate the other one of said slots for securing the elastic band via another one of said button holes.

16. The one piece garment of claim 1 further comprising storm flaps to cover said drop left side seam, said right side seam and said drop seat panel top edge when said drop seat panel is in its closed position.

17. The one piece garment of claim 1 wherein said at least a portion of said drop seat panel left side edge is said drop panel left side edge top; and wherein said at least a portion of said drop seat panel right side edge is said drop panel right side edge top.

18. The one piece garment of claim 1 wherein substantially the entire portion of said drop seat panel left side edge is removably attachable to said lower torso front panel left side seam, and wherein substantially the entire portion of said drop seat panel right side edge is removably attachable to said lower torso front panel right side seam.

19. A one piece garment having a front side and a rear side comprising:

a. an upper torso section to be worn over at least a part of the upper portion of a human torso, comprising:

i. an upper torso front panel, ii. an upper torso rear panel having a shirttail tuck panel, iii. an upper torso right side, and iv. an upper torso left side, said upper torso section front panel meeting said upper torso rear panel section at said upper torso left side and said upper torso right side;

b. a lower torso section to be worn over at least a part of the lower portion of a human torso and at least the upper portion of the legs comprising:

i. a lower torso front panel, ii. a lower torso rear panel, iii. a lower torso section right side, iv. a lower torso section left side, said lower torso section front panel meeting said lower torso rear panel section at said lower torso section left side and said lower torso section right side, v. a left side seam located along an intersection of said meeting of said lower torso rear panel section and said lower torso front panel section at said lower torso left side, and vi. a right side seam located along an intersection of said meeting of said lower torso rear panel section and said lower torso front panel section at said lower torso right side, said lower torso front panel being permanently connected with said upper torso section front panel between said left side seam and said right side seam, said lower torso rear panel being removably attachable with said upper torso section rear panel between said left side seam and said right side seam; and c. a drop seat panel capable of being opened and closed comprising:

i. a drop seat panel top edge having left and right ends extending between said left side seam and said right side seam, ii. a bottom fold line having left and right ends, opposite said drop panel top edge, permanently attached to said lower torso section rear panel and extending between said left side seam and said right side seam, iii. a drop seat panel left side edge, having a drop seat panel left side edge top end and a drop seat panel left side edge bottom end, said drop seat panel left side edge extending downwardly from said drop seat panel left side edge top end along said left side seam to said drop seat panel left side edge bottom end at said drop panel bottom fold line left end, wherein substantially all of said drop seat panel left side edge is removably attachable to said lower torso front panel left side seam, said left side seam extending substantially diagonally upwardly from said drop seat panel left side edge bottom end towards said garment front side along said drop seat panel left side edge to said drop seat panel left side edge top end, when said drop seat panel is closed, iv. a drop seat panel right side edge, having a drop seat panel right side edge top end and a drop seat panel right side edge bottom end, said drop seat panel right side edge extending downwardly from said drop seat panel right side edge top end along said right side seam to said drop seat panel right side edge bottom end at said drop panel bottom fold line right end, wherein substantially all of said drop seat panel right side edge is removably attachable to said lower torso front panel right side seam, said right side seam extending substantially diagonally upwardly from said drop seat panel right side edge bottom end towards said garment front side along said drop seat panel right side edge to said drop seat panel right side edge top end, when said drop seat panel is closed, v. a drop seat panel left seam fastener for removably attaching said drop panel left side edge to said lower torso front panel along said left side seam, said left side seam further comprising a flap of material extending outwardly behind said zipper, and vi. a drop seat panel right seam fastener for removably attaching said drop panel right side edge to said lower torso front panel along said right side seam, said right side seam further comprising a flap of material extending outwardly behind said zipper, wherein said drop seat panel top edge left end and drop seat panel top edge right end further comprise additional fasteners for fastening to said lower torso front panel, said fasteners being selected from the group consisting of: snaps, snap tabs, buttons, clips, hooks, belts, sashes, ropes, and ties.

* * * * *